US011014355B2

(12) United States Patent
Eto

(10) Patent No.: US 11,014,355 B2
(45) Date of Patent: May 25, 2021

(54) LIQUID FEEDING UNIT AND LIQUID EJECTION DEVICE

(71) Applicant: KYOCERA Document Solutions Inc., Osaka (JP)

(72) Inventor: Daisuke Eto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/563,088

(22) Filed: Sep. 6, 2019

(65) Prior Publication Data

US 2020/0086642 A1 Mar. 19, 2020

(30) Foreign Application Priority Data

Sep. 19, 2018 (JP) ..... JP2018-174990

(51) Int. Cl.
*B41J 2/14* (2006.01)
*B41J 2/175* (2006.01)
*B41J 2/19* (2006.01)

(52) U.S. Cl.
CPC ..... *B41J 2/14* (2013.01); *B41J 2/17563* (2013.01); *B41J 2/17596* (2013.01); *B41J 2/19* (2013.01)

(58) Field of Classification Search
CPC ..... B41J 2/19; B41J 2/17596; B41J 2/17563; B41J 2/1753; B41J 2/14; B41J 2/235; B41J 25/304; B41J 29/02; B41J 29/54
See application file for complete search history.

(56) References Cited

U.S. PATENT DOCUMENTS 8,360,540 B2 * 1/2013 Ito ..... B41J 29/02 347/6
8,678,547 B2 * 3/2014 Nitta ..... B41J 2/16585 347/33
2005/0073559 A1 4/2005 Aruga et al. ..... 347/85

FOREIGN PATENT DOCUMENTS

WO WO 03/041964 A1 5/2003

* cited by examiner

*Primary Examiner* — Thinh H Nguyen
(74) *Attorney, Agent, or Firm* — Stein IP, LLC

(57) ABSTRACT

A liquid feeding unit has a first chamber, a second chamber, a wall portion, an opening-closing member, and a filter member. The first chamber has a first feed passage connected to it to receive liquid through the first feed passage. The second chamber receives the liquid from the first chamber, and has a second feed passage for feeding the liquid connected to it. The wall portion has a communication hole through which the first and second chambers communicate with each other. The opening-closing member is arranged in the communication hole to open and close it. The filter member is arranged in the first feed passage or in the first chamber to remove foreign matter in the liquid.

10 Claims, 51 Drawing Sheets

LIQUID FEEDING UNIT AND LIQUID EJECTION DEVICE

INCORPORATION BY REFERENCE

This application is based on and claims the benefit of Japanese Patent Application No. 2018-174990 filed on Sep. 19, 2018, the contents of which are hereby incorporated by reference.

BACKGROUND

The present disclosure relates to a liquid feeding unit that feeds a liquid ejection head with liquid stored in a liquid storage container, and relates also to a liquid ejection device that employs such a liquid feeding unit.

For example, an inkjet printer employs a liquid ejection head that ejects tiny amounts of ink (liquid) onto a printing target. The liquid ejection head is fed with ink through a predetermined feed passage from an ink cartridge (liquid storage container) in which the ink is stored. In a case where ink is fed from the ink cartridge to the liquid ejection head by exploiting a head difference, a liquid feeding unit (valve unit) furnished with a pressure chamber for keeping the ejection apertures in the liquid ejection head at a negative pressure is arranged in the feed passage. Owing to the interposition of the liquid feeding unit that produces the negative pressure, even when ink is fed by head-difference feeding, it is possible to prevent unlimited dripping of ink from the ejection apertures.

Such a conventional liquid feeding unit employs, for example, a structure where part of the negatively pressurized pressure chamber is demarcated by flexible film and a pressing plate (pressure receiving plate) fitted to the flexible film directly presses a movable valve. The movable valve is biased by a biasing member in the direction opposite to the direction of that pressing. As the liquid ejection head sucks ink and the degree of negative pressure in the pressure chamber increases, the flexible film is displaced and so the movable valve is pressed by the pressing plate and moves; eventually, an ink feed passage leading to the pressure chamber opens and ink flows in. As ink flows in and the degree of negative pressure in the pressure chamber decreases, the movable valve is moved in the opposite direction by the biasing force of the biasing member, and the pressure chamber returns to a hermetically sealed state.

SUMMARY

According to one aspect of the present disclosure, a liquid feeding unit includes a first chamber, a second chamber, a wall portion, an opening-closing member, and a filter member. The first chamber has a first feed passage connected to it, and is fed with liquid through the first feed passage. The second chamber is fed with the liquid from the first chamber, and has a second feed passage for feeding the liquid connected to it. The wall portion has a communication hole through which the first and second chambers communicate with each other. The opening-closing member is arranged in the communication hole to open and close the communication hole. The filter member is arranged in the first feed passage or in the first chamber to remove foreign matter in the liquid This and other objects of the present disclosure, and the specific benefits obtained according to the present disclosure, will become apparent from the description of embodiments which follows.

DETAILED DESCRIPTION

Overall Structure of a Printer

Figure 1:
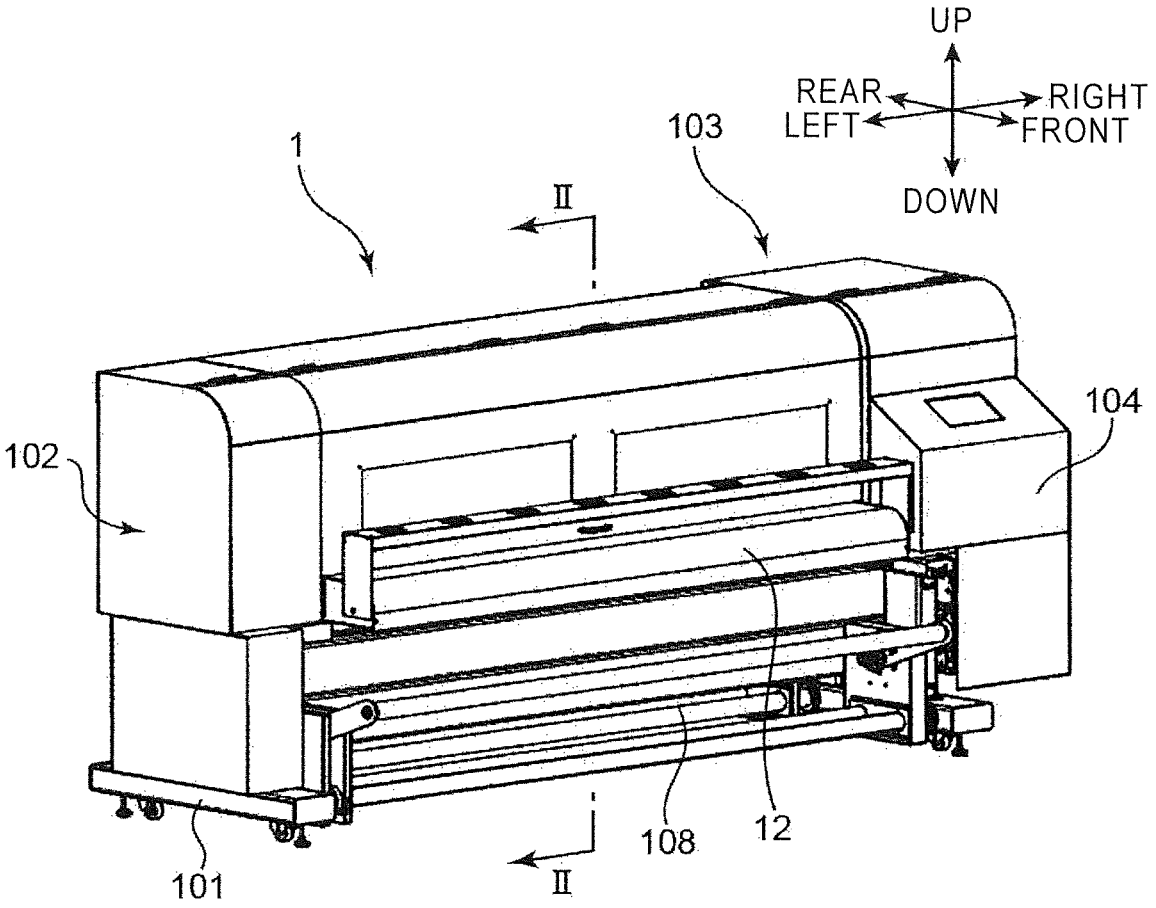
FIG. 1 is a perspective view showing the appearance of an inkjet printer to which the present disclosure is applied.
Figure 2:
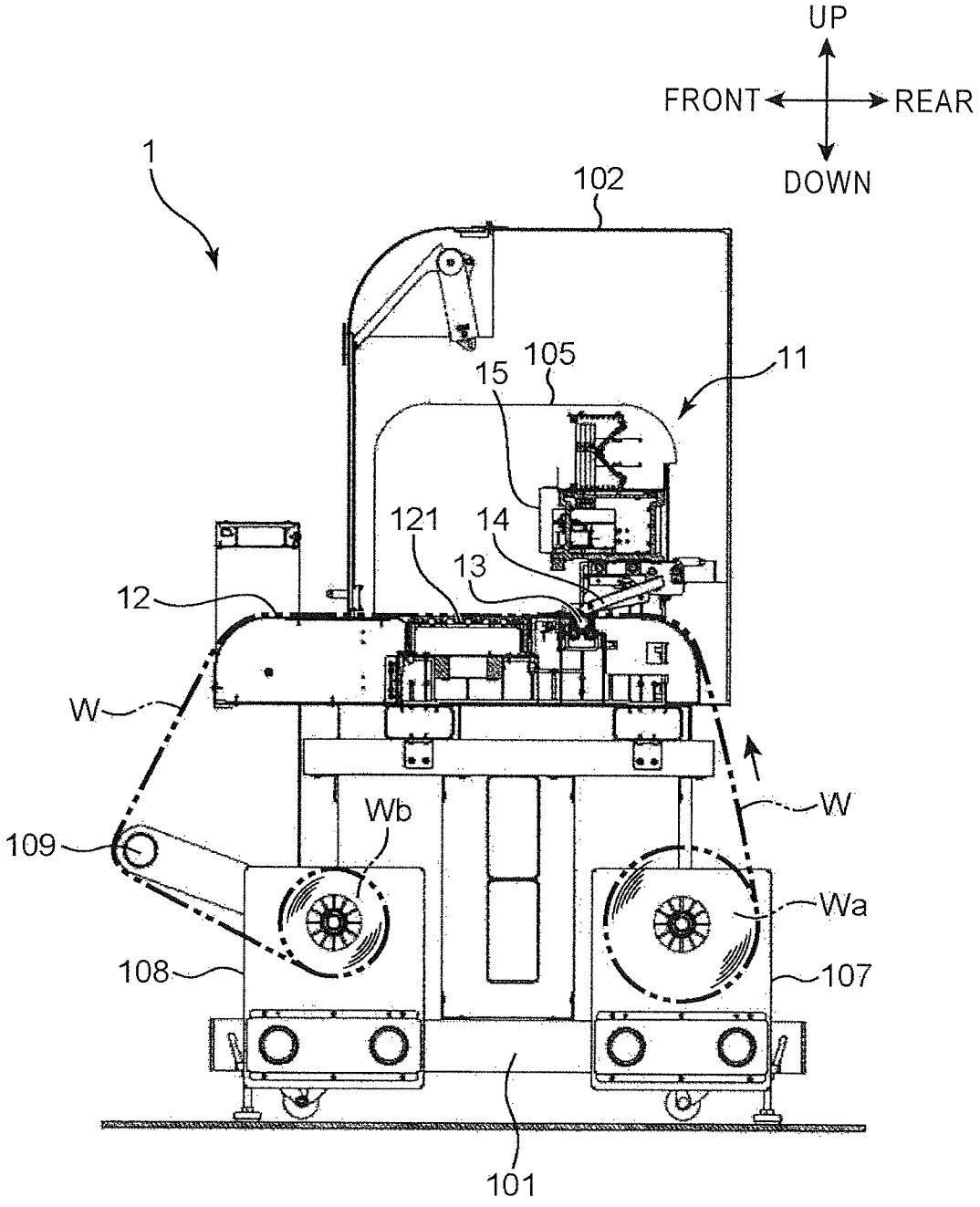
FIG. 2 is a sectional view across line II-II in FIG. 1.
Figure 3:
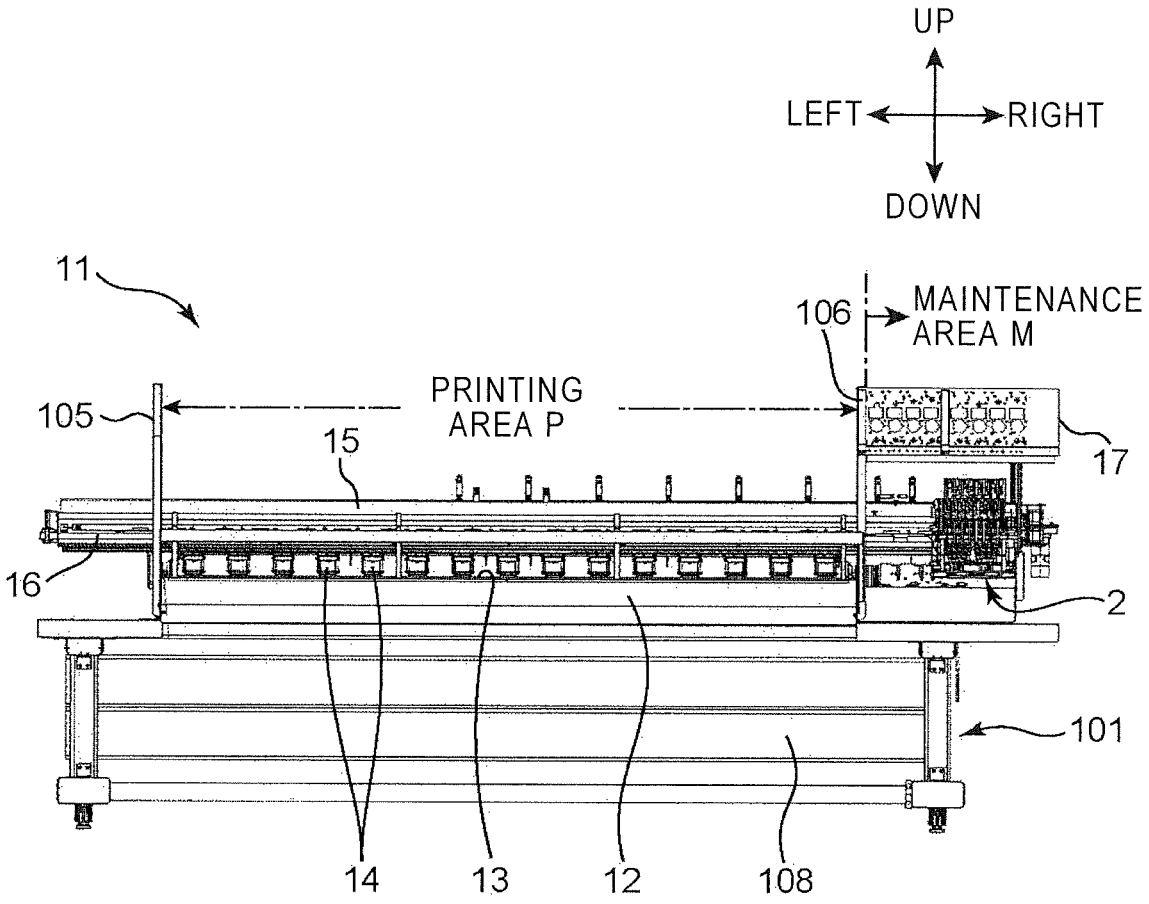
FIG. 3 is a front view of the inkjet printer in a state with an outer cover removed.

One embodiment of the present disclosure will be described below with reference to the accompanying drawings. First, a description will be given of an inkjet printer which is the target of application of a liquid feeding unit or a liquid ejection device according to the present disclosure. FIG. 1 is a perspective view showing the appearance of an inkjet printer 1 according to the embodiment. FIG. 2 is a sectional view across line II-II in FIG. 1. FIG. 3 is a front view of the inkjet printer 1 in a state with an outer cover 102 removed. The indications of front, rear, left, right, up, and down directions in FIGS. 1 to 3 and in the relevant ones of the following drawings are merely for the sake of convenience in description, and are not meant as any limitation associated with directions.

The printer 1 (liquid ejection device) is a printer that performs printing, such as character printing and image printing, by an inkjet process on different kinds of workpiece W, such as paper and resin sheets of different sizes and pieces of fabric, and that is particularly suitable for printing directed to large-size, continuous workpieces. The printer 1 includes a base frame 101 that has casters and a device body 11 that is mounted on the base frame 101 and that performs printing as mentioned above.

The device body 11 includes a workpiece conveying passage 12, a conveying roller 13, pinch roller units 14, and a carriage 2. The workpiece conveying passage 12 is a conveying passage that extends in the front-rear direction, for conveying a workpiece W to be subjected to printing into the device body 11 from its rear side and out of the device body 11 from its front side. The conveying roller 13 is a roller that extends in the left-right direction and that produces a driving force by which the workpiece W is fed intermittently through the workpiece conveying passage 12. The pinch roller units 14 are each arranged so as to face the conveying roller 13 from above, and includes pinch rollers (not shown) that form a conveying nip with the conveying roller 13. The plurality of pinch roller units 14 are arranged at predetermined intervals in the left-right direction.

The carriage 2 is a movable member on which a unit that performs printing on the workpiece W is mounted and that can reciprocate in the left-right direction on the base frame 101. At the rear side of the base frame 101, a carriage guide 15, including a guide rail for guiding the reciprocating movement of the carriage 2, is provided upright so as to extend in the left-right direction. To the carriage guide 15, a timing belt 16 is fitted to be able to go around in the left-right direction. The carriage 2 has a fastened portion that is fastened to the timing belt 16, and moves in the left-right direction, while being guided by the guide rail, as the timing belt 16 goes around in forward or reverse rotation.

Printing is achieved by the conveying roller 13 and the pinch roller units 14 feeding the workpiece W intermittently and, while the workpiece W is at rest, the carriage 2 moving in the left-right direction to scan the workpiece W for printing (ejecting ink to the workpiece W). In the workpiece conveying passage 12, under the path through which the carriage 2 passes, a platen 121 (FIG. 2), furnished with the function of suction-attracting the workpiece W, is arranged. During printing, the workpiece W in a state suction-attracted onto the platen 121 is scanned by the carriage 2 for printing.

The device body 11 is covered with an outer cover 102. In a region on the right side of the outer cover 102, a side station 103 is arranged. The side station 103 houses in it a stationary ink cartridge rack 17 that holds an ink cartridge IC (FIG. 5) that stores ink (predetermined liquid) for printing.

A front part of the side station 103 is a carriage retract area 104 into which the carriage 2 can retract. As shown in FIG. 3, on the base frame 101, a left frame 105 and a right frame 106 are provided upright with an interval between them that corresponds to the workpiece conveying passage 12 in the left-right direction. Classified by working area, the region between the left and right frames 105 and 106 is a printing area P (processing area) in which printing can be performed. The carriage guide 15 has a left-right width that is larger than the printing area P, and the carriage 2 is movable up to outside the printing area P rightward. The right-end side of the carriage guide 15, that is, a region adjoining the printing area P on the right is a maintenance area M. When no printing is performed, the carriage 2 is retracted in the maintenance area M (carriage retract area 104). Also a pressurized purging process, which will be described later, is performed in the carriage retract area 104.

At the rear side of the base frame 101, a feed-out portion 107, which accommodates a feeding roll Wa, which is a roll of the workpiece W as the target of printing, is provided. At the front side of the base frame 101, a wind-up portion 108, which accommodates a winding roll Wb, which is a roll of the workpiece W having undergone printing, is provided. The wind-up portion 108 includes a driving source (not shown) that drives the winding spindle of the winding roll Wb, and winds up the workpiece W while keeping it under a predetermined tension with a tension roller 109.

Structure of the Carriage

Figure 4:
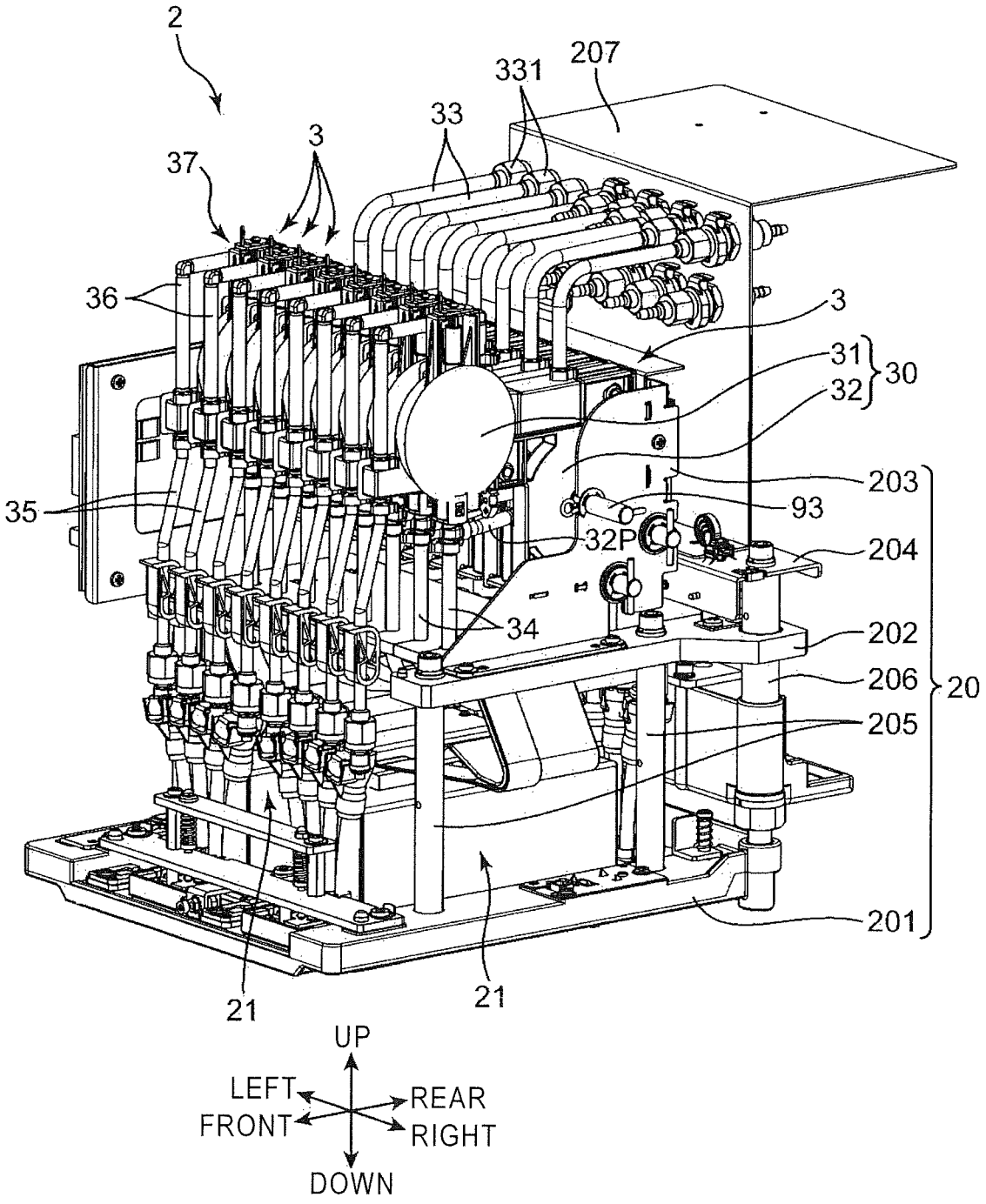
FIG. 4 is an overall perspective view of a carriage mounted in the inkjet printer.

FIG. 4 is an overall perspective view of the carriage 2. On the carriage 2, there are mounted a head unit 21 (liquid ejecting head) that ejects ink (liquid) onto the workpiece W and a liquid feeding unit 3 that supplies the head unit 21 with ink. FIG. 4 shows an example where two head units 21 and eight liquid feeding units 3 are mounted on the carriage 2. Specifically, for one head unit 21, four liquid feeding units 3 are provided to feed it with cyan, magenta, yellow, and black ink respectively. The liquid feeding units 3 may be loaded with ink of different colors respectively so that the two head units 21 eject ink of a maximum of eight colors.

The carriage 2 includes the head unit 21 and a carriage frame 20 that holds the head units 21. The carriage frame 20 includes a lower-tier frame 201 located at the lowermost position, an upper-tier frame 202 arranged over the lower-tier frame 201 at an interval from it, a rack 203 fitted to the top face of the upper-tier frame 202, and a rear frame 204 fitted to the rear face of the upper-tier frame 202. The lower-tier and upper-tier frames 201 and 202 are coupled together by coupling posts 205 that extend in the up-down direction. On the rear frame 204, an unillustrated ball-screw mechanism is mounted, and a nut portion that is driven by a ball screw there is fitted to the lower-tier frame 201. The rear frame 204 includes a guide post 206 that extends in the up-down direction. By being driven by the ball-screw mechanism, the coupled unit of the lower-tier and upper-tier frames 201 and 202 can move in the up-down direction while being guided by the guide post 206. That is, the body portion of the carriage 2 can move in the up-down direction relative to the rear frame 204. On the rear frame 204, a rear plate 207 is provided upright, to which the upstream end 331 of an upstream pipe 33, which will be mentioned later, is fitted.

On the lower-tier frame 201, the head units 21 are mounted. Since the body portion of the carriage 2 is movable in the up-down direction as mentioned above, the height position of the head units 21 relative to the workpiece Win the up-down direction can be adjusted. On the upper-tier frame 202, the liquid feeding units 3 are mounted. The eight liquid feeding units 3 are, in a state aligned in the left-right direction within the rack 203, supported by the upper-tier frame 202. The rear frame 204 includes a guided portion (not shown) that is guided by the above-mentioned guide rail of the carriage guide 15, a fastened portion (not shown) that is fastened to the timing belt 16, etc.

Figure 5:
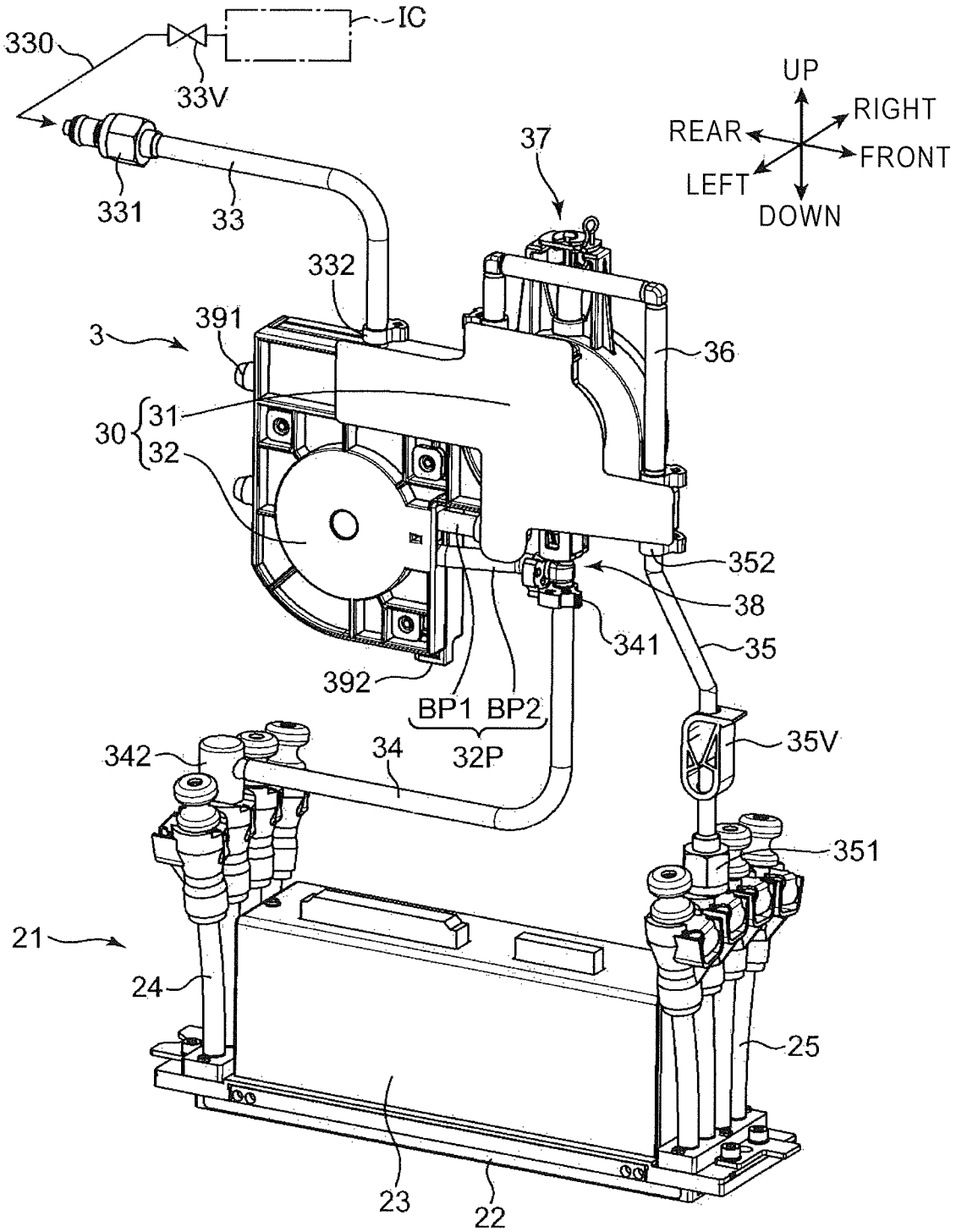
FIG. 5 is a perspective view showing one liquid feeding unit and one head unit.

FIG. 5 is a perspective view showing one liquid feeding unit 3 and one head unit 21. The liquid feeding unit 3 includes a body portion 30 that includes a tank portion 31 and a pump portion 32, an upstream pipe 33 that is arranged upstream of the body portion 30 with respect to the ink feed direction (liquid feed direction), a downstream pipe 34 that is arranged downstream of the body portion 30, a return pipe 35 that constitutes a passage through which ink is returned from the head unit 21 to the liquid feeding unit 3, a monitor pipe 36, and a bypass pipe 32P.

The tank portion 31 is a region that forms a space in which ink that is fed to the head unit 21 in a negative-pressure environment is temporarily stored. The pump portion 32 is a region that houses a pump 9 (FIGS. 7, 8, 9A, and 9B) which is operated in a depressurizing process for forming the negative-pressure environment, in a pressurized purging process for cleaning the head unit 21 (an ink ejection portion 22), and in a circulating process for circulating ink between the head unit 21 and the liquid feeding unit 3.

The upstream pipe 33 is a feed pipe through which the tank portion 31 (a second chamber 42) communicates with an ink cartridge IC (liquid storage container). The upstream end 331 of the upstream pipe 33 is connected to the terminal-end portion of a tube 330 led out of the ink cartridge IC. The downstream end 332 of the upstream pipe 33 is connected to an inlet portion of the tank portion 31. To the tube 330, a feed valve 33V, serving to open and close the upstream pipe 33, is fitted. With the feed valve 33V open, ink can be fed from the ink cartridge IC to the tank portion 31. With the feed valve 33V closed, ink cannot be fed from the ink cartridge IC to the tank portion 31. The ink cartridge IC, the upstream pipe 33, and the feed valve 33V may be part of the liquid feeding unit 3.

The downstream pipe 34 is a feed pipe through which the tank portion 31 (second chamber 42) communicates with the head unit 21. The upstream end 341 of the downstream pipe 34 is connected via a backflow prevention mechanism portion 38, which will be mentioned later, to an outlet portion of the tank portion 31. The downstream end 342 of the downstream pipe 34 is connected to the head unit 21. The return pipe 35 is a pipe through which the head unit 21 communicates with the tank portion 31 (second chamber 42). The upstream end 351 of the return pipe 35 is connected to the head unit 21. The downstream end 352 of the return pipe 35 is connected to the tank portion 31. A clip 35V for opening and closing the return pipe 35 is attached to the return pipe 35. FIG. 5 shows a state where the clip 35V holds the return pipe 35 squashed and thus closed. The monitor pipe 36 is a pipe that indicates the ink level in the tank portion 31. The bypass pipe 32P is a pipe passage for feeding ink to the downstream pipe 34 without going through the negative-pressure environment (second chamber 42) in the tank portion 31. The bypass pipe 32P includes a bypass upstream pipe BP1 and a bypass downstream pipe BP2. The bypass upstream pipe BP1 is arranged upstream of the pump portion 32, and the bypass downstream pipe BP2 is arranged downstream of the pump portion 32.

The head unit 21 includes the ink ejection portion 22, a control unit portion 23, an end tube 24, and a collection tube 25. The ink ejection portion 22 is a nozzle portion that ejects ink to the workpiece W. The ink ejection portion 22 can eject ink droplets, for example, by a piezoelectric method using piezoelectric elements, a thermal method using heating elements, or the like. The control unit portion 23 includes a control board (not shown) that controls the piezoelectric elements (not shown) or heating elements (not shown) provided in the ink ejection portion 22, and controls the ejection of ink droplets from the ink ejection portion 22.

The end tube 24 is a tube that connects the downstream end 342 of the downstream pipe 34 to the ink ejection portion 22. The downstream end 342 is a socket, so that it can be attached with a single action to the upper-end fitting portion of the end tube 24. The collection tube 25 is a tube that connects the ink ejection portion 22 to the upstream end 351 of the return pipe 35. The collection tube 25 is used also, at initial use, to discharge the preservative liquid sealed in the liquid feeding unit 3. At initial use, the downstream end 342 of the downstream pipe 34 is attached to the upper-end fitting portion of the end tube 24, and a separate tube is connected to the collection tube 25; thus the storage space for the preservative liquid is opened up so that the preservative liquid is discharged.

Figure 6A:
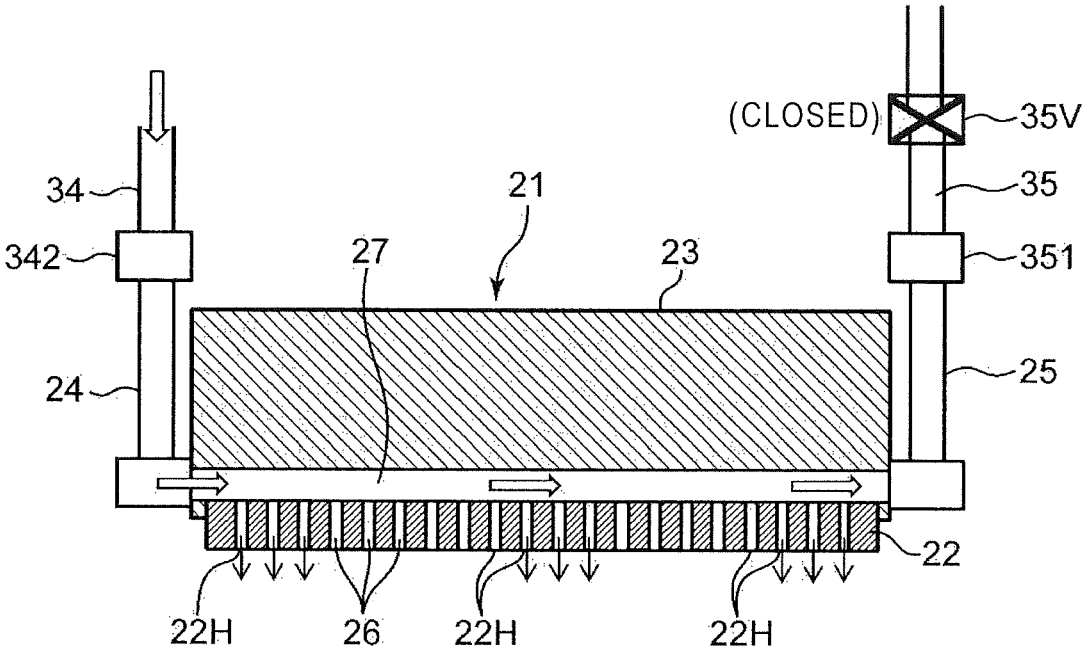
FIG. 6A is a diagram schematically showing a section of the head unit in the front-rear direction, showing a state where a printing mode is performed.
Figure 6B:
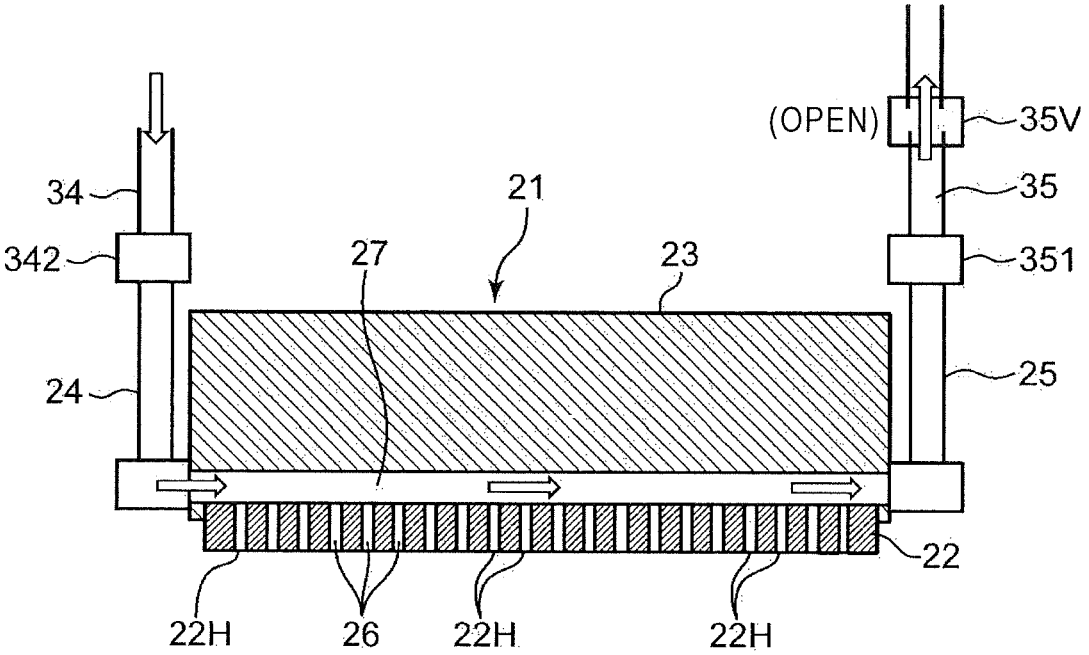
FIG. 6B is a diagram schematically showing a section of the head unit in the front-rear direction, showing a state where a circulating mode is performed.

FIGS. 6A and 6B are diagrams schematically showing a section of the head unit 21 in the front-rear direction. FIG. 6A shows a state with the clip 35V closed (printing mode). FIG. 6B shows a state with the clip 35V open (circulating mode). The ink ejection portion 22 has a plurality of ink ejection holes 22H through which ink is ejected toward the workpiece W. The head unit 21 has inside it individual passages 26 through which ink is fed to the ink ejection holes 22H individually and a common passage 27 through which ink is fed to the individual passages 26.

The common passage 27 is an ink passage that extends in the horizontal direction. The upstream ends of the individual passages 26 communicate with the common passage 27. The downstream end 342 of the downstream pipe 34 communicates via the end tube 24 with the upstream side of the common passage 27. The upstream end 351 of the return pipe 35 communicates via the collection tube 25 with the downstream side of the common passage 27. In other words, the upstream side of the common passage 27 communicates via the downstream pipe 34 with the tank portion 31 (second chamber 42), and the downstream side of the common passage 27 communicates via the return pipe 35 with the tank portion 31 (first chamber 41).

As shown in FIG. 6A, when, in a state with the return pipe 35 closed by the clip 35V, ink is fed from the downstream pipe 34 to the head unit 21, the ink passes through the common passage 27 and the individual passages 26 and is ejected from the ink ejection holes 22H. By contrast, as shown in FIG. 6B, when, with the clip 35V released and thus the return pipe 35 open, ink is fed from the downstream pipe 34 to the head unit 21, the ink passes exclusively through the return pipe 35 and returns to the tank portion 31. Here, keeping the return pipe 35 under negative pressure prevents ink from leaking through the ink ejection holes 22H.

Outline of a Liquid Feeding System

In the embodiment, the ink cartridge IC is arranged above the head unit 21, so that ink is fed to the head unit 21 due to a head difference. In a structure where ink is fed due to a head difference, feeding the ink under ordinary pressure would result in the ink being ejected constantly from the ink ejection portion 22 of the head unit 21. To prevent that, the ink ejection portion 22 needs to be kept under adequate negative pressure with a negative pressure generation portion, for producing a negative-pressure environment, inserted in the ink feed passage. The tank portion 31 in the liquid feeding unit 3 functions as such a negative pressure generation portion.

Figure 7:
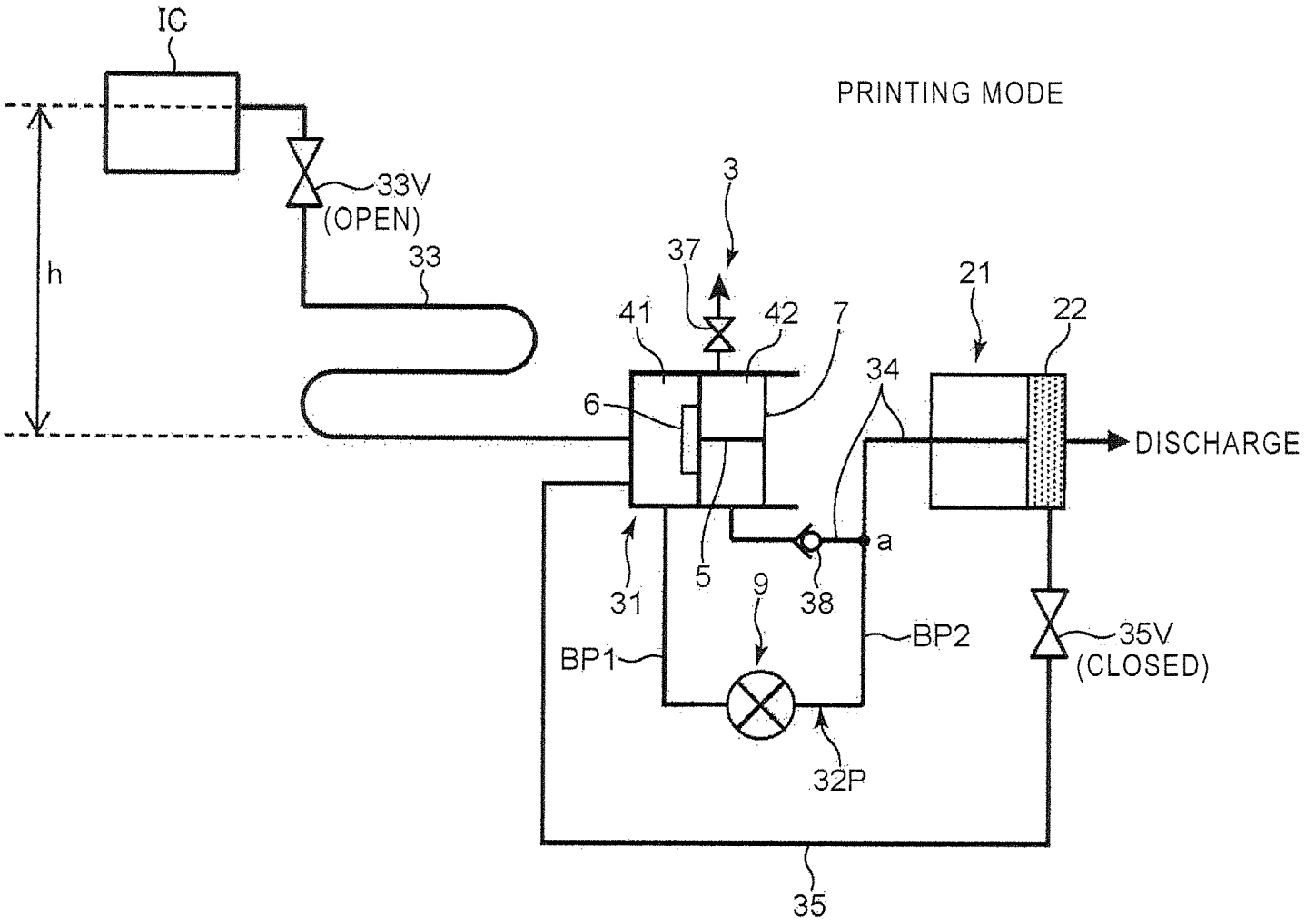
FIG. 7 is a block diagram showing a liquid feeding system according to an embodiment, showing a state where the printing mode is performed.
Figure 8:
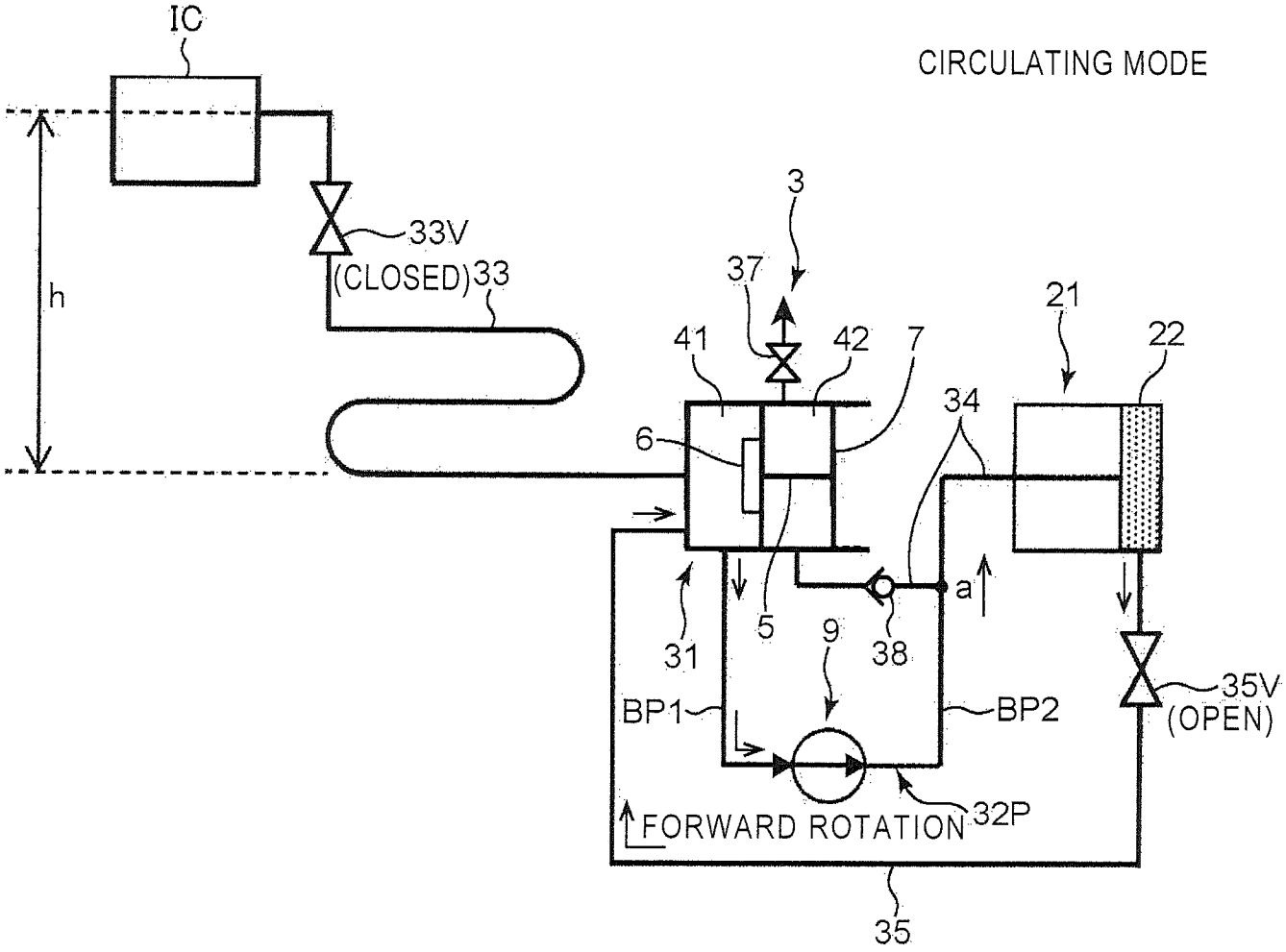
FIG. 8 is a block diagram showing a state where the circulating mode is performed.
Figure 9A:
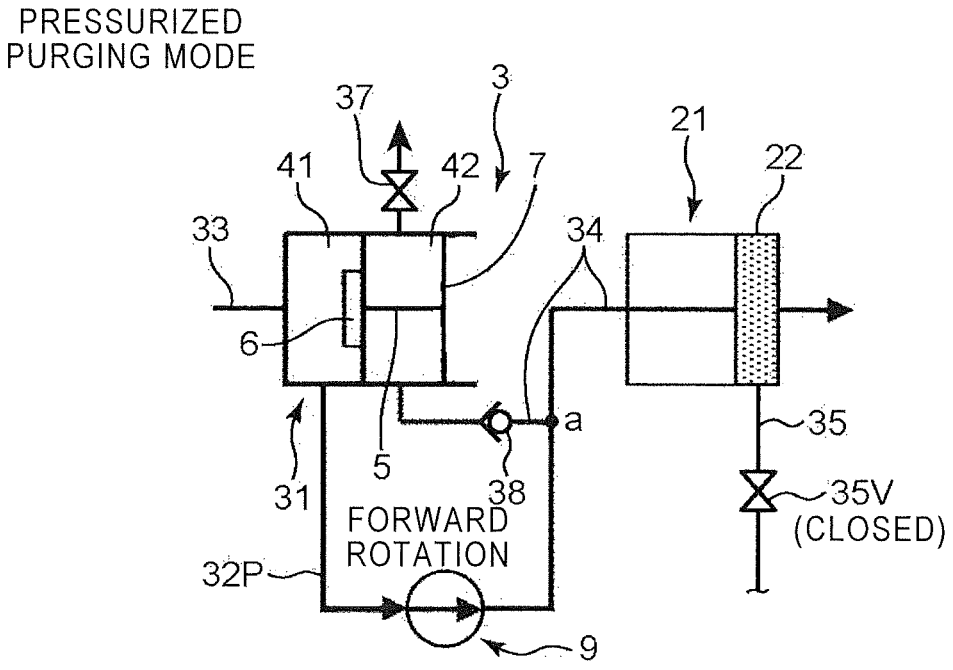
FIG. 9A is a diagram showing a state where a pressurized purging mode is performed.
Figure 9B:
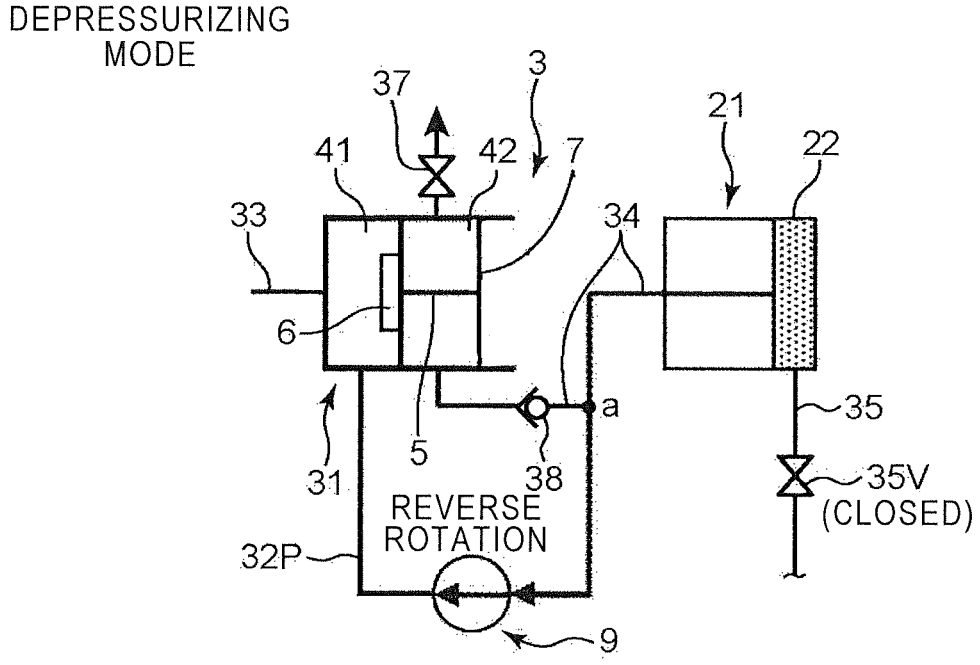
FIG. 9B is a diagram showing a state where a depressurizing mode is performed.

FIGS. 7, 8, 9A, and 9B are each a block diagram schematically showing the liquid feeding system adopted in the carriage 2 according to the embodiment. They schematically show the ink cartridge IC, the liquid feeding unit 3, and the head unit 21; that is to say, they do not accurately show the positions and orientations of the ink cartridge IC, the liquid feeding unit 3, and the head unit 21 respectively. It should be noted, however, that, in FIGS. 7 and 8, the symbol "h" indicates that the ink cartridge IC is arranged at a position higher than the ink ejection portion 22 by a height h. In FIGS. 9A and 9B, part of the liquid feeding system is omitted; specifically, the ink cartridge IC, part of the upstream pipe 33, the feed valve 33V, and part of the return pipe 35 are omitted.

In FIG. 7, the height h is the head difference. Due to the head difference, the ink in the ink cartridge IC is fed to the head unit 21. The liquid feeding unit 3 is built in the middle of the ink feed passage between the ink cartridge IC and the head unit 21. The tank portion 31 in the liquid feeding unit 3 has a first chamber 41 that remains at a pressure (first pressure) higher than the atmospheric pressure due to the head difference and a second chamber 42 that is arranged downstream of the first chamber 41 with respect to the ink feed direction and that is set at negative pressure (a second pressure lower than the first pressure). The first chamber 41 is a chamber that is not negatively pressurized and that is acted on by, in addition to the atmospheric pressure, the pressure P due to the head difference. The pressure P is given by $P=\rho gh$ (Pa), where $\rho$ represents ink density, g represents acceleration of gravity, and h represents head difference. The density of ink can be considered equal to that of water for most practical purposes.

The first chamber 41 communicates via the upstream pipe 33 with the ink cartridge IC. The second chamber 42 communicates via the downstream pipe 34 with the ink ejection portion 22.

The first and second chambers 41 and 42 are demarcated from each other by a wall portion, in which a opening-closing valve 6 (opening-closing member) is arranged. The opening-closing valve 6 is coupled to a pressing member 5. Part of the wall portion that demarcates the second chamber 42 is formed by an atmospheric pressure sensing film 7 (flexible film member). When the negative pressure (the absolute value of the negative pressure) in the second chamber 42 exceeds a predetermined threshold value, the atmospheric pressure sensing film 7 senses the atmospheric pressure and is displaced accordingly. The displacing force acts on the pressing member 5, and switches the opening-closing valve 6 coupled to it from a closed state to an open state, letting the first and second chambers 41 and 42 communicate with each other.

The ink feed route in regular printing is a route that runs through the upstream pipe 33, the first chamber 41, the second chamber 42, and the downstream pipe 34. In addition, the bypass pipe 32P is provided through which the first chamber 41 is short-circuited to the downstream pipe 34 without going through the second chamber 42. The upstream end of the bypass pipe 32P is connected via the first chamber 41 to the upstream pipe 33. The downstream end of the bypass pipe 32P joins the downstream pipe 34 (a joint portion a). In the bypass pipe 32P, a pump 9 that can operate in forward and reverse rotation is arranged.

FIG. 7 shows a state where the printing mode, in which the liquid feeding system performs printing, is performed. In the printing mode, the feed valve 33V in the upstream pipe 33 is open, while the clip 35V on the return pipe 35 is closed. In the printing mode, the first and second chambers 41 and 42 are loaded with ink, and the second chamber 42 is kept under a predetermined negative pressure. As mentioned above, the pressure in the first chamber 41 equals, due to the head difference, Atmospheric Pressure+$\rho gh$ (Pa), and this maintains a state where ink can be fed from the ink cartridge IC due to the head difference at any time. The basic settings in the printing mode include the opening-closing valve 6 being kept closed to keep the second chamber 42 under negative pressure, with the first and second chambers 41 and 42 isolated from each other. The pump 9 is kept at rest. The pump 9 is a tube pump (peristaltic pump), and when the pump 9 is at rest, the bypass pipe 32P is closed. This keeps also the downstream pipe 34 and the ink ejection portion 22 under negative pressure.

For smooth loading of the second chamber 42 with ink, the second chamber 42 is fitted with an air vent mechanism 37. At initial use or after maintenance, the second chamber 42 needs to be initially loaded with a predetermined amount of ink. The air vent mechanism 37 permits the second chamber 42, which is set in an negative-pressure environment, to communicate with the atmosphere temporarily (so that air will be vented from the second chamber 42), and thereby promotes the initial loading. In some cases, air bubbles may develop in the ink in the second chamber 42 under heat. The air vent mechanism 37 is used also to remove air resulting from such air bubbles from the second chamber 42.

As the head unit 21 operates and the ink ejection portion 22 ejects ink droplets, the ink in the second chamber 42 is consumed and the degree of negative pressure in the second chamber 42 gradually increases. That is, every time the ink ejection portion 22 ejects ink droplets, the ink ejection portion 22 sucks ink from the second chamber 42, which is isolated from the atmosphere, and this gradually increases the degree of negative pressure in the second chamber 42. When the ink in the second chamber 42 has decreased until the negative pressure (the absolute value of the negative pressure) in the second chamber 42 exceeds the above-mentioned threshold value, then, as mentioned above, the atmospheric pressure sensing film 7 senses the atmospheric pressure and is displaced accordingly. The displacing force switches, via the pressing member 5, the atmospheric pressure sensing film 7 from a closed state to an open state, and this lets the first and second chambers 41 and 42 communicate with each other. Now, due to the pressure difference between the two chambers, ink flows out of the first chamber 41 into the second chamber 42.

As ink flows into the second chamber 42, the degree of negative pressure in the second chamber 42 is gradually reduced, becoming increasingly close to the atmospheric pressure. Concurrently, the displacing force acting from the atmospheric pressure sensing film 7 on the pressing member 5 decreases gradually. When the negative pressure (the absolute value of the negative pressure) in the second chamber 42 falls below the above-mentioned predetermined threshold value, the opening-closing valve 6 returns to the closed state, bringing the first and second chambers 41 and 42 back into a state isolated from each other. Meanwhile, due to the head difference, the first chamber 41 is replenished with so much ink from the ink cartridge IC as the amount that has flowed out of the first chamber 41 into the second chamber 42. In the pressurized ink, the operation described above is repeated.

In the liquid feeding system according to the embodiment, it is possible to perform not only the printing mode described above but also a circulating mode, a pressurized purging mode, and a depressurizing mode. The circulating mode is a mode in which ink is circulated through the return pipe 35 so that air trapped in the ink passage (the individual passages 26 and the common passage 27) in the head unit 21 will be discharged. The pressurized purging mode is a mode in which, with a view to eliminating or preventing an ink clog in the ink ejection portion 22, high-pressure ink is fed to and ejected from the ink ejection portion 22. The depressurizing mode is a mode for setting the second chamber 42 at the above-mentioned predetermined negative pressure. For example, at initial use or after maintenance, the second chamber 42 is at ordinary pressure; performing the depressurizing mode sets the second chamber 42 at the above-mentioned predetermined negative pressure.

FIG. 8 is a block diagram showing a state where the circulating mode is performed. In the circulating mode, the feed valve 33V is closed so that the upstream pipe 33 is closed, while the clip 35 is open so that the return pipe 35 is open. The pump 9 arranged in the bypass pipe 32P is driven in forward rotation. As shown in FIGS. 6A and 6B, the upstream end 351 of the return pipe 35 communicates with the downstream end of the common passage 27 in the head unit 21. On the other hand, the downstream end 352 (FIG. 5) of the return pipe 35 communicates with the first chamber 41. The downstream end 352 of the return pipe 35 communicates, via the first chamber 41 with which it communicates directly and via the opening-closing valve 6, also with the second chamber 42.

In the circulating mode, when the pump 9 is driven in forward rotation, ink circulates through a circulation passage that runs through the bypass downstream pipe BP2, the part of the downstream pipe 34 downstream of the joint portion a, the common passage 27 in the head unit 21, the return pipe 35, and the bypass upstream pipe BP1. Meanwhile, since the feed valve 33V is closed, the ink sucking operation of the pump 9 keeps the return pipe 35 and the common passage 27 under negative pressure. This prevents ink from leaking through the ejection holes 22H. Performing the circulating mode makes it possible to collect air that has entered the head unit 21 back into the liquid feeding unit 3 (first chamber 41). It is thus possible to prevent air from being detained in the individual passages 26 and the ejection holes 22H, and to suppress ink ejection failure. The air collected in the first chamber 41 can be moved to the second chamber 42 via the opening-closing valve 6; it is then discharged to outside by the air vent mechanism 37.

FIG. 9A is a diagram showing a state where the pressurized purging mode is performed. In the pressurized purging mode, the pump 9 is driven in forward rotation. The clip 35V is closed. With the pump 9 driven in forward rotation, ink passes from the upstream pipe 33 through the first chamber 41 and the bypass pipe 32P directly to the downstream pipe 34 without going through the second chamber 42. That is, ink pressurized by the pump 9 is fed to the ink ejection portion 22. Thus, ink is forcibly ejected from the ink ejection portion 22, and thereby the ink ejection portion 22 is cleaned. Operation similar to that in the pressurized purging mode is performed to discharge, at initial use, the preservative liquid sealed in the liquid feeding unit 3.

When the pressurized purging mode is performed, to prevent a backflow of pressurized ink through the downstream pipe 34 to the second chamber 42, a backflow prevention mechanism portion 38 is provided. The backflow prevention mechanism portion 38 is arranged in the downstream pipe 34 upstream of the joint portion a between the downstream pipe 34 and the downstream end of the bypass pipe 32P. The backflow prevention mechanism portion 38 closes the part of the downstream pipe 34 upstream of the joint portion a. Thus, all the high-pressure ink produced in the bypass pipe 32P flows toward the ink ejection portion 22. This prevents breakage of the atmospheric pressure sensing film 7 which demarcates the second chamber 42.

In FIG. 9A, part of the liquid feeding system is omitted, and the feed valve 33V is not shown. As will be mentioned later with reference to FIG. 31, in the pressurized purging mode, the feed valve 33V is open.

FIG. 9B is a diagram showing a state where the depressurizing process is performed. In the depressurizing mode, the pump 9 is driven in reverse rotation. The clip 35V is closed. With the pump 9 driven in reverse rotation, the ink ejection portion 22 and the second chamber 42 are depressurized through the downstream pipe 34 and the bypass pipe 32P. In the depressurizing mode, the ink ejection portion 22 and the second chamber 42 are set at a predetermined negative pressure, specifically at such a negative pressure that, even when head-difference feeding is performed, no ink droplets drip from the ink ejection portion 22. Setting the ink ejection portion 22 at an excessive negative pressure may hamper ink ejection achieved by the driving of the piezoelectric elements or the like in the ink ejection portion 22. Accordingly, it is preferable that the second chamber 42 be set at a low negative pressure of about, for example, −0.2 to −0.7 kPa.

In FIG. 9B, part of the liquid feeding system is omitted, and the feed valve 33V is not shown. As mentioned above, the depressurizing mode can be performed even when head-difference feeding is performed. In that case, the feed valve 33V is open. On the other hand, the depressurizing mode is performed to set the second chamber 42 at a predetermined negative pressure. That is, the main purpose of the depressurizing mode is not the feeding of ink. Accordingly, the feed valve 33V may be closed.

Overall Structure of the Liquid Feeding Unit

Figure 10A:
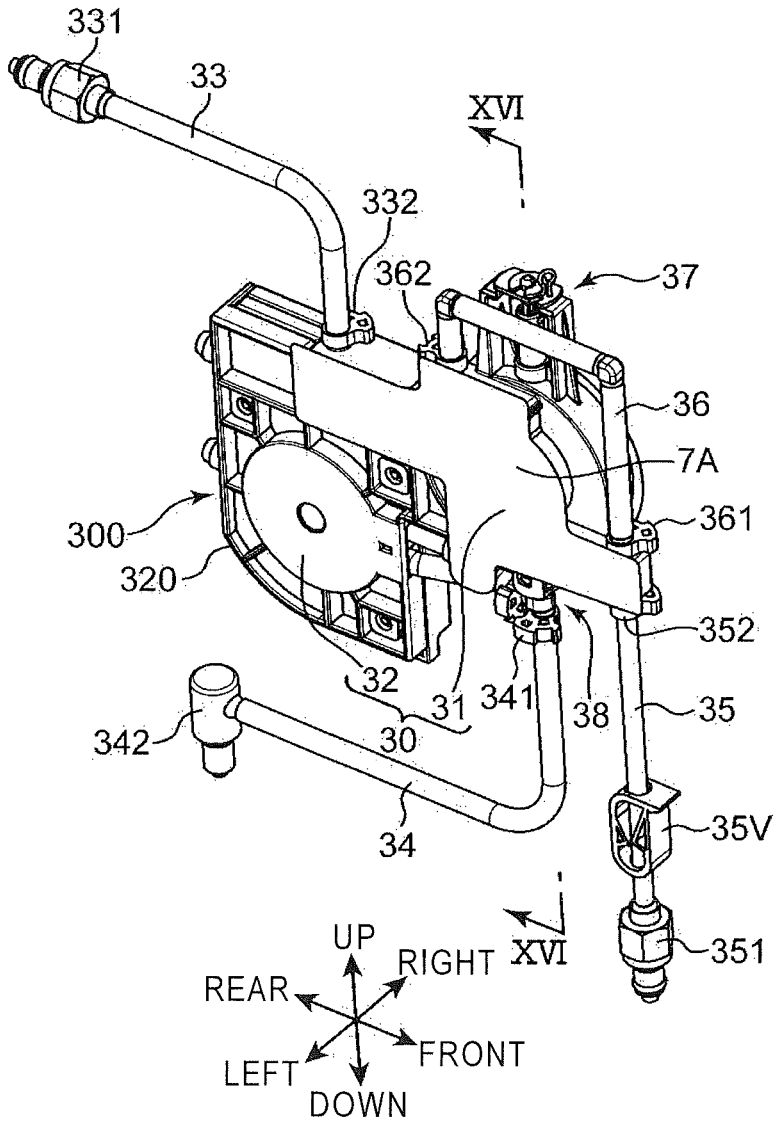
FIG. 10A is a perspective view showing the liquid feeding unit as seen from a first chamber.
Figure 10B:
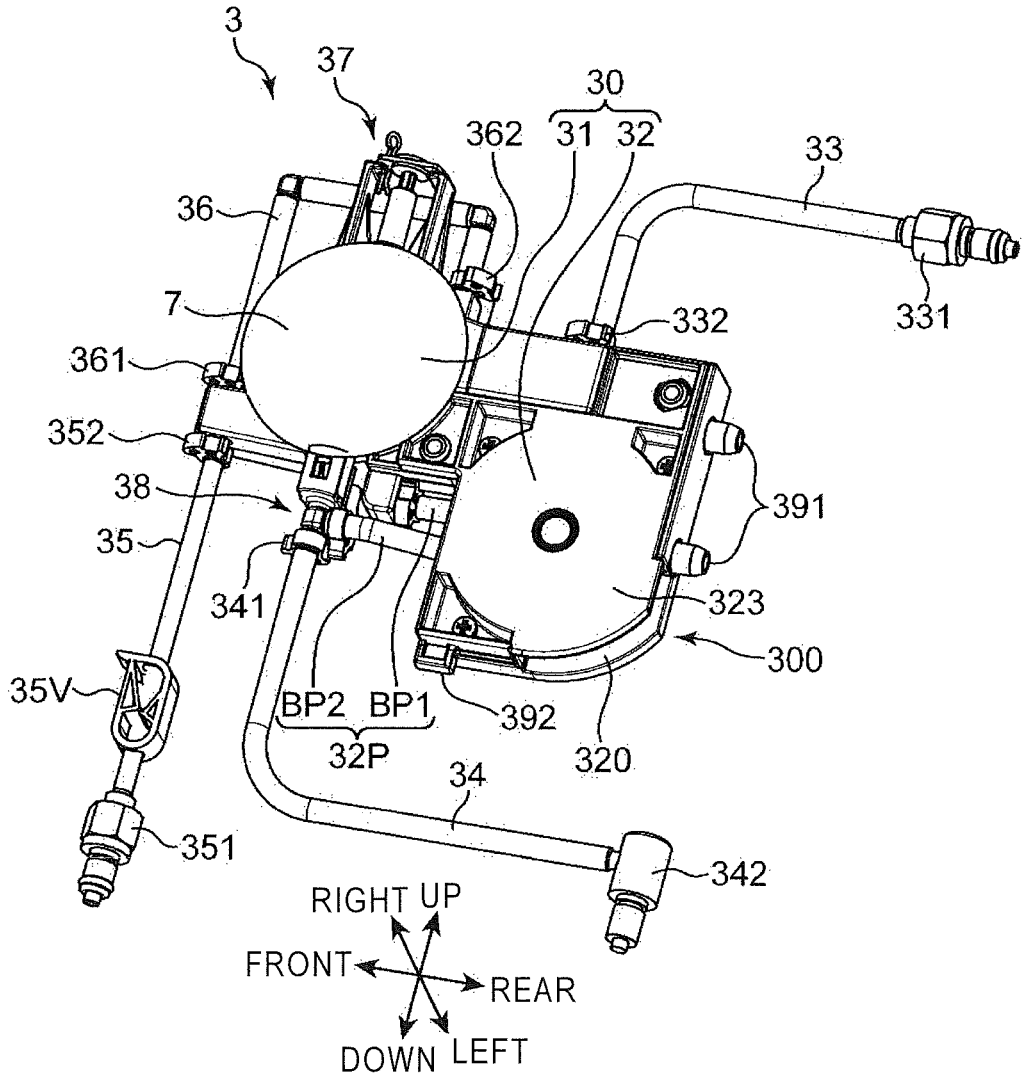
FIG. 10B is a perspective view showing the liquid feeding unit as seen from a second chamber.
Figure 11:
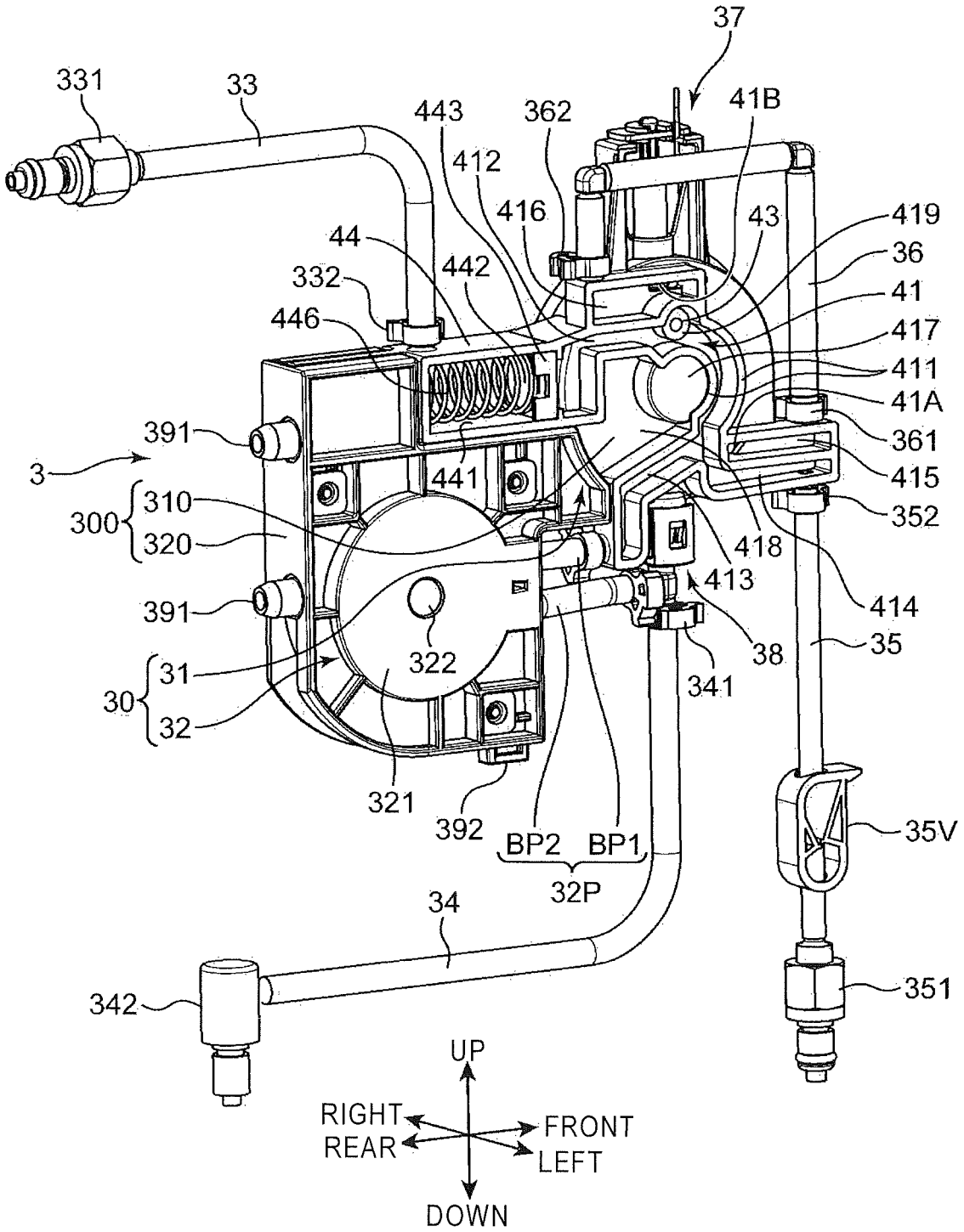
FIG. 11 is a perspective view of the liquid feeding unit in a state with a first chamber-side sealing film removed.
Figure 12A:
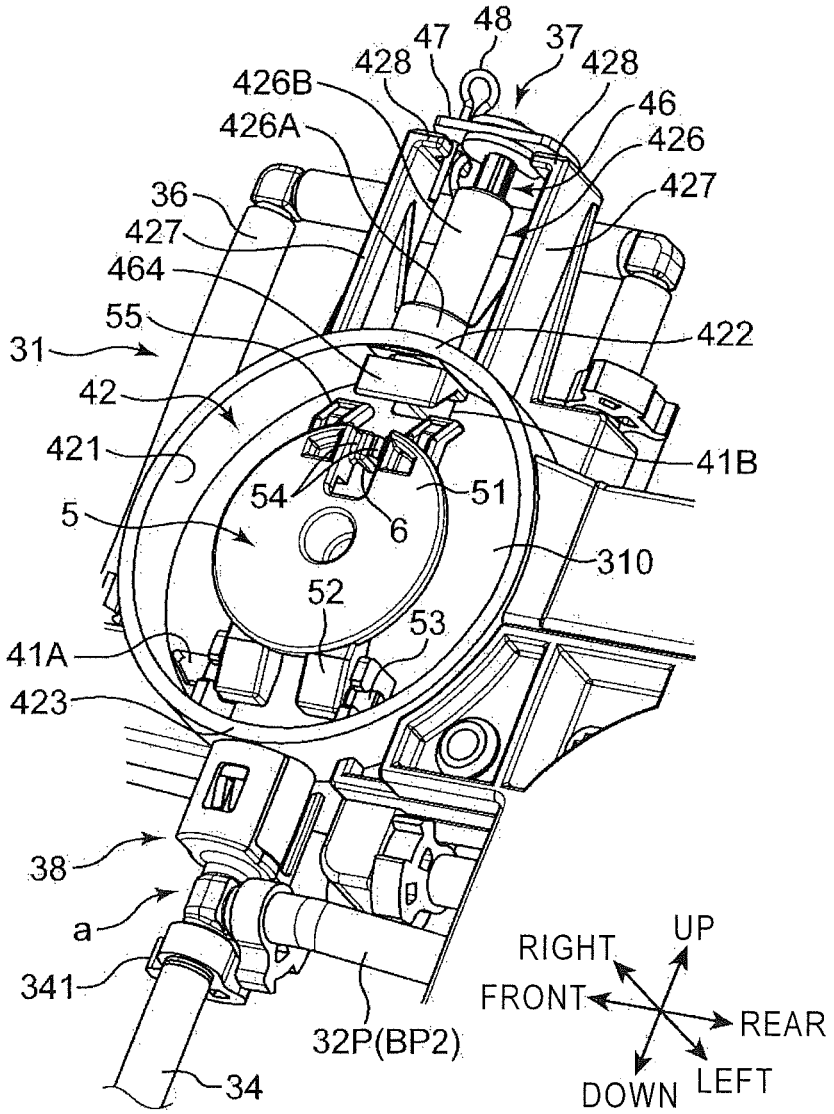
FIGS. 12A, 12B, and 12C are perspective views of the liquid feeding unit in a state with a second chamber-side atmospheric pressure sensing film removed.
Figure 12B:
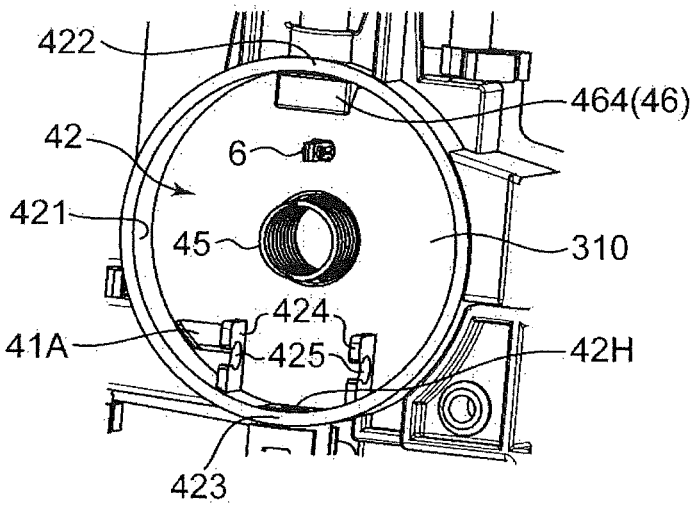
Figure 12C:
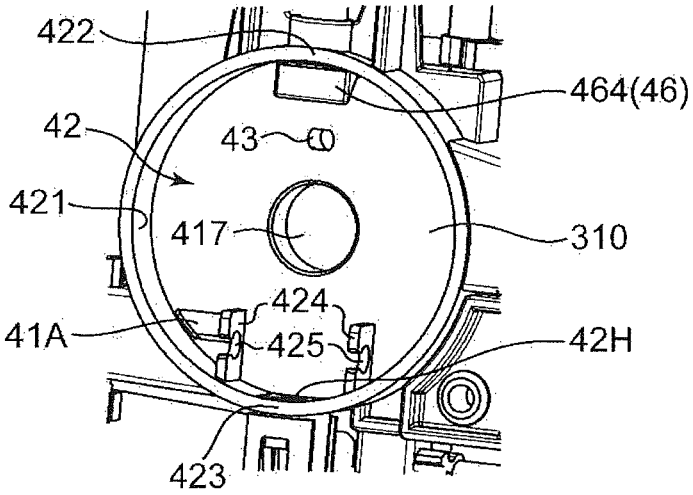
Figure 13:
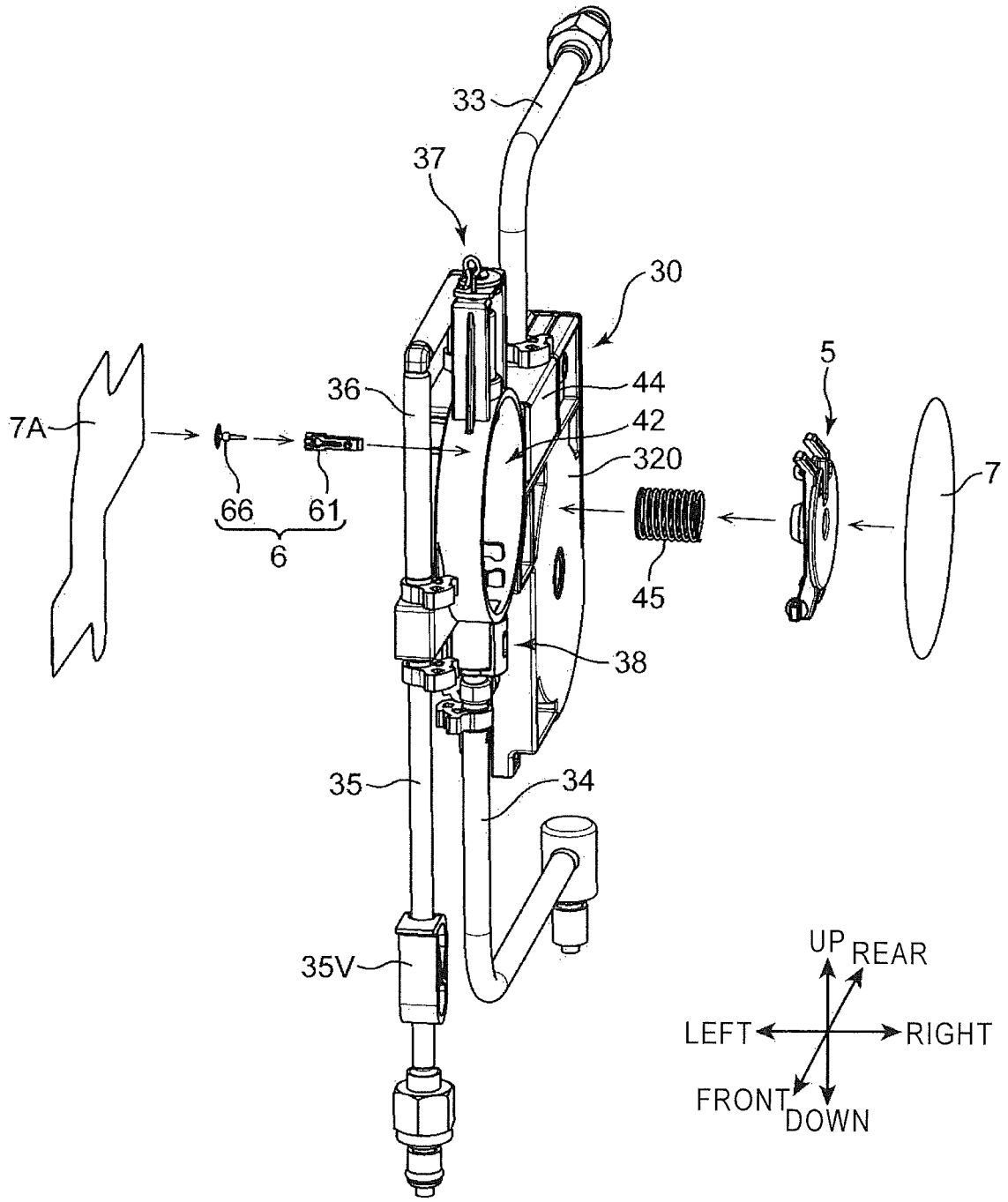
FIG. 13 is an exploded perspective view of the liquid feeding unit.

Next, a detailed description will be given of the structure of the liquid feeding unit 3 according to the embodiment that enables the liquid feeding system to operate in the different modes described above. FIGS. 10A and 10B are each a perspective view of the liquid feeding unit 3. FIG. 10A is a perspective view as seen from the first chamber 41 side. FIG. 10B is a perspective view as seen from the second chamber 42 side. FIG. 11 is a perspective view of a state with a first chamber 41 side sealing film 7A removed. FIGS. 12A, 12B, and 12C are each a perspective view of the liquid feeding unit 3 in a state with a second chamber 42 side atmospheric pressure sensing film 7 removed. FIG. 13 is an exploded perspective view of the liquid feeding unit 3.

As described in an introductory fashion with reference to FIGS. 7, 8, 9A, and 9B, the liquid feeding unit 3 includes the body portion 30 including the tank portion 31 and the pump portion 32, the upstream pipe 33, the downstream pipe 34, the return pipe 35, the bypass pipe 32P, the air vent mechanism 37, the backflow prevention mechanism portion 38, the pressing member 5, the opening-closing valve 6, and the atmospheric pressure sensing film 7. The liquid feeding unit 3 further includes the monitor pipe 36 for the monitoring of the ink liquid surface in the second chamber 42 and a sealing film 7A that forms part of the wall face that demarcates the first chamber 41.

The body portion 30 has a base member 300 (FIG. 11) formed of a flat plate that extends in the front-rear direction. A front-side part of the base member 300 is a tank portion base plate 310 (wall portion) which serves as the base plate for the tank portion 31. A rear-side part of the base member 300 is a pump portion housing 320 which forms a housing structure in the pump portion 32. On the left-face side of the tank portion base plate 310, the first chamber 41 is arranged, and on the right-face side of the tank portion base plate 310, the second chamber 42 is arranged. The first and second chambers 41 and 42 are each a space that can store ink. Through the tank portion base plate 310, a communication hole 43 is formed through which the first and second chambers 41 and 42 communicate with each other. In the communication hole 43, the opening-closing valve 6 mentioned previously is arranged.

As shown in FIG. 11, the first chamber 41 is a small-width space roughly in a U-shape as seen in a plan view from left. The first chamber 41 is demarcated by a first demarcation wall 411 that is provided to protrude leftward from the tank portion base plate 310. The first demarcation wall 411 is composed of a pair of wall segments that face each other across a predetermined distance. The upstream end of the first chamber 41 constitutes an inflow portion 412, which communicates with a filter chamber 44, which will be mentioned later. The ink that is fed from the upstream pipe 33 to the tank portion 31 passes through the filter chamber 44 and flows via the inflow portion 412 into the first chamber 41.

The first chamber 41 is so shaped as to extend horizontally frontward from the inflow portion 412 and then curve downward. To the downstream end of the first chamber 41, a bypass communication chamber 413 and a return communication chamber 414 are connected. The bypass communication chamber 413 is a partition for connecting together the first chamber 41 and the bypass upstream pipe BP1. To a part of the wall portion that demarcates near the lower end of the bypass communication chamber 413, the upstream end of the bypass upstream pipe BP1 is connected. The return communication chamber 414 is a partition for connecting together the first chamber 41 and the return pipe 35. To a part of the wall portion that demarcates near the front end of the return communication chamber 414, the downstream end 352 of the return pipe 35 is connected. In FIGS. 7 and 8, the return communication chamber 414 is dealt with as part of the return pipe 35.

Over the return communication chamber 414, a lower monitor communication chamber 415 is arranged. Over a horizontal part of the first chamber 41, an upper monitor communication chamber 416 is arranged. The upstream end 361 of the monitor pipe 36 communicates with the lower monitor communication chamber 415. The downstream end 362 of the monitor pipe 36 communicates with the upper monitor communication chamber 416. As shown in FIGS. 11, 12A, 12B, and 12C, through the tank portion base plate 310, a lower communication hole 41A and an, upper communication hole 41B arranged above the lower communication hole 41A are formed. The lower monitor communication chamber 415 communicates via the lower communication hole 41A with the second chamber 42. The upper monitor communication chamber 416 communicates via the upper communication hole 41B with the second chamber 42. That is, the monitor pipe 36 communicates with the upper-end and lower-end sides of the second chamber 42, and the ink liquid level in the monitor pipe 36 reflects the ink liquid level in the second chamber 42.

In the embodiment, the monitor pipe 36 is formed of transparent resin tube. Thus, the user can, by viewing the monitor pipe 36, observe the ink liquid level in the second chamber 42. In the embodiment, as shown in FIG. 4, a plurality of liquid feeding units 3 are arranged side by side in the left-right direction on the carriage 2. Thus, even when transparent film is used as the atmospheric pressure sensing film 7 located on the right side face, the user cannot observe the ink liquid level in the second chamber 42 except with respect to the rightmost liquid feeding unit 3. However, in the embodiment, the monitor pipe 36 is provided upright at the front of the liquid feeding unit 3. Thus, the user can, by viewing from in front of the carriage 2 the monitor pipe 36 of each liquid feeding unit 3, observe the ink liquid level in the corresponding second chamber 42.

Near the middle of the first chamber 41 in the up-down direction, a spring seat 417, which is a cavity in a cylindrical shape, is provided to protrude leftward. The spring seat 417 is a cavity that accommodates a biasing spring 45, which will be mentioned later, and is open toward the second chamber 42. The first chamber 41 is designed to make a half turn around the outer circumference wall of the spring seat 417. Behind the spring seat 417, a spacer chamber 418 is provided. The spacer chamber 418 is provided to minimize the volume of the first chamber 41. A first chamber 41 with a large volume would have to store an accordingly large amount of ink. When the carriage 2 moves, a swinging force acts on the liquid feeding unit 3. A large weight of ink, with its inertia, might cause exfoliation or breakage of the atmospheric pressure sensing film 7 and the sealing film 7A. Where there is no such concern, the spacer chamber 418 may be omitted, and the first chamber 41 may be formed to encircle the spring seat 417.

The communication hole 43 is arranged in the first chamber 41, at a position over the spring seat 417. In the first chamber 41, a boss 419 in a cylindrical shape protrudes leftward from the tank portion base plate 310. The communication hole 43 is formed so as to penetrate the boss 419 in the left-right direction. The first chamber 41 is a chamber that is not subjected to depressurizing or the like and that is acted on by, in addition to the atmospheric pressure, the pressure P=ρgh due to the head difference. When ink flows via the inflow portion 412 into the first chamber 41, it starts to collect ink starting in the bypass communication chamber 413 and the return communication chamber 414. When the liquid level of the ink has passed the communication hole 43, the ink is then ready to be fed via the communication hole 43 to the second chamber 42. When the pump 9 is operated, the ink stored in the first chamber 41 is sucked through the bypass upstream pipe BP1 so that, through the bypass downstream pipe BP2 and the downstream pipe 34, high-pressure ink is fed toward the head unit 21.

As shown chiefly in FIGS. 12A, 12B, 12C, and 13, the second chamber 42 has a circular shape as seen in a plan view from right. The second chamber 42 is fitted with the pressing member 5 and the opening-closing valve 6, both mentioned previously, and also with a biasing spring 45 and a lever member 46, which will both be mentioned later. FIG. 12A shows a state with the just-mentioned four components fitted to the second chamber 42. FIG. 12B shows a state with the pressing member 5 removed. FIG. 12C shows a state with the opening-closing valve 6 and the biasing spring 45 additionally removed.

The second chamber 42 is demarcated by a second demarcation wall 421 that is provided to protrude rightward from the tank portion base plate 310. The second demarcation wall 421 is a wall in a cylindrical shape. The second chamber 42 faces, across the tank portion base plate 310, the first chamber 41 located on the left side. The above-mentioned spring seat 417 is provided to be recessed in the tank portion base plate 310 at the center of the region encircled by the second demarcation wall 421 in a cylindrical shape, that is, at the position concentric with the second demarcation wall 421. The biasing spring 45 is accommodated in the recess of the spring seat 417. The communication hole 43 is arranged over the spring seat 417, on a vertical line passing through the center of the spring seat 417.

On the upper-end portion 422 side of the second chamber 42, a lever member 46, for the venting of air out of the second chamber 42, is arranged. In a lower-end portion 423 (a lowermost part of the second chamber 42), a feed hole 42H is formed through the second chamber 42. The upstream end 341 of the downstream pipe 34 communicates via the backflow prevention mechanism portion 38 with the feed hole 42H. Under the second chamber 42, the backflow prevention mechanism portion 38 is located to correspond to the feed hole 42H, and the second chamber 42, the backflow prevention mechanism portion 38, and the downstream pipe 34 are arranged in the up-down direction such that the joint portion a between the downstream pipe 34 and the downstream end of the bypass pipe 32P (bypass downstream pipe BP2) is located under the backflow prevention mechanism portion 38. The ink stored in the second chamber 42 is sucked into the ink ejection portion 22, and is fed, through the feed hole 42H and the backflow prevention mechanism portion 38, to the downstream pipe 34. The backflow prevention mechanism portion 38 will be described in detail later.

Near the lower-end portion 423, a pair of support plates 424 is provided to protrude rightward from the tank portion base plate 310. Each support plate 424 has a bracket portion 425 on which a pressing member, which will be mentioned later, is pivoted. The pair support plates 424 is arranged side by side in the front-rear direction. The lower communication hole 41A mentioned previously is formed through the tank portion base plate 310 at a position in front of the front-side support plate 424, next to it. The upper communication hole 41B is formed through the tank portion base plate 310 near the upper-end portion 422.

Figure 20A:
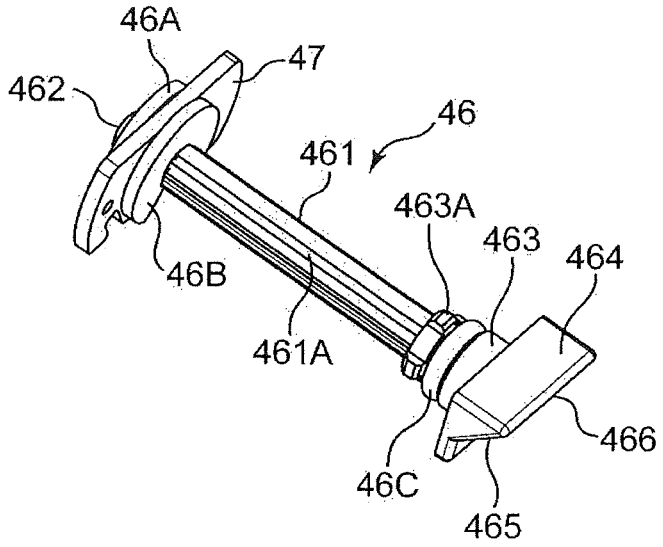
FIGS. 20A and 20B are perspective views of a lever member.
Figure 20B:
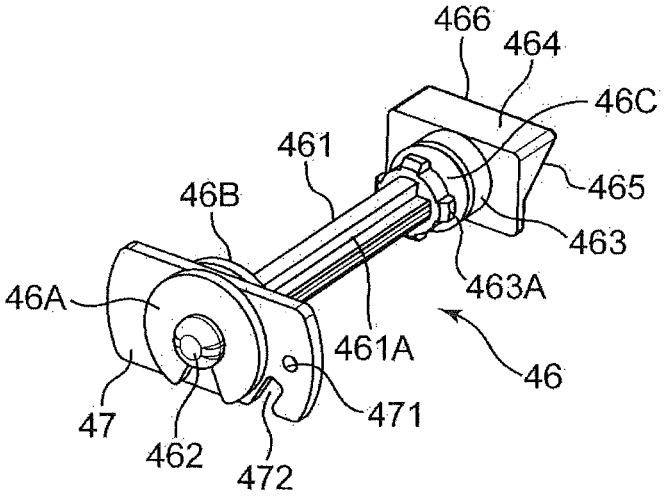
Figure 20C:
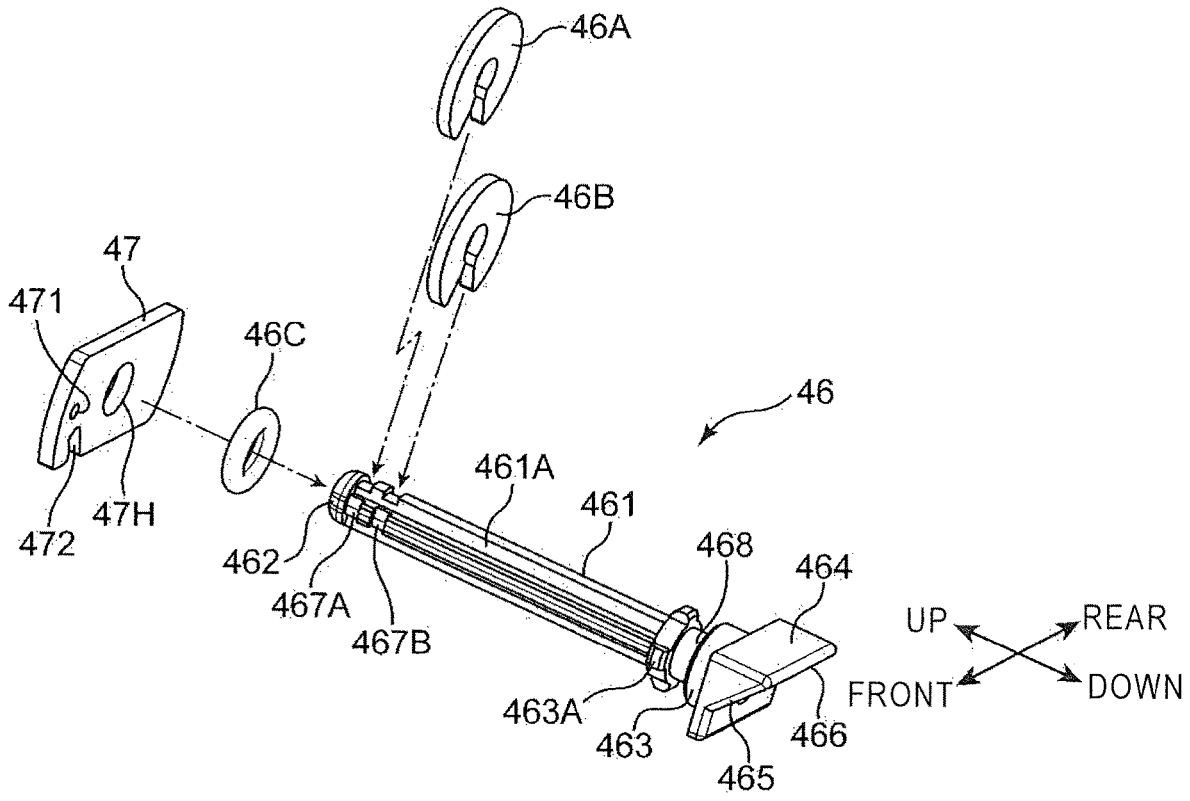
FIG. 20C is an exploded perspective view of the lever member.

At the upper-end portion 422 of the second chamber 42, a boss portion 426 and a pair of holding frames 427 are provided to protrude upward. The boss portion 426 is a cylindrical member that extends vertically upward, and has a boss hole 42A (FIGS. 22A and 22B) through it. The boss hole 42A is an opening through which the second chamber 42 communicates with the atmosphere. The pair of holding frames 427 is a pair of frame segments arranged to hold the boss portion 426 between them in the front-rear direction. At the upper ends of the holding frames 427, locking claws 428, which are bent in mutually facing directions, are provided. The boss portion 426 and the holding frames 427 form part of the air vent mechanism 37, and are fitted with a lever member 46. The lever member 46 will be described in detail later (FIGS. 20A, 20B, and 20C).

Figure 19A:
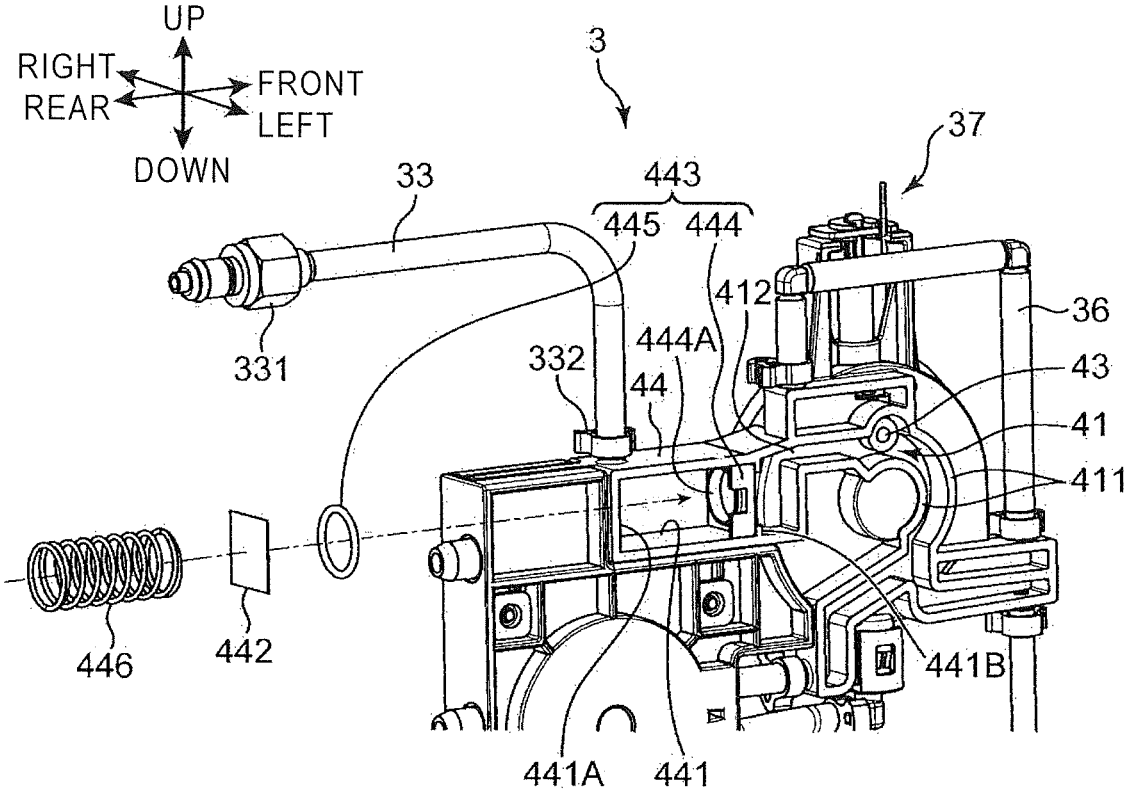
FIG. 19A is an exploded perspective view of a filter chamber.
Figure 19B:
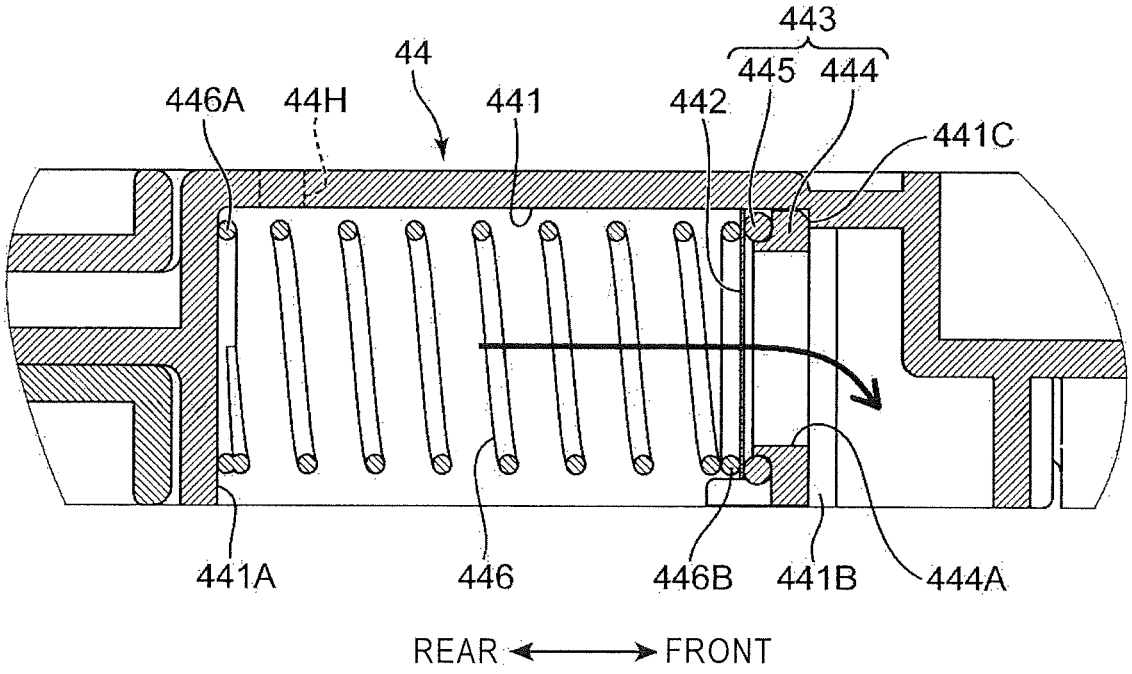
FIG. 19B is a sectional view of the filter chamber in the front-rear direction.

As shown in FIG. 11, upstream of the first chamber 41 with respect to the ink feed direction, the filter chamber 44 (upstream chamber) is arranged. The filter chamber 44 together with the upstream pipe 33 constitutes a passage through which ink is fed from the ink cartridge IC to the first chamber 41. The filter chamber 44 has an inner wall face 441, which demarcates a space that has a rectangular sectional shape in the left-right direction and that extends in a rectangular column shape with respect to the ink feed direction. The filter chamber 44 is a space for housing a filter member 442 for removing foreign matter in ink, a holding member 443 for the filter member 442, a coil spring 446 for fastening the filter member 442, etc. Through the ceiling wall of the filter chamber 44, an inflow hole 44H (FIG. 19B) for ink is formed. On the ceiling wall, an inflow port 447 (FIG. 25), which is a receiving plug, is provided upright to correspond to the inflow hole 44H. To the inflow port 447, the downstream end 332 of the upstream pipe 33 is connected by insertion. The filter chamber 44 will be described in detail later (FIGS. 19A and 19B).

As shown in FIGS. 10A and 13 among others, a left face-side opening in the first chamber 41 is sealed with a sealing film 7A made of resin. The sealing film 7A has such an exterior shape that it can cover not only the first chamber 41 but also the bypass communication chamber 413, the return communication chamber 414, the lower monitor communication chamber 415, the upper monitor communication chamber 416, and the filter chamber 44. A peripheral edge part of the sealing film 7A is welded or bonded the opening-end faces of the first demarcation wall 411 and other walls, so that the sealing film 7A seals the openings in the respective chambers.

A right face-side opening in the second chamber 42 is sealed with an atmospheric pressure sensing film 7 formed of a flexible film member made of resin. The atmospheric pressure sensing film 7 has a circular exterior shape that fits the wall shape of the second demarcation wall 421 of the second chamber 42 as seen in a plan view from right. A peripheral edge part of the atmospheric pressure sensing film 7 is welded or bonded to the opening-end face of the second demarcation wall 421, so that the atmospheric pressure sensing film 7 seals the opening in the second chamber 42. The atmospheric pressure sensing film 7 is welded or bonded with no particular tension applied to it.

The pump portion 32 is arranged behind, obliquely below, the tank portion 31, next to it, and includes a pump cavity 321 and a cam shaft insertion hole 322. The pump cavity 321 is a cavity in a cylindrical shape arranged in the pump portion housing 320, and houses the pump 9. The cam shaft insertion hole 322 is a boss hole provided at a position concentric with the pump cavity 321. Through the cam shaft insertion hole 322, a cam shaft 93 (FIG. 4), on which an eccentric cam 91 of the pump 9 pivots, is inserted. A right face-side opening in the pump cavity 321 is sealed by a pump cover 323 (FIG. 10B). On the rear face of the pump portion housing 320, two positioning pins 391 are provided to protrude. On the lower face of the pump portion housing 320, a rib 392 is provided to protrude. The positioning pins 391 and the rib 392 function as a positioning member when the liquid feeding unit 3 is mounted on the carriage 2.

In the embodiment, the liquid feeding unit 3 has the tank portion 31 and the pump portion 32 formed integrally. That is, the tank portion base plate 310, which is the base plate for the tank portion 31, and the pump portion housing 320, which has the pump cavity 321, are integrated together, and the pump 9 for pressurized purging is mounted on the liquid feeding unit 3 itself. It is thus possible to give the carriage 2 a compact, simple mechanical structure.

Negative Pressure Feeding Mechanism in Detail

Next, a detailed description will be given of a negative pressure feeding mechanism by which, as the amount of ink in the second chamber 42 decreases, ink is fed from the first chamber 41 to the second chamber 42. The negative pressure feeding mechanism includes the pressing member 5, the opening-closing valve 6, and the atmospheric pressure sensing film 7, of which the operation has been outlined with reference to FIG. 7 etc., and further includes a biasing spring 45 (biasing member). The opening-closing valve 6 is arranged in the communication hole 43, and is switched between a closed state, in which it closes the communication hole 43, and an open state, in which it opens the communication hole 43. The biasing spring 45 biases the opening-closing valve 6 in the direction toward the closed state. The pressing member 5 can press the opening-closing valve 6 in the direction toward the open state. The atmospheric pressure sensing film 7 is displaced by the negative pressure that is produced as the ink in the second chamber 42 decreases, and transmits the displacing force to the pressing member 5.

Pressing Member

Figure 14A:
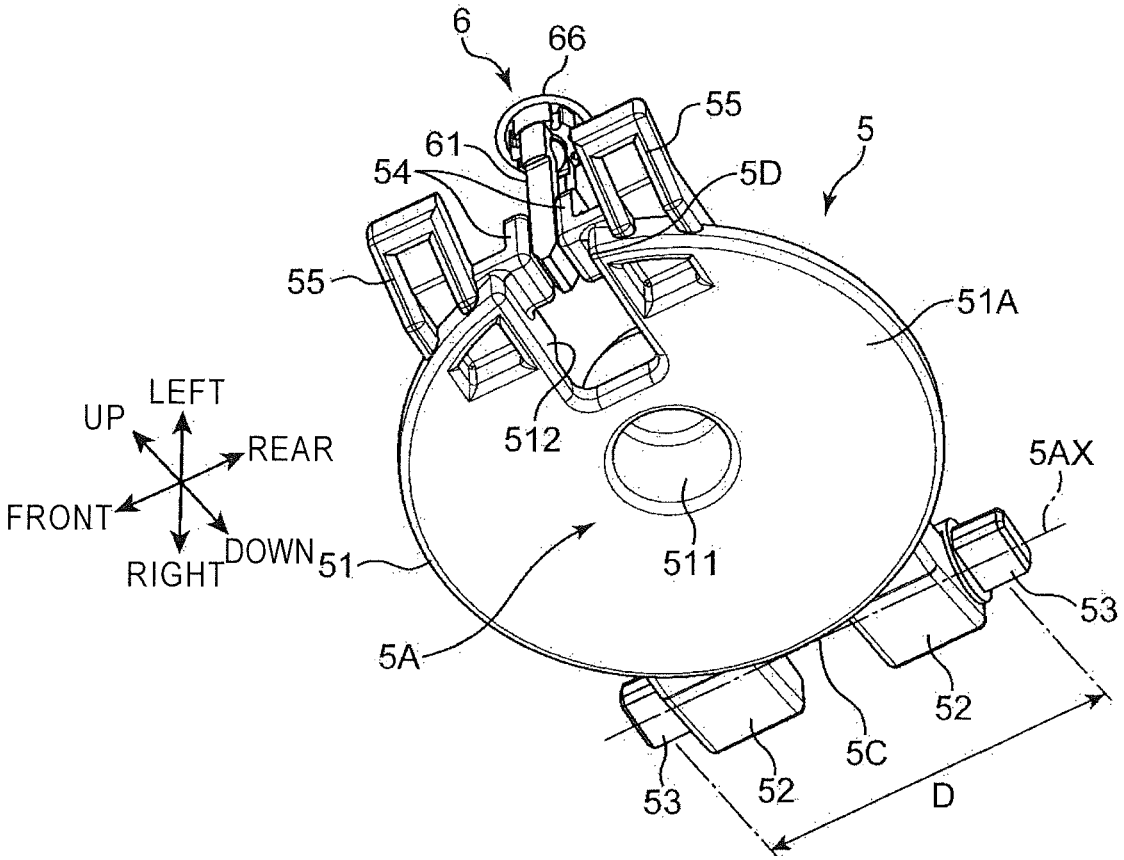
FIG. 14A is a perspective view of a pressing member.
Figure 14B:
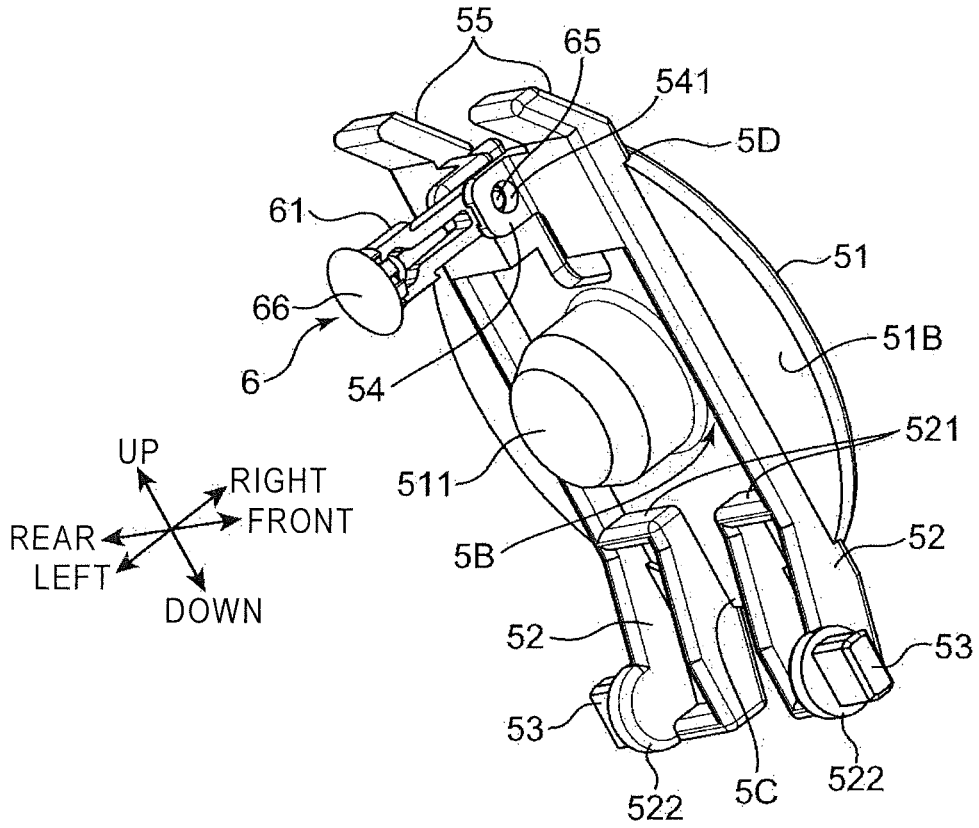
FIG. 14B is a perspective view of the pressing member as seen from a different perspective.

FIGS. 14A and 14B are perspective views of the pressing member 5 as seen from different perspectives respectively, with the opening-closing valve 6 shown together. The pressing member 5 is a member that is pivotably arranged in the second chamber 42. The pressing member 5 includes a disk portion 51 which is a flat plate in a circular shape, a pair of arm portions 52 that extends downward from the lower-end side 5C of the disk portion 51, pivot portions 53 that are provided in extended distal-end portions (lower-end portions) of the arm portions 52 respectively, a pair of link bosses 54 arranged at the upper-end side 5D of the disk portion 51, and receiving slopes 55 that interfere with the lever member 46. The pair of pivot portions 53 pivots on the bracket portions 425 (FIGS. 12B and 12C) of the pair of support plates 424 arranged in the second chamber 42. Thus, the disk portion 51 is pivotable about the axis of the pivot portions 53.

The disk portion 51 is a disk with a diameter about one-half of the inner diameter of the second demarcation wall 421 in a cylindrical shape that demarcates the second chamber 42. The second demarcation wall 421 and the disk portion 51 in a state pivoted on the bracket portions 425 are arranged roughly concentrically. The disk portion 51 has a first face 51A that faces the atmospheric pressure sensing film 7 and a second face 51B that faces the opening-closing valve 6 (faces the tank portion base plate 310). In the middle of the disk portion 51 in the diametrical direction, a spring fitting projection 511 is provided so as to protrude from the second face 51B side. Around the second face 51B side of the spring fitting projection 511, a right-end portion of the biasing spring 45, which is a coil spring, is fitted. On the first face 51A side, the region of the spring fitting projection 511 defines a recess in a cylindrical shape.

The disk portion 51 has a pressed portion 5A and a biased portion 5B. The pressed portion 5A receives a displacing force from the atmospheric pressure sensing film 7. The biased portion 5B receives a biasing force from the biasing spring 45. The pressed portion 5A is set at a predetermined position on the first face 51A of the disk portion 51. In the embodiment, the pressed portion 5A is a region on the first face 51A around a peripheral edge portion of the spring fitting projection 511. The biased portion 5B is on the second face 51B side, and is a region of the spring fitting projection 511 around which the biasing spring 45 is fitted. That is, the biased portion 5B is set at a position corresponding to the pressed portion 5A.

When the pressed portion 5A receives no displacing force from the atmospheric pressure sensing film 7, the disk portion 51 is in a state close to upright. However, the right end of the biasing spring 45 abuts on the biased portion 5B, and its biasing force keeps the first face 51A in contact with the inner face of the atmospheric pressure sensing film 7. By contrast, when the pressed portion 5A receives from the atmospheric pressure sensing film 7 a displacing force stronger than the biasing force of the biasing spring 45, the disk portion 51 pivots leftward about the axis of the pivot portions 53, from the upright state into a state leaning leftward.

The pair of arm portions 52 is arranged at the lower-end side 5C of the disk portion 51, one apart from the other in the front-rear direction. The upper-end portions 521 of the pair of arm portions 52 extend upward beyond the lower-end side 5C of the disk portion 51, and are located under opposite side parts of the spring fitting projection 511. The distal-end portions 522 of the pair of arm portions 52 each extend linearly downward from the lower-end side 5C. The pivot portions 53 are provided to protrude frontward and rearward from the distal-end portions 522. More specifically, one of the pivot portions 53 is provided to protrude frontward from the front face of the front-side distal-end portion 522. The other of the pivot portions 53 is provided to protrude rearward from the rear face of the rear-side distal-end portion 522. Thus, the pair of pivot portions 53 is provided to protrude in directions away from each other. The pivot portions 53 are fitted in the bracket portions 425 of the support plates 424. Owing to the pivot portions 53 being provided on the distal-end portions 522 of the arm portions 52, when the pressing member 5 pivots, the upper-end side 5D of the disk portion 51 has a large swing width.

The pair of pivot portions 53 is located along a pivot axis 5AX that extends in the front-rear direction. The front-side and rear-side pivot portions 53 are arranged at a predetermined interval D from each other. That is, the pair of pivot portions 53 is arranged one apart from the other across what corresponds to a central region of the disk portion 51 along the plane. The interval D can be set at, for example, about 40% to 90% of the diameter of the disk portion 51. Then, the pivots provided by the pair of pivot portions 53 are large-width pivots so apart from each other as to be located across the central region of the disk portion 51. Thus, the disk portion 51 that pivots about the pivots does not easily twist about the axis perpendicular to the pivot axis 5AX. It is thus possible to stabilize the pivoting operation of the disk portion 51.

Near the upper-end side 5D of the disk portion 51, the pair of link bosses 54 is provided to protrude leftward from the second face 51B. More specifically, the disk portion 51 is provided with a notch portion 512. The notch portion 512 extends inward in the diametrical direction, with an open edge at the upper-end side 5D. The link bosses 54 are provided upright from front and rear side edges, respectively, facing the void of the notch portion 512. Each link boss 54 is a flat plate in a rectangular shape, and is provided with a link hole 541. The link holes 541 are used to couple together the pressing member 5 and the opening-closing valve 6. The coupling permits coordination between the pivoting operation of the pressing member 5 and the opening-closing operation of the opening-closing valve 6.

In other words, the link bosses 54 serve as a pressing portion that presses the opening-closing valve 6 to make it move in the left-right direction in accordance with the pivoting operation of the pressing member 5 which pivots about the axis of the pivot portions 53. The pair of link bosses 54 is arranged at the upper-end side 5D, a predetermined distance away from the pair of pivot portions 53 arranged at the lower-end side 5C. That is, The pressing portion (the link bosses 54) is arranged, with respect to the disk portion 51, at the position opposite to the pivot (pivot portions 53). It is thus possible to increase the amount of movement of the link bosses 54 during the pivoting of the pressing member 5, and to increase the amount of movement of the opening-closing valve 6 which is coupled to the link bosses 54.

In terms of the relationship of the pressed portion 5A or the biased portion 5B (point of effort) with the pivot portions 53 (fulcrum), the link bosses 54 (point of action) are arranged at a position farther from the pivot portions 53 than are the pressed portion 5A and the biased portion 5B. In other words, the link bosses 54 are arranged at the upper-end side 5D of the disk portion 51 so as to face the pivot portions 53 across the pressed portion 5A and the biased portion 5B. With this arrangement, the amount of movement that the pressed portion 5A or the biased portion 5B receives can be amplified by a factor corresponding to the distance from the pressed portion 5A or the biased portion 5B before being fed to the link bosses 54.

Opening-Closing Valve

Next, the opening-closing valve 6 will be described. The opening-closing valve 6 is arranged in the communication hole 43 through which the first and second chambers 41 and 42 communicate with each other. The opening-closing valve 6 opens and closes the communication hole 43 by moving in the left-right direction in the communication hole 43 by following the pivoting of the pressing member 5 about the pivot portions 53. To enable the opening-closing valve 6 to follow the pivoting, it is coupled to the link bosses 54 on the disk portion 51.

Figure 15A:
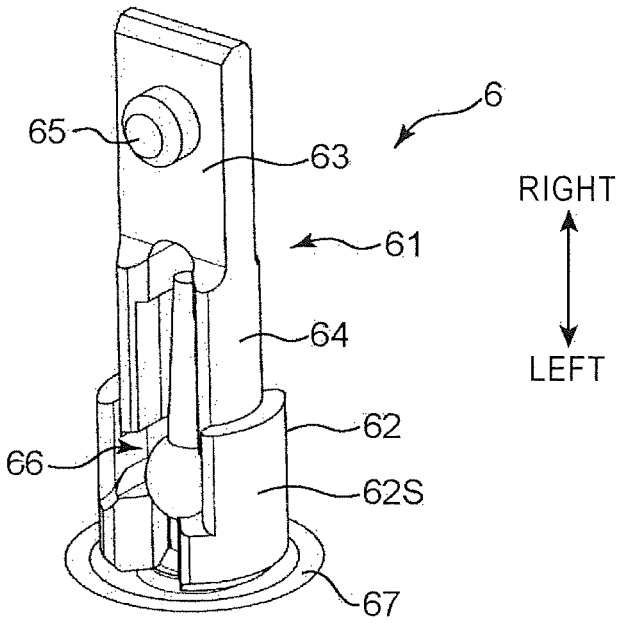
FIG. 15A is a perspective view of an opening-closing valve.
Figure 15B:
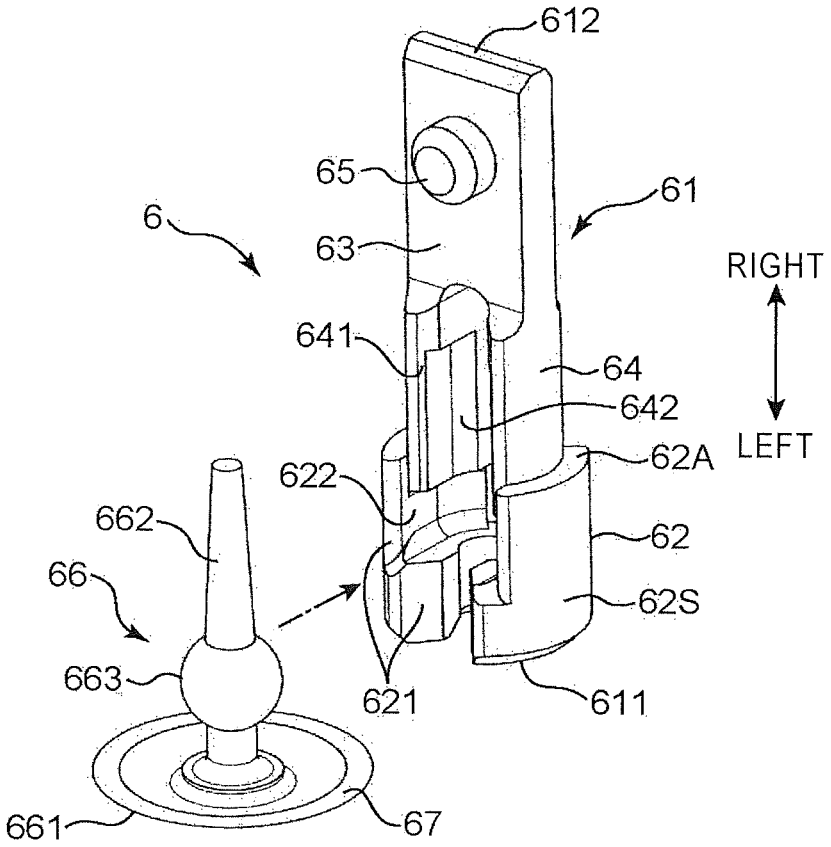
FIG. 15B is an exploded perspective view of the opening-closing valve.
Figure 16A:
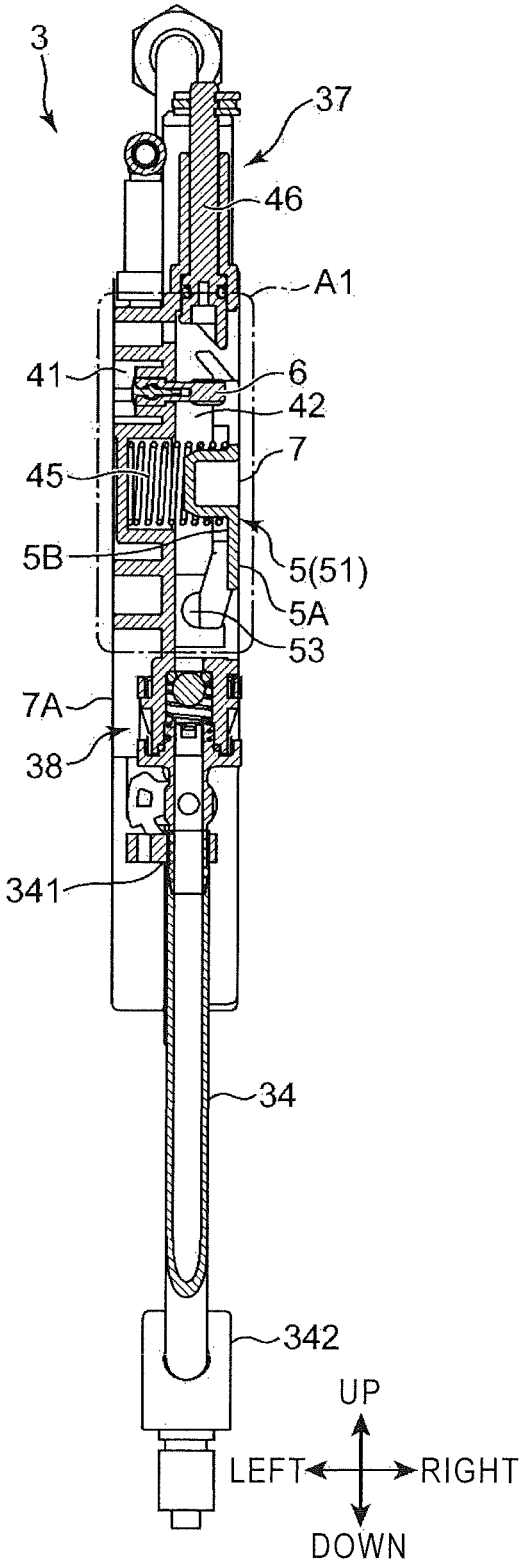
FIG. 16A is a sectional view across line XVI-XVI in FIG. 10A, showing the opening-closing valve in a closed state.
Figure 16B:
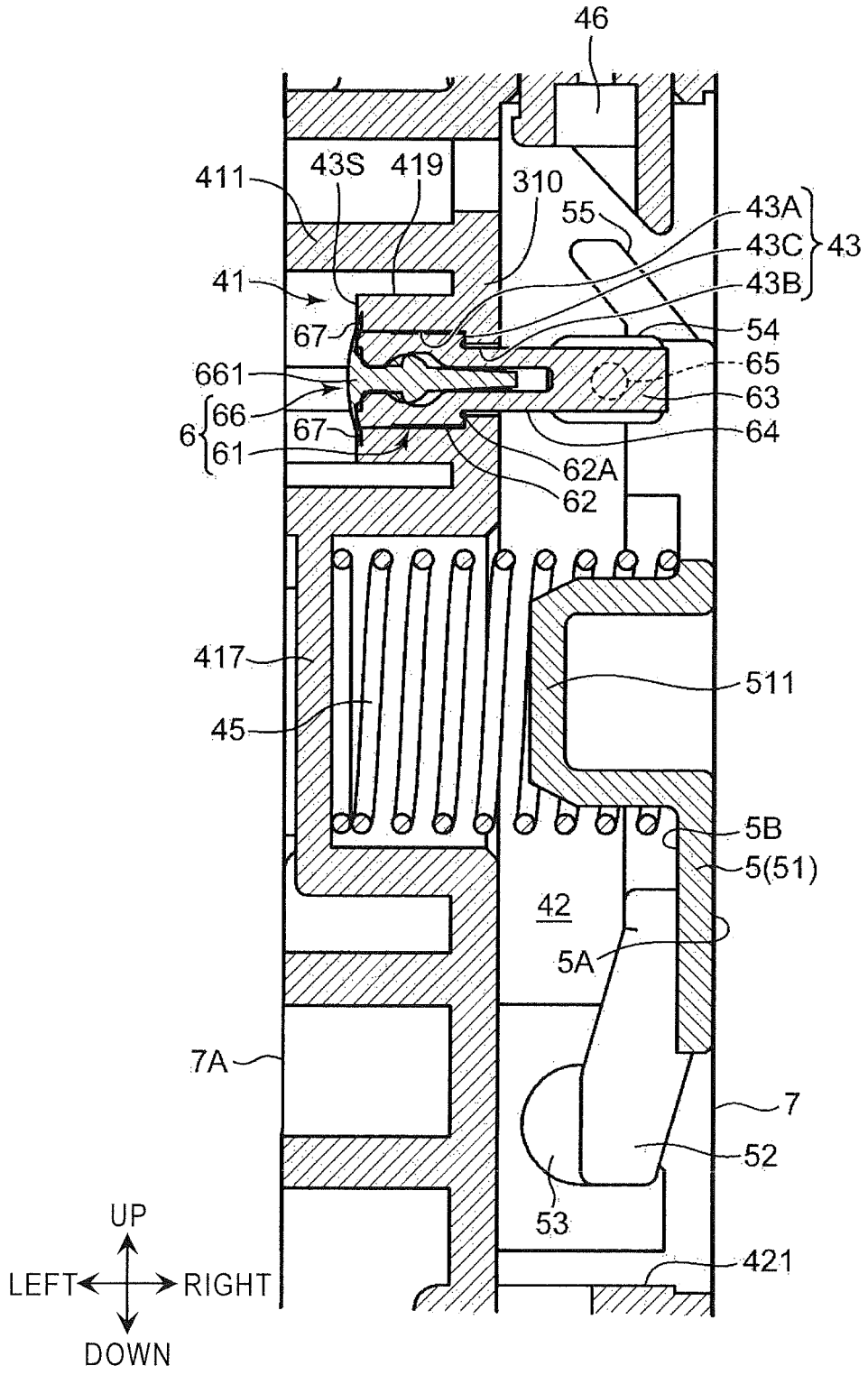
FIG. 16B is an enlarged view of part A1 in FIG. 16A.

FIG. 15A is a perspective view of the opening-closing valve 6. FIG. 15B is an exploded perspective view of the opening-closing valve 6. FIG. 16A is a sectional view across line XVI-XVI in FIG. 10A. FIG. 16B is an enlarged view of part A1 in FIG. 16A. The opening-closing valve 6 is an assembled unit composed of a valve holder 61 and an umbrella valve 66 held by the valve holder 61. The communication hole 43 is a hole in a cylindrical shape that penetrates the tank portion base plate 310 and the boss 419, and has a large-diameter portion 43A, a small-diameter portion 43B with a smaller diameter than the large-diameter portion 43A, and a step portion 43C resulting from the difference in diameter between them.

The valve holder 61 in a state fitted in the communication hole 43 is a half-cylindrical member that has a first end portion 611 located on the first chamber 41 side (left side) and a second end portion 612 located on the second chamber 42 side (right side). The valve holder 61 includes a cylinder portion 62 on the first end portion 611 side, a flat plate portion 63 on the second end portion 612 side, a middle portion 64 located between the cylinder portion 62 and the flat plate portion 63, and link pins 65 arranged on the flat plate portion 63. The umbrella valve 66 is held at the first end portion 611 side of the valve holder 61.

The cylinder portion 62 is a portion in a cylindrical shape that has the largest diameter in the valve holder 61. The cylinder portion 62 has a guide face 62S, a flow passage notch 621, and a holding groove 622. The guide face 62S is the outer circumferential face of the cylinder portion 62. The flow passage notch 621 is formed by cutting off part of the cylinder portion 62 in the circumferential direction. The holding groove 622 is provided to be recessed in an annular shape on the inner circumference side of the cylinder portion 62. The cylinder portion 62 is accommodated in the large-diameter portion 43A of the communication hole 43. When the opening-closing valve 6 moves in the left-right direction, the guide face 62S is guided by the inner face of the large-diameter portion 43A. The flow passage notch 621 serves as a flow passage through which ink flows when the opening-closing valve 6 is open. The holding groove 622 is a groove for locking a locking spherical portion 663 of the umbrella valve 66.

The middle portion 64 is a cylindrical portion with a smaller diameter than the cylinder portion 62. The middle portion 64 has an open portion 641 and a pin housing 642. The open portion 641 is an open portion that leads to the flow passage notch 621. The pin housing 642 houses a pin portion 662 of the umbrella valve 66. The middle portion 64 is housed in the small-diameter portion 43B of the communication hole 43. The outer circumferential face of the middle portion 64 is guided by the inner face of the small-diameter portion 43B. At the boundary between the cylinder portion 62 and the middle portion 64, there is an annular abutment portion 62A. The annular abutment portion 62A is formed by the step resulting from the difference in outer diameter between the cylinder portion 62 and the middle portion 64. The annular abutment portion 62A faces, and abuts on, the step portion 43C of the communication hole 43.

The flat plate portion 63, in a state where the opening-closing valve 6 is fitted in the communication hole 43, is a portion that protrudes rightward from the communication hole 43. The flat plate portion 63 has a pair of, observe and reverse, flat faces that extend in the left-right direction. The link pins 65 are provided to protrude from the pair of flat faces respectively. As shown in FIG. 14B, the link pins 65 are fitted in link holes 541 provided in the link bosses 54 on the pressing member 5. The fitting couples together the pressing member 5 and the opening-closing valve 6, and permits conversion of pivoting movement of the pressing member 5 about the pivot portions 53 into linear movement of the opening-closing valve 6.

The umbrella valve 66 is a member made of rubber, and has an umbrella portion 661, a pin portion 662 that extends rightward from the umbrella portion 661, and a locking spherical portion 663 that is provided integrally with the pin portion 662. The umbrella portion 661 has a diameter larger than the inner diameter of the large-diameter portion 43A of the communication hole 43. A peripheral edge portion of the inner side (right-face side) of the umbrella portion 661 is a sealing face 67. The sealing face 67 can, by abutting on a sealing wall face 43S, bring the communication hole 43 into a sealed state (a closed state). The sealing wall face 43S is the wall face around the communication hole 43 and is the protrusion-end face of the boss 419. By contrast, when the sealing face 67 is apart from the sealing wall face 43S, the above-mentioned sealed state is canceled (an open state). When a predetermined pressure acts on the right-face side of the umbrella portion 661, its umbrella shape reverses (see FIGS. 29A and 29B).

The pin portion 662 is a bar-form portion that extends in the left-right direction, and is a portion that serves as a prop for the umbrella portion 661. The pin portion 662 fits into the pin housing 642 in the cylinder portion 62 and the middle portion 64 of the valve holder 61. That is, while the umbrella portion 661 abuts on the first end portion 611 of the valve holder 61, the pin portion 662 can fit into the inner cylinder portion of the valve holder 61. The locking spherical portion 663 is formed by a part of the pin portion 662 close to the left end being expanded into a spherical shape, and is a portion that fits in the holding groove 622. With the locking spherical portion 663 fitted in the holding groove 622, the umbrella valve 66 is, in a state with its movement in the left-right direction restricted, held by the valve holder 61. That is, the umbrella valve 66 moves integrally with the valve holder 61 in the left-right direction.

Biasing Spring

The biasing spring 45 is a coil spring that is provided between the second face 51B of the disk portion 51 and the tank portion base plate 310 and that supports (biases) the second face 51B. More specifically, as shown in FIG. 16B, the right-end side of the biasing spring 45 is fitted around the spring fitting projection 511 of the disk portion 51, and the left-end side of the biasing spring 45 is housed in the spring seat 417 which is provided to be recessed in the tank portion base plate 310. When the pressed portion 5A of the disk portion 51 receives a displacing force acting leftward against the biasing force of the biasing spring 45 acting rightward, the disk portion 51 pivots leftward about the axis of the pivot portions 53. Without the displacing force, the disk portion 51 remains in an upright state by the biasing force.

Operation of the Opening-Closing Valve

Next, the opening-closing operation of the opening-closing valve 6 will be described. FIGS. 16A and 16B show a state where the opening-closing valve 6 is in the closed state. This state is a state where the atmospheric pressure sensing film 7 is not producing such a strong displacing force as to make the pressing member 5 (disk portion 51) pivot, that is, a state where the sum of the spring pressure (biasing force) of the biasing spring 45 and the interior pressure of the second chamber 42 exceeds the atmospheric pressure. Although the second chamber 42 is at negative pressure, the biasing spring 45 biases the biased portion 5B of the disk portion 51 rightward with a biasing force that exceeds the displacing force of the atmospheric pressure sensing film 7 due to the negative pressure. Thus, the disk portion 51 does not pivot about the axis of the pivot portions 53 but maintains the above-mentioned upright state.

In this case, the opening-closing valve 6 which is coupled with the link bosses 54 on the pressing member 5 takes a closed state where it is located at the rightmost position. That is, the biasing force of the biasing spring 45 pulls the valve holder 61 rightward via the link bosses 54. This results in a state where the annular abutment portion 62A of the valve holder 61 abuts on the step portion 43C of the communication hole 43 and the sealing face 67 of the umbrella valve 66 abuts on the sealing wall face 43S. Thus, the communication hole 43 is sealed by the umbrella valve 66. The biasing spring 45, by biasing the disk portion 51 rightward, indirectly biases the opening-closing valve 6 in the direction toward the closed state.

Figure 17A:
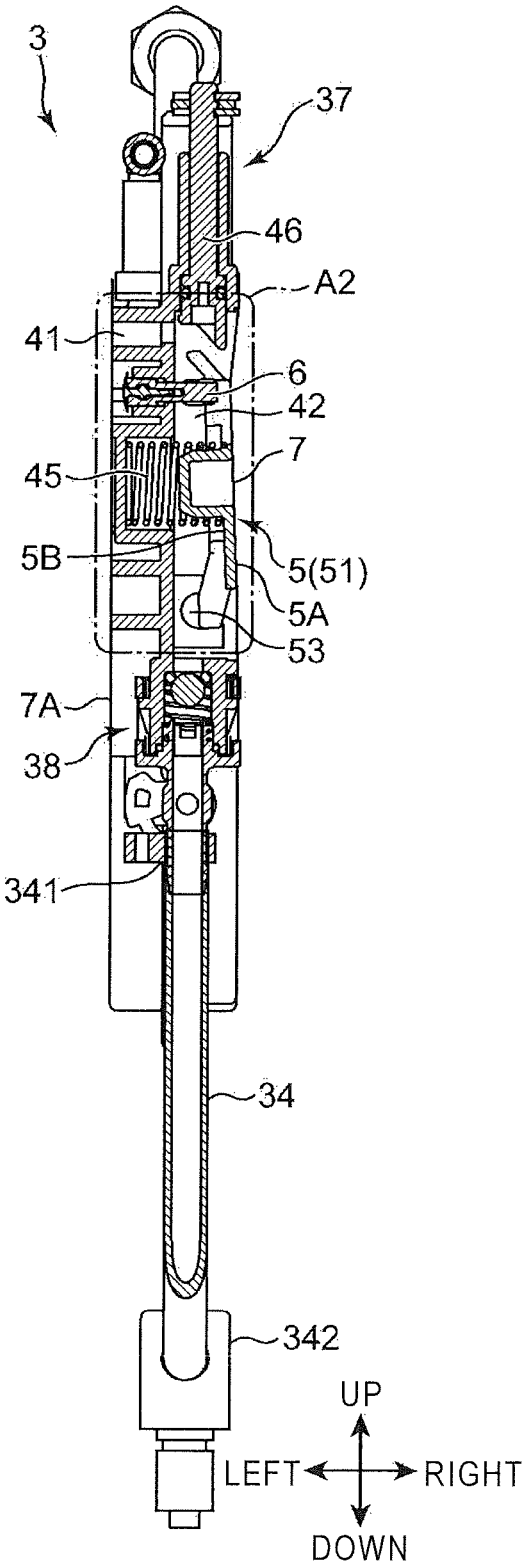
FIG. 17A is a diagram corresponding to FIG. 16A, and is a sectional view showing the opening-closing valve in an open state.
Figure 17B:
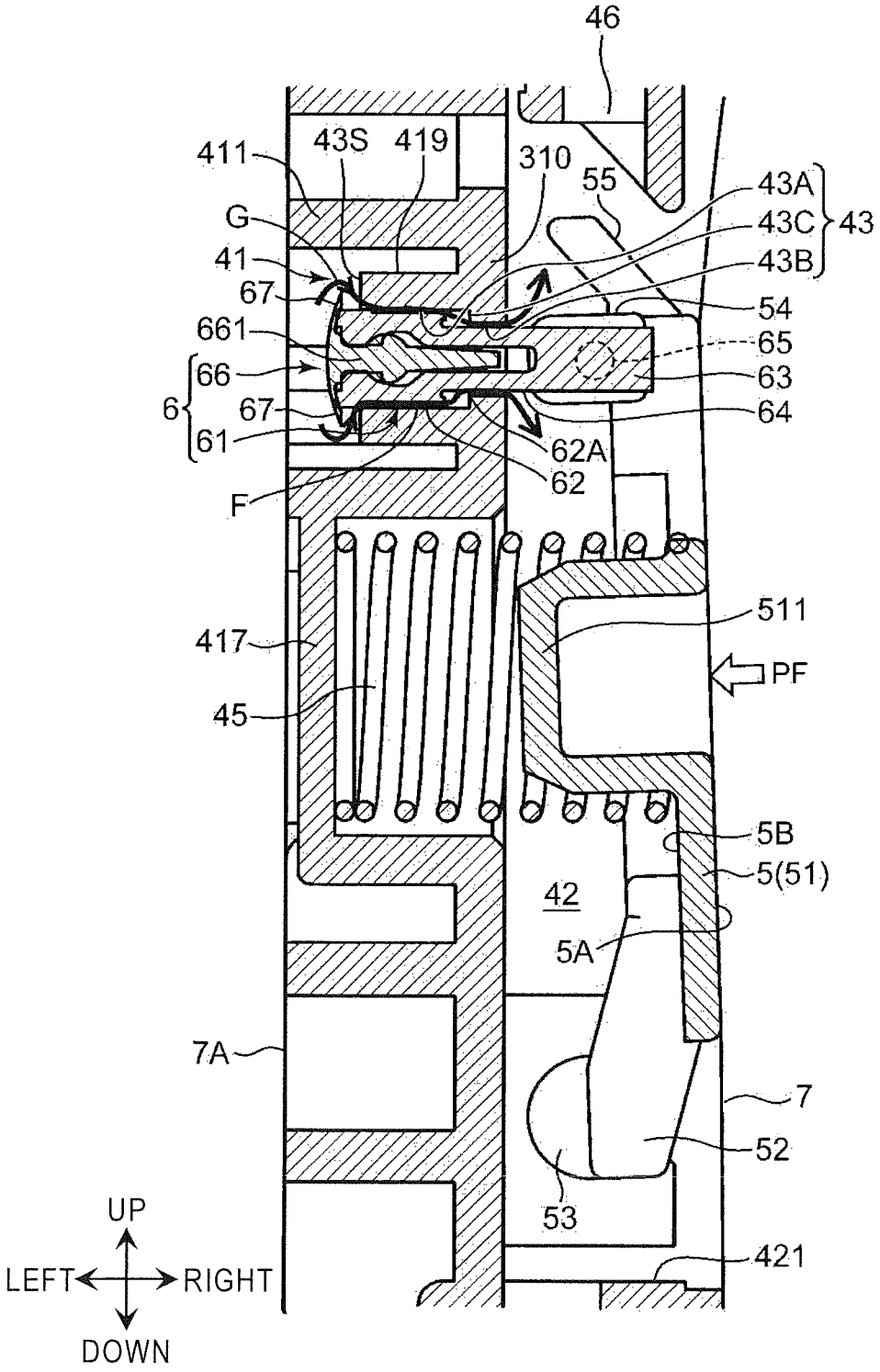
FIG. 17B is an enlarged view of part A2 in FIG. 17A.

FIG. 17A is a diagram corresponding to FIG. 16A, and is a sectional view showing the opening-closing valve 6 in the open state. FIG. 17B is an enlarged view of part A2 in FIG. 17A. When the ink ejection portion 22 continues ink droplet ejection from the state in FIGS. 16A and 16B, as ink decreases, the degree of negative pressure in the second chamber 42, which is a hermetically sealed space, gradually increases. Eventually, when the negative pressure (the absolute value of the negative pressure) in the second chamber 42 exceeds a predetermined threshold value, the atmospheric pressure sensing film 7 exerts to the pressed portion 5A of the disk portion 51 a pressing force that surpasses the biasing force of the biasing spring 45. That is, the sum of the spring pressure of the biasing spring 45 and the interior pressure of the second chamber 42 is exceled by the atmospheric pressure.

In this case, the disk portion 51 pivots leftward about the axis of the pivot portions 53 against the biasing force of the biasing spring 45. As a result of the pivoting, the link bosses 54 generate a pressing force PF that makes the opening-closing valve 6 move leftward, and switch the opening-closing valve 6 into the open state. That is, the pressing force is transmitted from the link holes 541 in the link bosses 54 to the link pins 65 on the valve holder 61, and, while the guide face 62S is guided along the inner face of the communication hole 43, the valve holder 61 moves linearly leftward. With the movement, also the umbrella valve 66 moves leftward, and the sealing face 67 moves away from the sealing wall face 43S. That is, a gap G is formed between the sealing face 67 and the sealing wall face 43S. In this way, the sealing of the communication hole 43 by the umbrella valve 66 is canceled.

When the opening-closing valve 6 is in the open state, as indicated by arrow F in FIG. 17B, the pressure difference between the first chamber 41 with Atmospheric Pressure+ ρgh and the second chamber 42 with an increased degree of negative pressure causes ink to flow out of the first chamber 41 into the second chamber 42. More specifically, ink flows into the second chamber 42 through the passage that runs through the gap G between the sealing face 67 of the umbrella valve 66 and the sealing wall face 43S, the flow passage notch 621 provided in the cylinder portion 62 of the valve holder 61, and the open portion 641 provided in the middle portion 64.

As the flowing of ink into the second chamber 42 progresses, the degree of negative pressure in the second chamber 42 is gradually reduced. Eventually, when the sum of the spring pressure of the biasing spring 45 and the interior pressure of the second chamber 42 surpasses the atmospheric pressure, the biasing force of the biasing spring 45 causes the disk portion 51 to be pushed back rightward. That is, when the negative pressure (the absolute value of the negative pressure) in the second chamber 42 falls below a predetermined threshold value, the disk portion 51, by being pushed by the biasing force of the biasing spring 45, pivots rightward about the axis of the pivot portions 53. Accordingly, also the opening-closing valve 6, by being pulled by the link bosses 54, moves linearly rightward. Eventually, the annular abutment portion 62A of the valve holder 61 abuts on the step portion 43C of the communication hole 43, and the sealing face 67 of the umbrella valve 66 abuts on the sealing wall face 43S. In this way, the opening-closing valve 6 returns to the closed state.

Workings and Effects of the Negative Pressure Feeding Mechanism

Figure 18A:
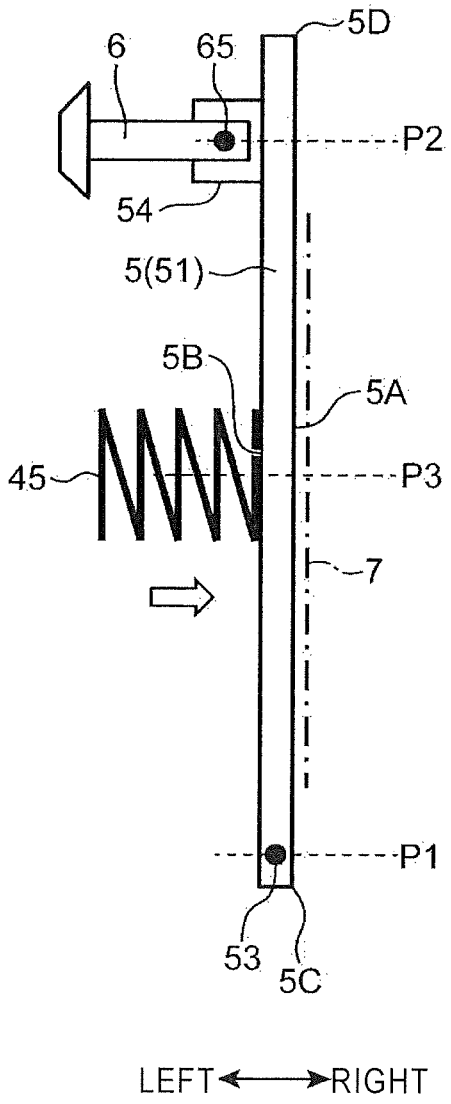
FIGS. 18A and 18B are schematic diagrams illustrating the positional relationship among a pivot and a pressing portion on the pressing member and the operation of the pressing member.
Figure 18B:
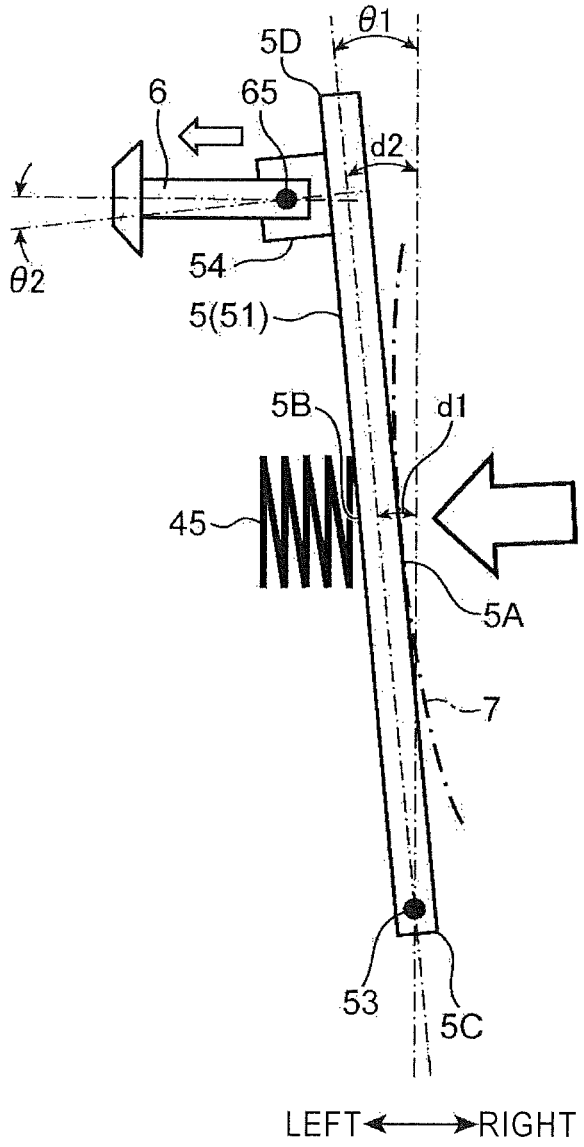

A description will now be given of the workings and effects of the negative pressure feeding mechanism according to the embodiment structured as described above, with reference to schematic diagrams in FIGS. 18A and 18B. FIG. 18A shows a state where the pressing member 5 (disk portion 51) is in the upright state and the opening-closing valve 6 is in the closed state. FIG. 18B shows a state where the pressing member 5 has pivoted into a slant state and the opening-closing valve 6 is in the open state.

First, the pressing member 5 has a pivot (the pivot portions 53), and is pivoted on the support plate 424 arranged in the second chamber 42. Thus, when the pressed portion 5A receives the displacing force of the atmospheric pressure sensing film 7, the pressed portion 5A pivots about the axis of the pivot portions 53. That is, displacement of the atmospheric pressure sensing film 7, which is an unstable moving force, can be converted into pivoting about the axis of the pivot portions 53, which is a stable moving force. Thus, the displacing force of the atmospheric pressure sensing film 7 can be efficiently transmitted via the link bosses 54 to the opening-closing valve 6. For example, in a case where the pressing member of the opening-closing valve 6 has no pivot as where the pressing member of the opening-closing valve 6 is affixed to the atmospheric pressure sensing film 7, the behavior of the pressing member is unstable and the transmission of the pressing force to the opening-closing valve 6 is unstable. However, according to the embodiment, the pressing member 5 can generate a stable pressing force. Accordingly, the opening-closing valve 6 can be switched between the closed state and the open state with desired timing, and ink can be fed to the head unit 21 stably.

Moreover, while the pivot portions 53 are arranged at the lower-end side 5C of the pressing member 5, the link bosses 54 are arranged a predetermined distance away from the pivot portions 53, at the upper-end side 5D of the pressing member 5. That is, when, as shown in FIG. 18A, the pivots provided by the pivot portions 53 are referred to as the fulcrum P1 and the link bosses 54 that feed a moving force to the opening-closing valve 6 are referred to as the point of load P2, then the point of load P2 is located at the position opposite to the fulcrum P1 on the pressing member 5. The point of effort P3 at which a pivoting force is fed to the pressing member 5 is, in the embodiment, at the position at which the pressed portion 5A and the biased portion 5B are arranged, and the point of effort P3 is located between the fulcrum P1 and the point of load P2.

It is thus possible to increase the amount of movement of the link bosses 54 during the pivoting of the pressing member 5, and hence to increase the amount of linear movement of the opening-closing valve 6 in the left-right direction. Suppose that, as shown in FIG. 18B, the pressing force of the atmospheric pressure sensing film 7 acts on the point of effort P3 (pressed portion 5A) and the pressing member 5 pivots through an angle θ1 about the axis of the pivot portions 53. In this case, the actual amount of movement of the pressing member 5 at the position of the pressed portion 5A is d1, and the amount of movement at the position of the link bosses 54 (link pins 65) is d2. The amount of movement d2 is amplified as compared with the amount of movement d1 in accordance with the difference between the distance from the fulcrum P1 to the point of load P2 and the distance from the fulcrum P1 to the point of effort P3.

As described with reference to FIGS. 16A, 16B, 17A, and 17B, the opening-closing valve 6 is not a member that opens and closes the communication hole 43 by relying on a pressing force but a member that opens and closes the communication hole 43 by moving in the left-right direction in the communication hole 43. The larger the amount of movement of the opening-closing valve 6 leftward, the larger the gap G and thus the lower the inflow resistance to ink. When the ink in the second chamber 42 is consumed rapidly, the atmospheric pressure sensing film 7 exerts a strong pressing force, and thus the amount of movement d1 is comparatively large. Then, with the amount of movement d2 amplified as compared with the amount of movement d1, the opening-closing valve 6 can be moved leftward. Accordingly, when ink is consumed rabidly, it is possible to move the opening-closing valve 6 greatly to make a comparatively large amount of ink flow into the second chamber 42.

By contrast, when the ink in the second chamber 42 is consumed slowly, the atmospheric pressure sensing film 7 exerts a weak pressing force, and thus the amount of movement d1 is comparatively small. Even such a small amount of movement d1 produces an amplified amount of movement d2 at the position of the link bosses 54, and thus the opening-closing valve 6 can be moved leftward accordingly. Thus, even when ink is consumed slowly, the opening-closing valve 6 can be moved with good sensitivity and proper timing. Thus, it is possible, both when ink is ejected from the head unit 21 in large amounts and small amounts, to maintain stable supply of ink from the liquid feeding unit 3 to the head unit 21.

One benefit from another viewpoint is that the opening-closing valve 6 is coupled to the pressing member 5. More specifically, the link pins 65 arranged near the right end of the opening-closing valve 6 are coupled to the link holes 541 in the link bosses 54. The biasing spring 45 presses the biased portion 5B of the disk portion 51 and thereby biases the opening-closing valve 6 in a direction toward the closed state. When the pressing member 5 (disk portion 51) pivots about the axis of the pivot portions 53, as shown in FIG. 18B, the pressing member 5 inclines leftward through an angle of rotation θ1. However, since the opening-closing valve 6 and the pressing member 5 are coupled together, even when the pressing member 5 inclines, the opening-closing valve 6 does not incline by following it. That is, the opening-closing valve 6 can pivot about the axis of the link pins 65 only through an angle of rotation θ2 commensurate with the angle of rotation θ1 and maintains a horizontal state. Thus, the opening-closing valve 6 can be moved linearly in the left-right direction in the communication hole 43. It is thus possible to stably move the opening-closing valve 6.

Filter Chamber in Detail

Next, the structure of the filter chamber 44 (upstream chamber, part of a first feed passage) will be described in detail. FIG. 19A is an exploded perspective view of the filter chamber 44. FIG. 19B is a sectional view of the filter chamber 44 in the front-rear direction. As described previously, the filter chamber 44 has an inner wall face 441 that demarcates a space in an rectangular column shape. A filter member 442, a holding member 443, and a coil spring 446 (fastening member) are housed in the space inside the filter chamber 44.

The filter member 442 is a filtering member that removes foreign matter contained in ink. Here, foreign matter includes, for example, fibrous dust and ink agglomerates. In the embodiment, ink flows from the first chamber 41 through the communication hole 43, where the opening-closing valve 6 is arranged, to the second chamber 42. The opening-closing valve 6 seals the communication hole 43 and thereby achieves the negative-pressure operation of the pressing member 5 in the second chamber 42. In this environment, feeding ink containing foreign matter may hamper the negative-pressure operation. In particular, foreign matter caught in the opening-closing valve 6 hampers its movement in the left-right direction and makes it impossible to maintain the negative pressure in the second chamber 42. Foreign matter that has entered the head unit 21 downstream of the second chamber 42 is difficult to remove and hampers ink ejection. The filter member 442 is arranged to prevent failure ascribable to such entry of foreign matter.

As the filter member 442, any of various filtering members can be used so long as it can trap foreign matter as mentioned above while letting ink liquid pass. For example, a woven or non-woven fabric filter, a sponge filter, a mesh filter, or the like can be used as the filter member 442. In the embodiment, a filter member 442 which is a sheet-form member in a rectangular shape in a plan view is used. The size of the filter member 442 is set approximately equal to the sectional size of the inner wall face 441 of the filter chamber 44 in the left-right direction.

The filter chamber 44 has an upstream end 441A and a downstream end 441B. The upstream end 441A is located upstream with respect to the ink feed direction. The downstream end 441B is located downstream with respect to the ink feed direction. In the upstream end 441A side ceiling wall of the filter chamber 44, the inflow hole 44H is formed. Right over the inflow hole 44H, the inflow port 447 (FIG. 25) is provided upright. The downstream end 332 of the upstream pipe 33 is inserted in and connected to the inflow port 447. Thus, the ink fed from the ink cartridge IC flows via the inflow hole 44H into the upstream end 441A side of the filter chamber 44. The downstream end 441B communicates with an inflow portion 412, which is the upstream end of the first chamber 41.

In the embodiment, the filter member 442 is arranged near the downstream end 441B. As described above, foreign matter caught in the opening-closing valve 6 poses problems. Accordingly, the filter member 442 is arranged upstream of the opening-closing valve 6. Specifically, the filter member 442 can be arranged at any position along the ink feed passage between the ink cartridge IC and the first chamber 41 or at a position upstream of the opening-closing valve 6 within the first chamber 41. The filter chamber 44 may be regarded as part of the first chamber 41. With such an arrangement, foreign matter is trapped by the filter member 442 before reaching the communication hole 43 or the second chamber 42. It is thus possible to prevent problems such as foreign matter being caught in the opening-closing valve 6 and foreign matter passing from the second chamber 42 to the head unit 21. It is thus possible to prevent operation failure of the liquid feeding unit 3 ascribable to entry of foreign matter.

The holding structure of the filter member 442 will be described. As shown in FIG. 19B, the filter member 442 is held (fastened) in a state pressed by the coil spring 446 against the holding member 443. To the holding member 443, a peripheral edge portion of the filter member 442 is fastened. Through a central region of the filter member 442 excluding the peripheral edge portion, ink passes and meanwhile foreign matter is trapped (see the arrow in FIG. 19B).

The holding member 443 is arranged near the downstream end 441B in the filter chamber 44, and includes a frame member 444, which has an opening 444A serving as a flow passage for ink, and a ring-form seal member 445, which is supported by the frame member 444. As the frame member 444, a molding of hard resin can be used. As the seal member 445, a molding of soft resin or rubber can be used. The seal member 445 is fitted in a seat portion provided in the rear face of the frame member 444. The filter member 442 abuts on the rear-face side of the seal member 445. The front face of the frame member 444 is engaged with a step portion 441C formed at the downstream end 441B of the inner wall face 441.

The coil spring 446 presses the peripheral edge portion of the filter member 442 against the rear-face side of the seal member 445. The coil spring 446 is, with its coil axis aligned with the ink feed direction (front-rear direction), housed in the filter chamber 44. More specifically, the coil spring 446 is fitted in the filter chamber 44 such that the rear end 446A (one end) of the coil spring 446 is locked at the upstream end 441A of the inner wall face 441 and that the front end 446B (other end) of the coil spring 446 presses the peripheral edge portion of the filter member 442 against the seal member 445.

With the above-described structure of the filter chamber 44, the opening 444A in the frame member 444 that holds the ring-form seal member 445 is closed by the filter member 442. Thus, foreign matter in ink can be reliably trapped by the filter member 442. Moreover, the fastening-together of the filter member 442 and the holding member 443 can be achieved with the pressing force of the coil spring 446 without the use of adhesive or the like. During the operation of the liquid feeding unit 3, the filter member 442 is exposed to liquid, and the peripheral edge, portion, which serves as a fastened portion fastened to the holding member 443, is submerged in ink. The ink can be a solvent to the above-mentioned adhesive or the like. Thus, if the filter member 442 is fastened by use of adhesive or the like, the filter member 442 may peel off the holding member 443, or the adhesive or the like may dissolve into ink to become foreign matter. These inconveniences can be overcome according to the embodiment which uses the pressing force of the coil spring 446. Moreover, providing the filter chamber 44 as a chamber dedicated to filtering of ink allows easy fitting of the filter member 442 to the liquid feeding unit 3 and reliable fulfillment of the filtering function.

Air Vent Mechanism for the Second Chamber

Figure 21A:
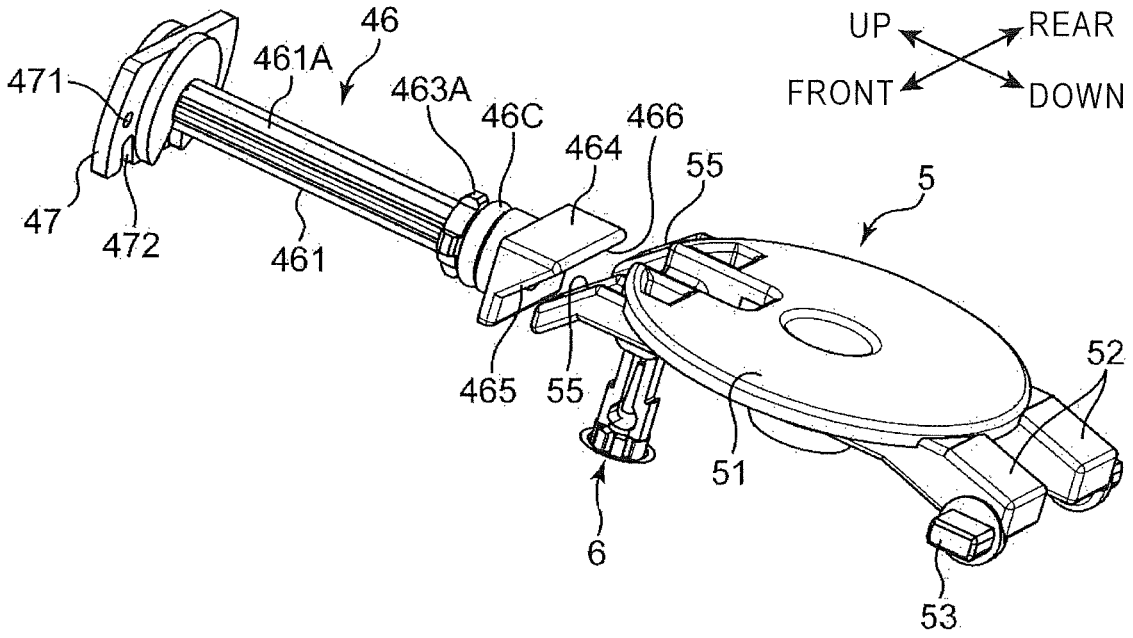
FIGS. 21A and 21B are perspective views of the pressing member, the opening-closing valve, and the lever member.
Figure 21B:
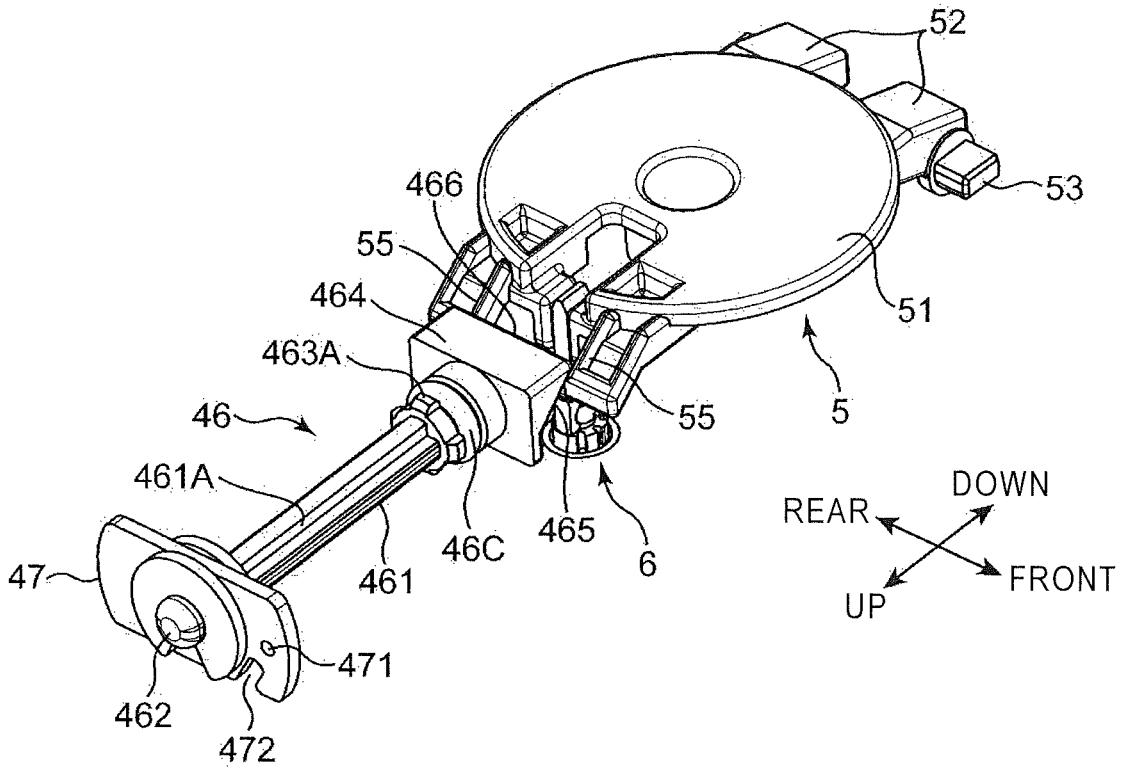
Figure 22A:
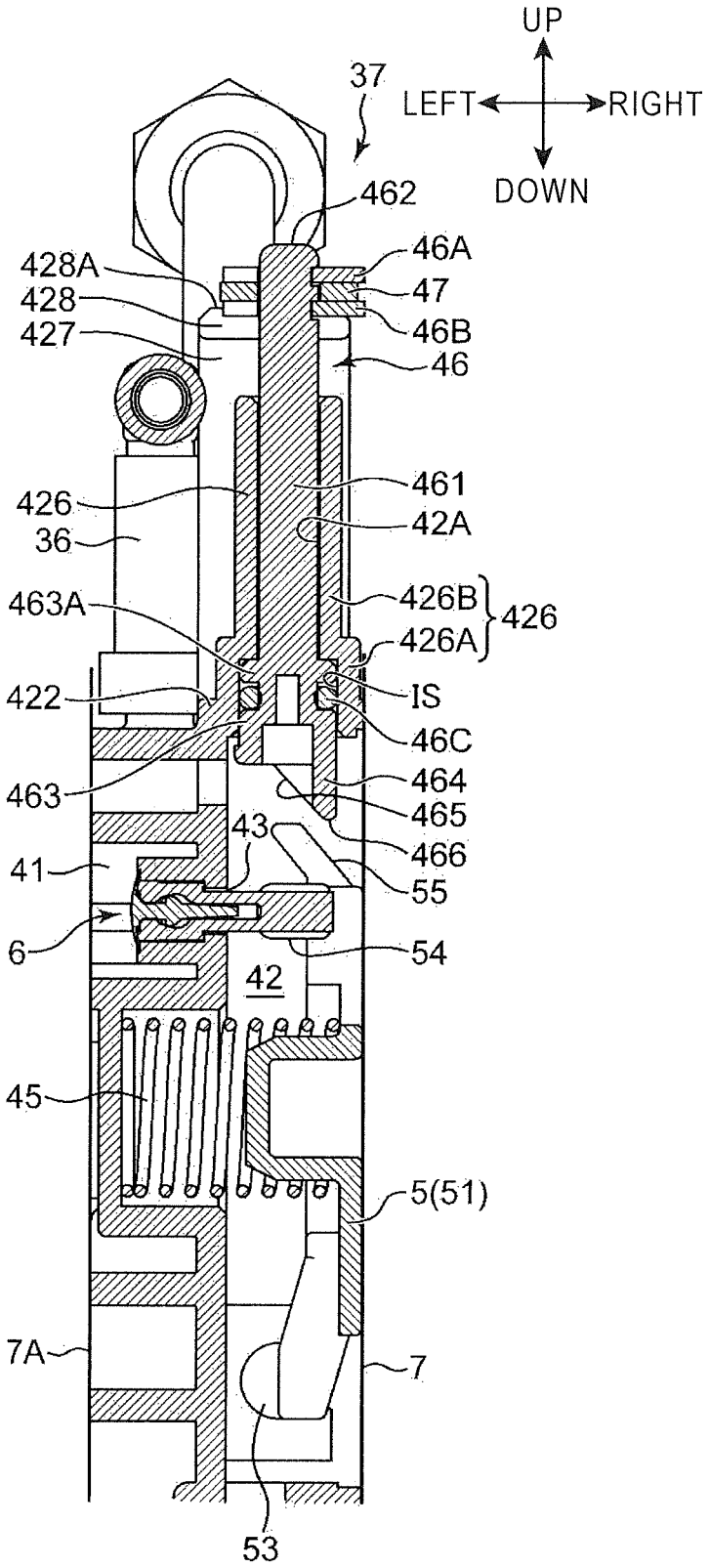
FIG. 22A is a sectional view showing a state before operation of the lever member.
Figure 22B:
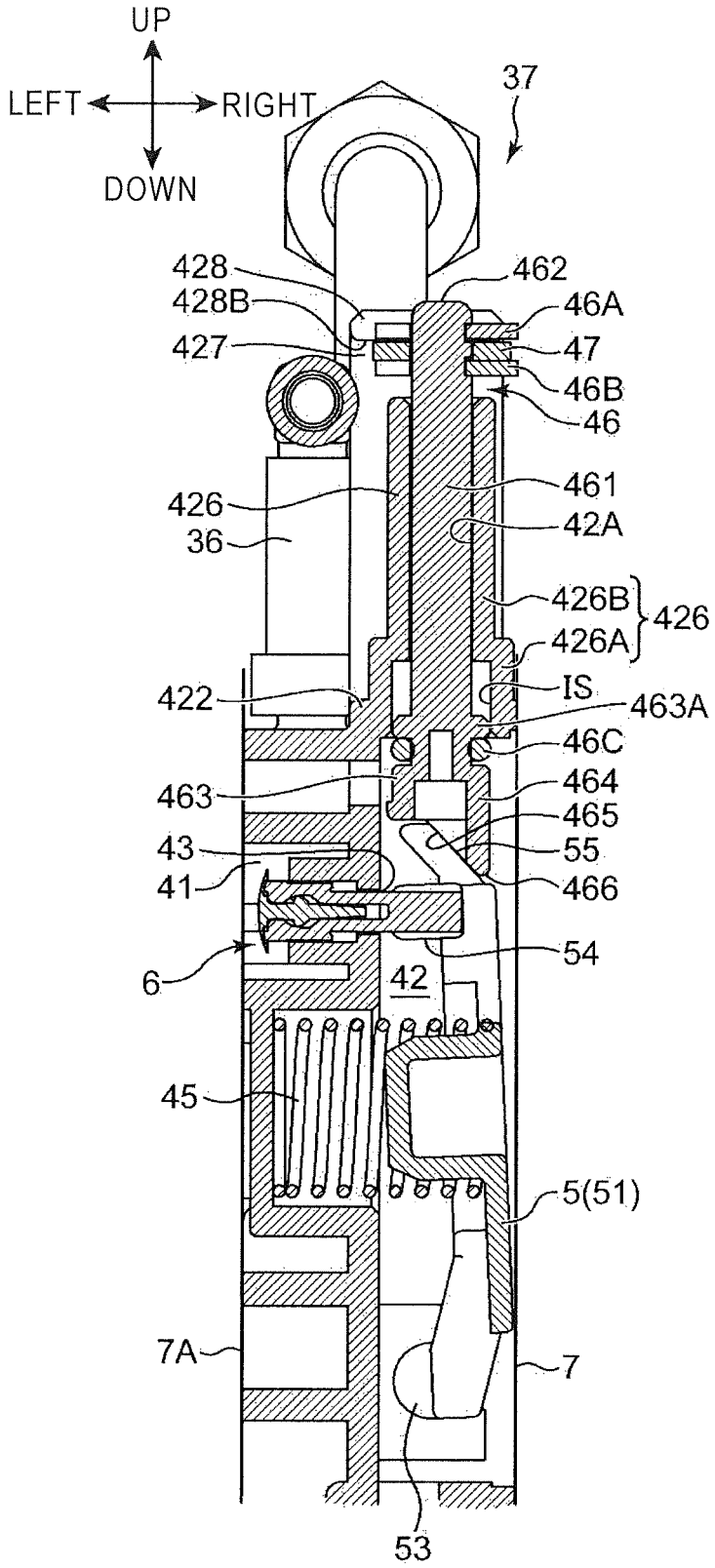
FIG. 22B is a sectional view showing a state where air venting is performed through operation of the lever member.

Next, a description will be given of the air vent mechanism 37 fitted to the second chamber 42 with reference to, in addition to FIG. 12A previously referred to, FIGS. 20A, 20B, 20C, 21A, 21B, 22A, and 22B. FIGS. 20A and 20B are perspective views of the lever member 46, which is a component of the air vent mechanism 37, and FIG. 20C is an exploded perspective view of the lever member 46. FIGS. 21A and 21B are perspective views showing the positional relationship among the pressing member 5, the opening-closing valve 6, and the lever member 46. FIGS. 22A and 22B are sectional views showing the same section as the FIG. 16A and illustrating air venting operation by the lever member 46. As mentioned previously, the air vent mechanism 37 is used, at initial use and after maintenance, to vent air during initial loading of the second chamber 42 with ink and to discharge air bubbles that develop in ink.

The air vent mechanism 37 includes, in addition to the already-mentioned boss portion 426 that is provided to protrude from the upper-end portion 422 of the second chamber 42, a lever member 46, a seal ring 46C, and a stopper 47. As shown in FIG. 12A, the boss portion 426 is provided to protrude from the topmost end of the second demarcation wall 421 that demarcates the second chamber 42, and has a boss hole 42A with a circular section. The boss hole 42A is an opening through which the second chamber 42 communicates with the atmosphere, that is, an air vent hole. Providing the boss hole 42A at the topmost position in the second chamber 42 makes it possible to reliably vent air from the second chamber 42. The boss portion 426 has a large-diameter portion 426A located right over the upper-end portion 422 and a small-diameter portion 426B formed over, continuously with, the large-diameter portion 426A. The inner diameter of the boss hole 42A in the large-diameter portion 426A is larger than the inner diameter of the boss hole 42A in the small-diameter portion 426B.

As shown in FIG. 20C, the lever member 46 has the shape of a shovel that includes a bar-form member 461 and a pressing piece 464. Part of the bar-form member 461 is inserted through the boss hole 42A. The pressing piece 464 is provided under, continuously with, the bar-form member 461. The lever member 46 is a kind of valve member, and is set either at a sealing position where it seals the boss hole 42A or at an open position where it opens the boss hole 42A. In the embodiment, the operation of changing the position of the lever member 46 is coordinated with the operation of changing the state of the opening-closing valve 6 via the pressing member 5. More specifically, when the lever member 46 is set at the sealing position, the opening-closing valve 6 is allowed to be in the closed state. When the lever member 46 is set at the open position, the opening-closing valve 6 is switched from the closed state to the open state.

The bar-form member 461 of the lever member 46 is a cylindrical member with an outer diameter smaller than the hole diameter of the boss hole 42A, and has an upper-end portion 462 and a lower-end portion 463. The upper-end portion 462 operates as an input portion that receives from the user a pressing force that presses the lever member 46 down. The lower-end portion 463 is connected to the pressing piece 464. As shown in FIGS. 21A and 21B, the pressing piece 464 functions as a transmission portion that transmits the pressing force applied to the upper-end portion 462 to the receiving slopes 55 of the pressing member 5. The lever member 46 has a discontinuous projection portion 463A. The discontinuous projection portion 463A is arranged a small distance over the lower-end portion 463, and is composed of a plurality of small projections arranged in a ring shape in the circumferential direction of the bar-form member 461.

The pressing piece 464 has a pressing slope 465 and a lower-end edge 466. The pressing slope 465 is inclined relative to the axial line of the bar-form member 461. The lower-end edge 466 extends in the front-rear direction at the lowermost end of the pressing piece 464. The pressing slope 465 is a slope that extends upward starting at the lower-end edge 466. The pressing slope 465 and the lower-end edge 466 operate as a portion that interferes with the pair of, front and rear, receiving slopes 55 of the pressing member 5 when the lever member 46 receives the pressing force. The width of the pressing slope 465 in the front-rear direction is larger than the interval between the pair of receiving slopes 55. The pressing slope 465 and the lower-end edge 466 abut the receiving slopes 55 and transmits the pressing force to the pressing member 5; this causes the pressing member 5 to pivot leftward about the axis of the pivot portions 53, switching the opening-closing valve 6 from the closed state to the open state.

An upper engagement groove 467A and a lower engagement groove 467B are formed near the upper-end portion 462 of the bar-form member 461, and are located side by side at an interval from each other in the up-down direction. An upper washer 46A is fitted in the upper engagement groove 467A. A lower washer 46B is fitted in the lower engagement groove 467B. A seal groove 468 is provided near the lower-end portion 463. The outer diameter of the lower-end portion 463 is larger than the outer diameter of the other part of the bar-form member 461, and the part between the lower-end portion 463 and the discontinuous projection portion 463A is the seal groove 468. A plurality of air vent longitudinal grooves 461A are provided over the entire length of the bar-form member 461 in the up-down direction. The air vent longitudinal grooves 461A are each formed as a recessed groove. In the circumferential direction, the positions of the air vent longitudinal grooves 461A coincide with the positions of the trough portions of the discontinuous projection portion 463A.

The bar-form member 461 is fitted with a seal ring 46C and a stopper 47. The seal ring 46C is an O ring with an inner diameter slightly larger than the upper washer 46A, and is penetrated by the bar-form member 461 to be fitted in the seal groove 468. With the seal ring 46C fitted in the seal groove 468, the outer circumferential face of the seal ring 46C is in sliding contact with the inner circumferential face IS of the large-diameter portion 426A of the boss portion 426. The stopper 47 is a plate member in a substantially rectangular shape, and is provided with a pivot hole 47H through which the bar-form member 461 is inserted. The fitting position of the stopper 47 is near the upper-end portion 462, between the upper and lower engagement grooves 467A and 467B. The upper and lower washers 46A and 46B hold the stopper 47 between them and restricts the movement of the stopper 47 in the axial direction.

Figure 23A:
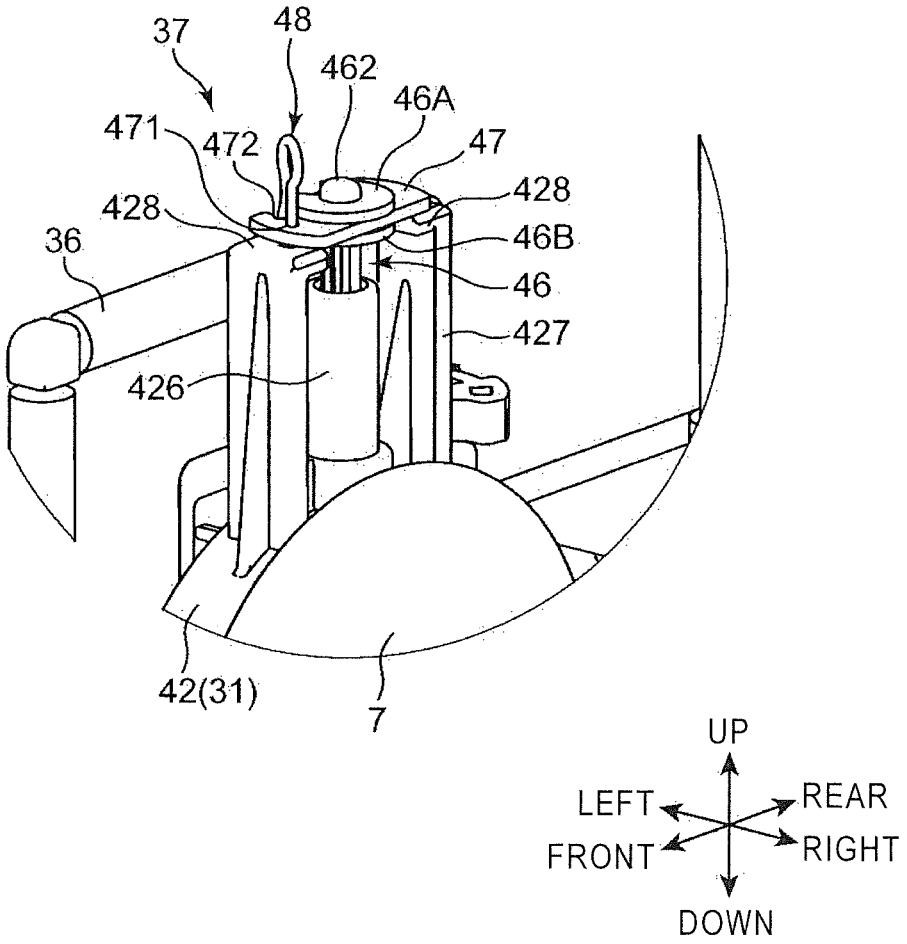
FIG. 23A is a perspective view of an air vent mechanism corresponding to the state in FIG. 22A.

With the stopper 47 held between the upper and lower washers 46A and 46B, the stopper 47 can pivot about the axis of the bar-form member 461. As shown in FIGS. 22A and 22B, as the lever member 46 moves up and down, the stopper 47 abuts on the upper face 428A or the lower face 428B of the pair of locking claws 428 of the holding frame 427. When the lever member 46 moves up and down, the stopper 47 pivots such that the longitudinal direction of the stopper 47 aligns with the left-right direction, and passes through the gap between the pair of locking claws 428. A pin hole 471 and a locking recess 472 are formed in the stopper 47. At least when the stopper 47 abuts on the upper face 428A, as shown in FIGS. 12A and 23A, a pin member 48 of a split pin type is fitted in the pin hole 471 and the locking recess 472. The stopper 47 is fastened, and thereby the stopper 47 is prevented from rotating and slipping off. The stopper 47, the pin member 48, and the pair of locking claws 428 function as a fastening mechanism that fastens the lever member 46.

Next, the operation of the lever member 46 will be described. FIG. 22A is a sectional view showing a state before operation of the lever member 46. FIG. 22B is a sectional view showing a state where, through operation of the lever member 46, air is being vented from the second chamber 42. FIG. 22A shows a state where the upper-end portion 462 of the lever member 46 is not receiving a pressing force, that is, the lever member 46 is set in the sealing position where it seals the boss hole 42A. On the other hand, FIG. 22B shows a state where the upper-end portion 462 is pressed downward and a pressing force is being applied to it, that is, the lever member 46 is set in the open position where it opens the boss hole 42A.

The sealing position is set by the pin member 48 fastening the stopper 47 and the upper face 428A with the stopper 47 abutting on the upper face 428A of the locking claws 428. The fastening keeps the lever member 46 lifted up. Accordingly, the discontinuous projection portion 463A and the lower-end portion 463 of the bar-form member 461 is housed in the large-diameter portion 426A of the boss portion 426. That is, the outer circumferential face of the seal ring 46C abuts on the inner circumferential face IS of the large-diameter portion 426A. Thus, the boss hole 42A is sealed. The pressing piece 464 (the pressing slope 465 and the lower-end edge 466) of the lever member 46 is apart from the receiving slopes 55 of the pressing member 5, and does not apply a force to the pressing member 5. Thus, the opening-closing valve 6 remains in the closed state.

By contrast, when the lever member 46 is set in the open position, the lever member 46 receives a pressing force and descends. Also the discontinuous projection portion 463A and the lower-end portion 463 descend, and as a result the seal ring 46C moves away from the inner circumferential face IS. Thus, the air passage formed by the trough portions of the discontinuous projection portion 463A and the air vent longitudinal grooves 461A of the bar-form member 461 communicates with the space inside the second chamber 42. That is, the boss hole 42A is opened, and the second chamber 42 communicates with outside air. Thus, the air detained in the second chamber 42 can be vented to the outside through the boss hole 42A.

The pressing force is transmitted from the lever member 46 to the pressing member 5. As shown in FIG. 22B, the pressing slope 465 and the lower-end edge 466 press the receiving slopes 55. With the receiving slopes 55 pressed, the pressing member 5 (disk portion 51) pivots leftward about the axis of the pivot portions 53. As mentioned previously, when the pressing member 5 pivots leftward, the pressing member 5 presses the opening-closing valve 6 leftward via the link bosses 54, and switches the opening-closing valve 6 from the closed state to the open state. Thus, the sealing of the communication hole 43 is canceled, and now the first and second chambers 41 and 42 communicate with each other.

The open position is set by the stopper 47 being pressed against the lower face 428B of the locking claws 428. That is, the stopper 47 is pressed down and moves to under the locking claws 428. Then, with the pressing piece 464 pressing the receiving slopes 55, the pressing member 5 is pivoted against the biasing force of the biasing spring 45. Thus, the biasing force of the biasing spring 45 is applied to the pressing piece 464. That is, the biasing force acts on the lever member 46, and the lever member 46 is lifted up. By the biasing force, the stopper 47 is pressed against the lower face 428B of the locking claws 428, and the open position is maintained.

When the lever member 46 is set in the open position, the second chamber 42 has an inflow hole (the communication hole 43) and an outflow hole (the boss hole 42A). Accordingly, at initial use, it is possible to smoothly perform, by head-difference feeding, the operation of, while venting the air in the second chamber 42 through the boss hole 42A, feeding ink from the first chamber 41 to the second chamber 42 through the communication hole 43. When the amount of air in the second chamber 42 has increased, as when air bubbles have developed in ink, then, with the lever member 46 set in the open position, it is possible to easily vent air from the second chamber 42. When the amount of air in the second chamber 42 increases, the ink liquid level in the second chamber 42 lowers. The ink liquid surface in the second chamber 42 can be monitored at the monitor pipe 36. That is, the user can recognize an increase in the amount of air in the second chamber 42 by use of the monitor pipe 36.

In the embodiment, when the lever member 46 is set in the open position, the pressing member 5 sets the opening-closing valve 6 in the open state. That is, a single action with the lever member 46 permits the second chamber 42 to have an inflow hole and an outflow hole. Thus, the user can easily perform air venting operation with respect to the second chamber 42. The air vent mechanism 37 is arranged on the top face of the tank portion 31. Even with a plurality of liquid feeding units 3 kept mounted on the carriage 2 as shown in FIG. 4, the user can perform, by reaching them from in front of the carriage 2, air venting operation with respect to each liquid feeding unit 3.

Procedure of Air Venting

Figure 23B:
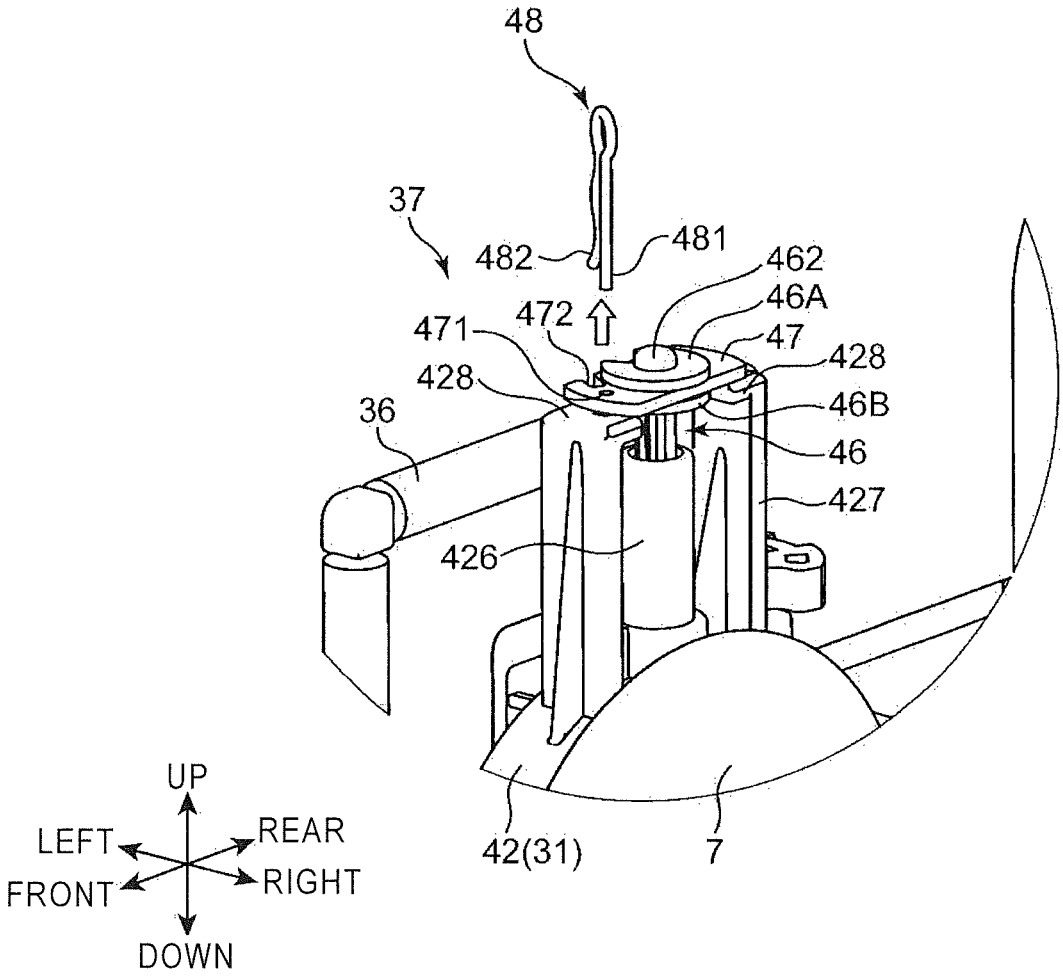
FIG. 23B is a perspective view showing operation of the lever member.
Figure 24A:
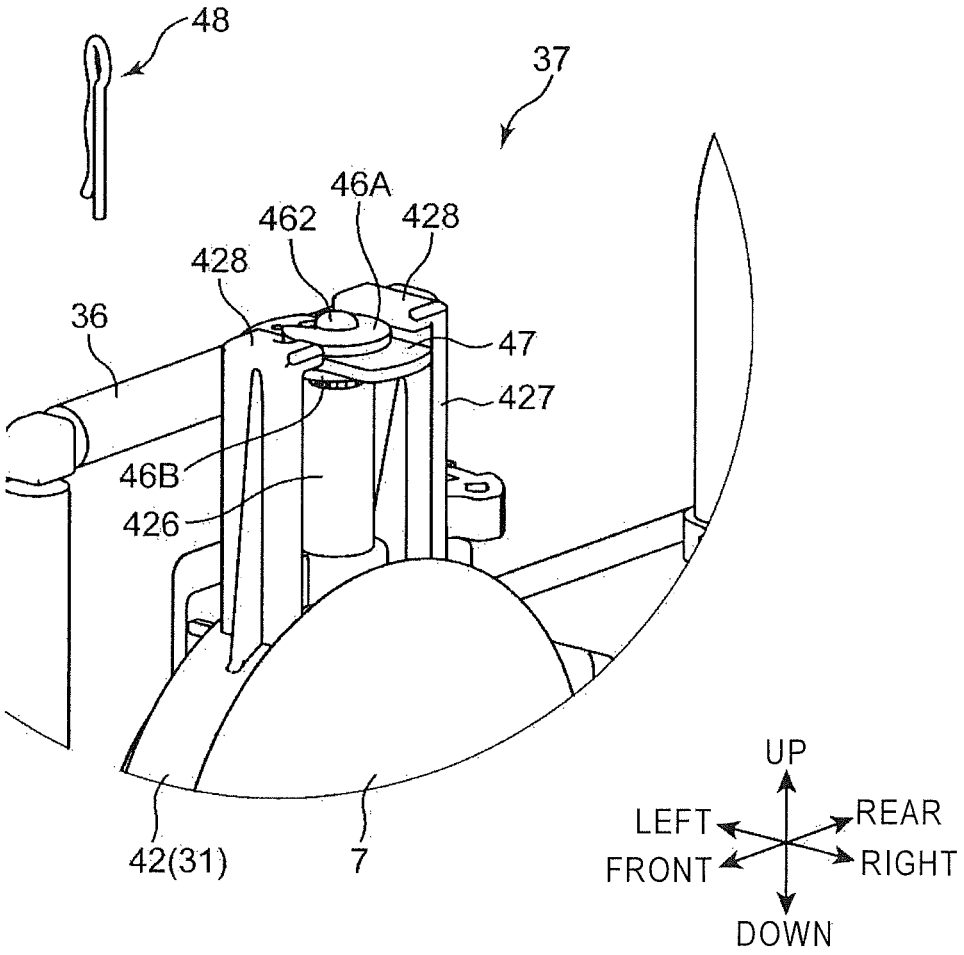
FIG. 24A is a perspective view showing operation of the lever member.
Figure 24B:
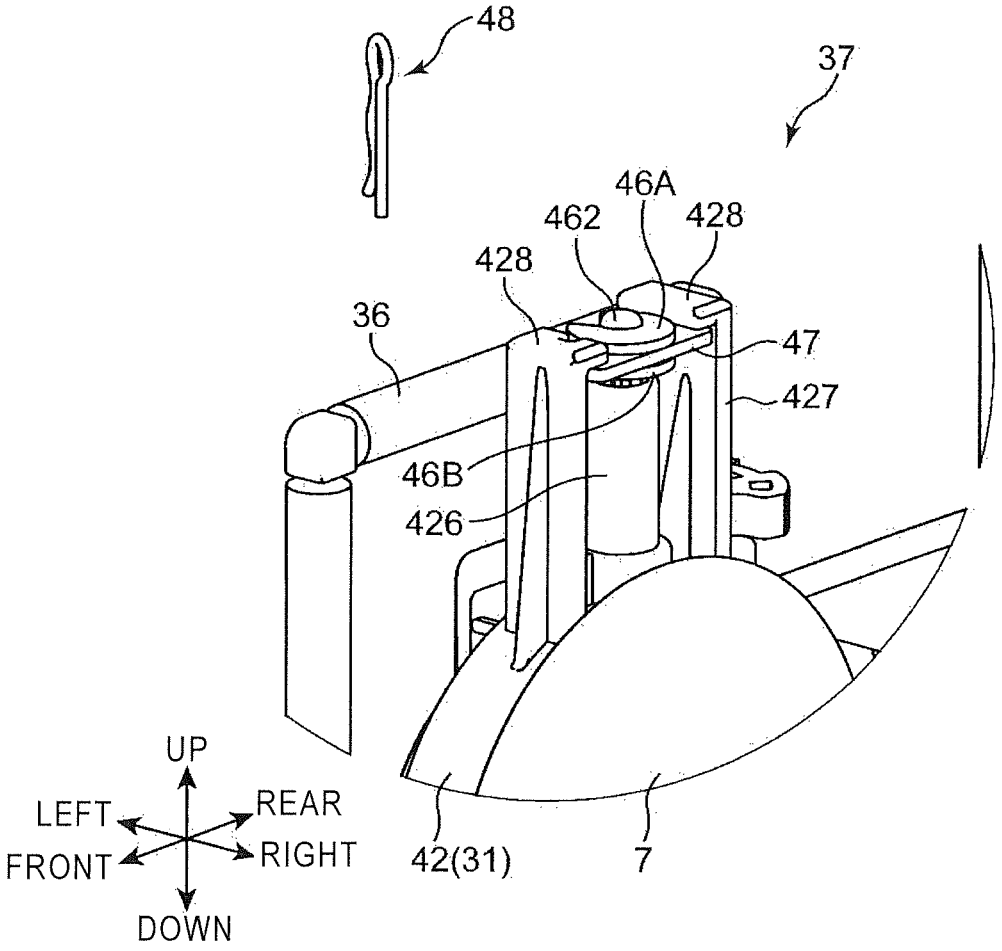
FIG. 24B is a perspective view of the air vent mechanism corresponding to the state in FIG. 22B.

Next, an example of air venting operation in the air vent mechanism 37 will be described with reference to FIGS. 23A, 23B, 24A, and 24B. FIG. 23A is a perspective view of the air vent mechanism 37 corresponding to the state in FIG. 22A. FIGS. 23B and 24A are perspective views showing the operation of the lever member 46. FIG. 24B is a perspective view of the air vent mechanism 37 corresponding to the state in FIG. 22B.

As shown in FIGS. 22A and 23A, when the lever member 46 is in the sealing position, as mentioned above, with the stopper 47 abutting on the upper face 428A of the locking claws 428, the stopper 47 and the upper face 428A are fastened together by the pin member 48. The stopper 47 is pivoted such that the longitudinal direction of the stopper 47 aligns with the front-rear direction. Thus, the front-end side of the stopper 47 overlaps the front-side locking claw 428. The rear-end side of the stopper 47 overlaps the rear-side locking claw 428. The pin hole 471 and the locking recess 472 in the stopper 47 are, as a result of the pivoting, located on the front-end side. The front-side locking claw 428 is provided with a notch portion (not shown) at a position corresponding to the pin hole 471. The pin member 48 of a split pin type has a vertical portion 481 and an engagement portion 482 of which the lower-end side is bent outward. The vertical portion 481 is inserted through the pin hole 471 so that part of the vertical portion 481 reaches the notch portion (not shown) in the locking claw 428 and the engagement portion 482 is fitted in the locking recess 472, and thereby the stopper 47 is fastened to the locking claw 428. With the lever member 46 in the sealing position, the lever member 46 is in a state lifted up; thus, the seal ring 46C abuts on the inner circumferential face IS of the boss hole 42A to exert a sealing effect, and the pressing slope 465 is apart from the receiving slopes 55.

When air venting operation with respect to the second chamber 42 is performed, as shown in FIG. 23B, first, the user or serviceperson pulls the pin member 48 out of the stopper 47. Now the stopper 47 can pivot about the axis of the bar-form member 461. Subsequently, as shown in FIG. 24A, the user or serviceperson pivots the stopper 47 through 90° such that the longitudinal direction of the stopper 47 aligns with the left-right direction. The pivoting permits the stopper 47 to pass through the gap between the pair of, front and rear, locking claws 428 in the up-down direction. Then, the user or serviceperson presses down the upper-end portion 462, that is, the lever member 46. The pressing-down is performed until the upper face of the stopper 47 reaches below the lower face 428B of the locking claws 428.

Then, as shown in FIG. 24B, the user or serviceperson pivots the stopper 47 through 90° such that the longitudinal direction of the stopper 47 aligns with the front-rear direction. Now, the front-side locking claw 428 overlaps the front-end side of the stopper 47; the rear-side locking claw 428 overlaps the rear-end side of the stopper 47. In this state, as shown in FIG. 22B, the lever member 46 is pressed down and is set in the open position. The seal ring 46C is apart from the inner circumferential face IS of the boss hole 42A, and no longer exerts a sealing effect. The pressing force applied to the upper-end portion 462 is transmitted via the pressing piece 464 to the receiving slopes 55. Against the biasing force of the biasing spring 45, the pressing member 5 is pivoted. At this time, by the resilient force of the biasing spring 45, the stopper 47 is pressed against the lower face 428B of the locking claws 428. This results in a fastened state of the lever member 46 for the open position.

As described above, irrespective of whether the lever member 46 is set in the sealing state or in the open state, it is possible, by using the locking claws 428, to easily maintain the state of the lever member 46. For example, when the second chamber 42 is loaded with liquid at initial use, air venting is necessary with the second chamber 42, and thus the lever member 46 needs to be kept in the open position. In this case, the user or serviceperson can perform the operation of pressing down the upper-end portion 462 of the lever member 46 and slipping the stopper 47 onto the lower face 428B of the locking claws 428. This eliminates the need for the user or serviceperson to keep pressing down the upper-end portion 462, and thus facilitates the operation. On the other hand, during regular use of the liquid feeding unit 3, the lever member 46 needs to be kept in the sealing position. In this case, the stopper 47 can simply be laid over the upper face 428A of the locking claws 428 so that the pin member 48 is fastened, and this involves simple operation.

Backflow Prevention Valve

Figure 25:
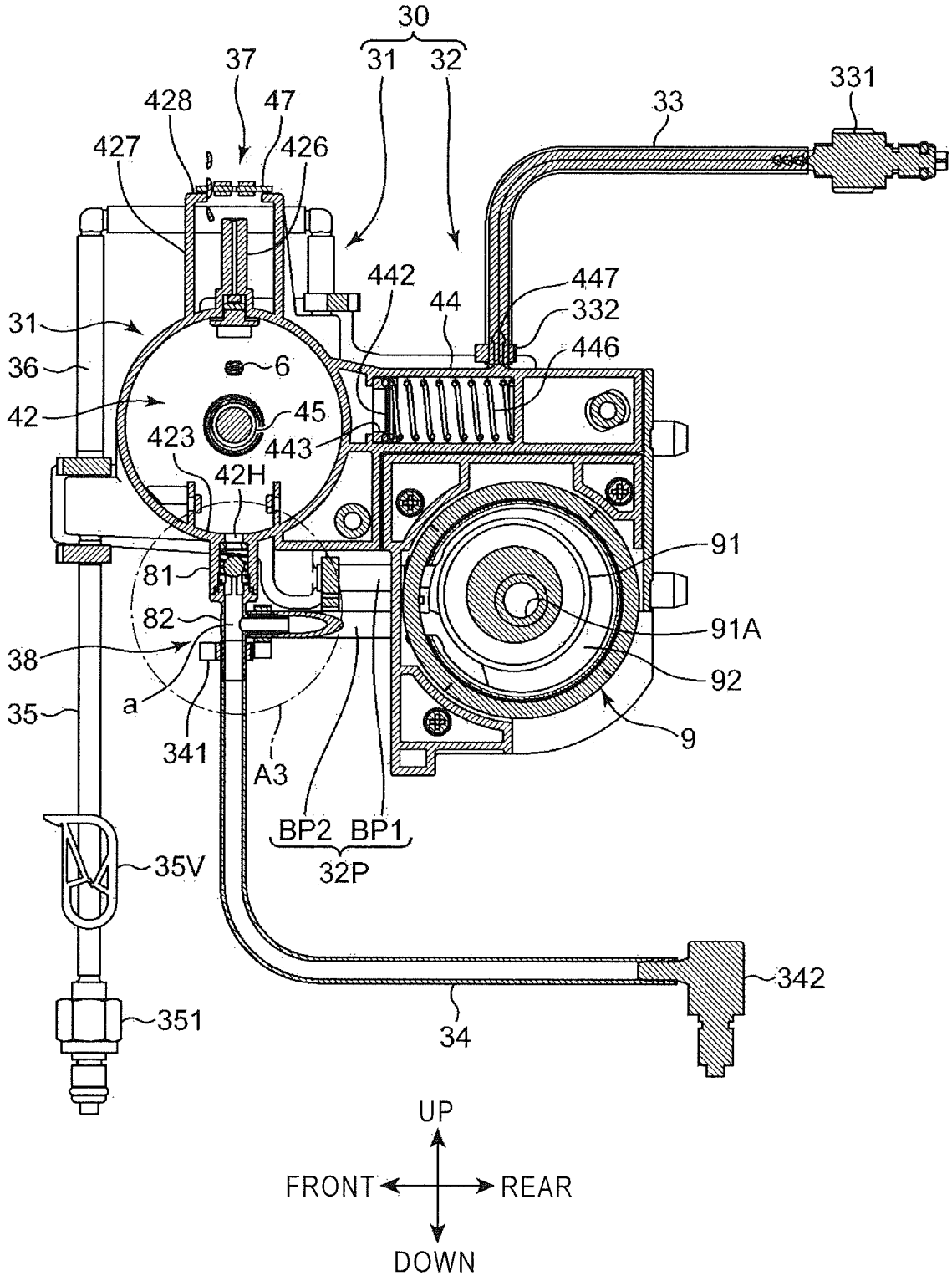
FIG. 25 is a sectional view of the liquid feeding unit in the front-rear direction.
Figure 26:
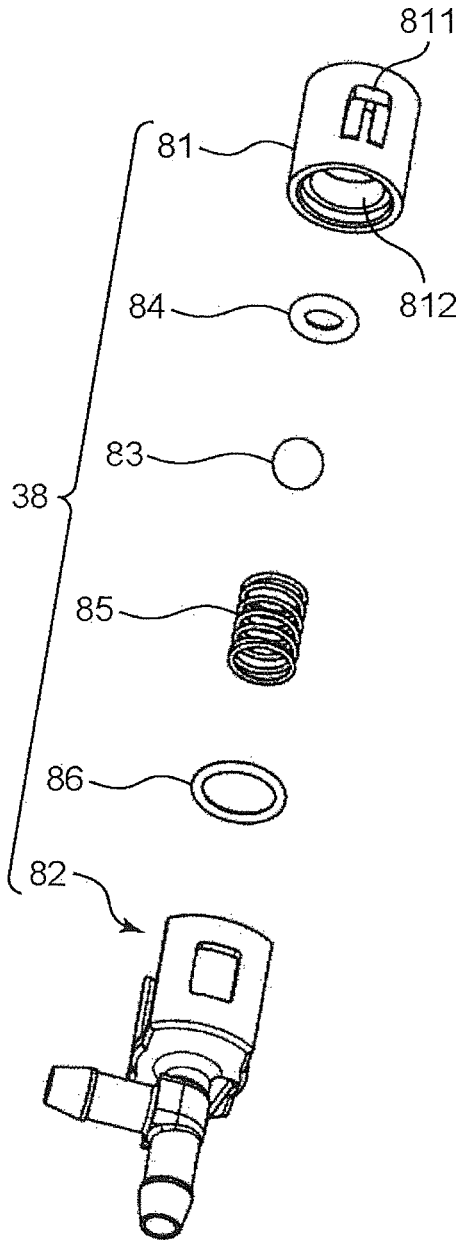
FIG. 26 is an exploded perspective view of a backflow prevention mechanism.
Figure 27A:
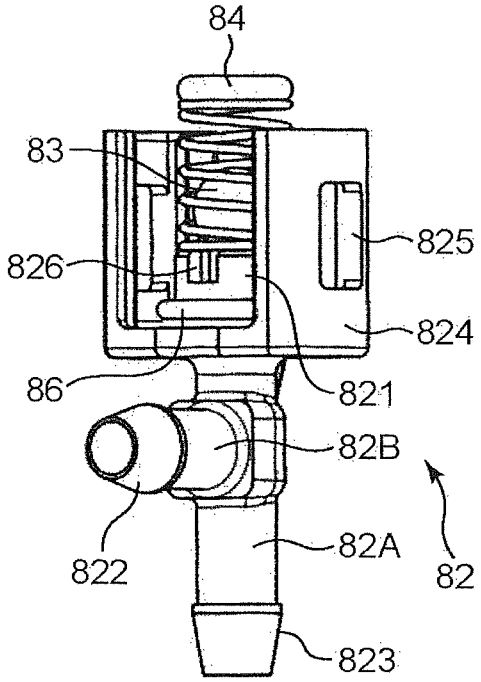
FIG. 27A is a perspective view of the backflow prevention mechanism, showing a state where a sphere member leaves a valve pipe passage open.
Figure 27B:
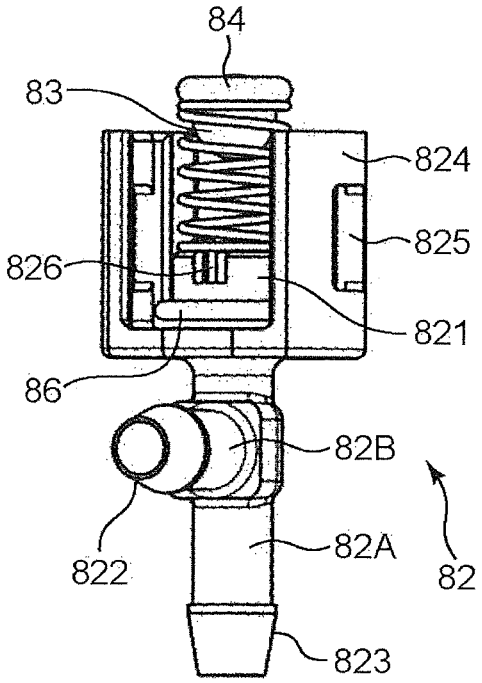
FIG. 27B is a diagram showing a state where the sphere member keeps the valve pipe passage closed.
Figure 27C:
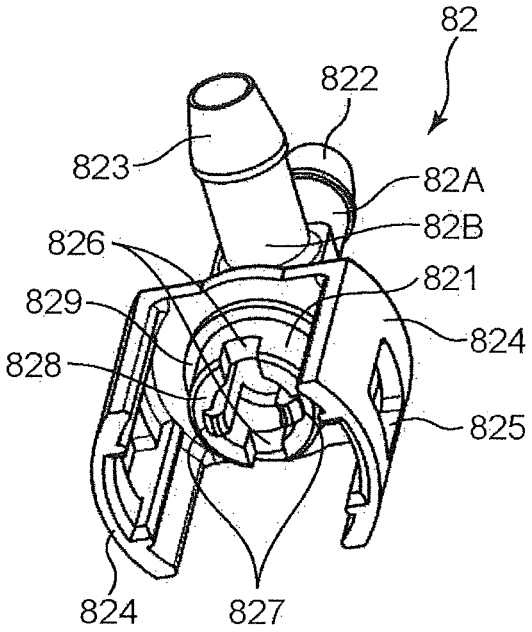
FIG. 27C is a perspective view of a branch head portion.
Figure 28A:
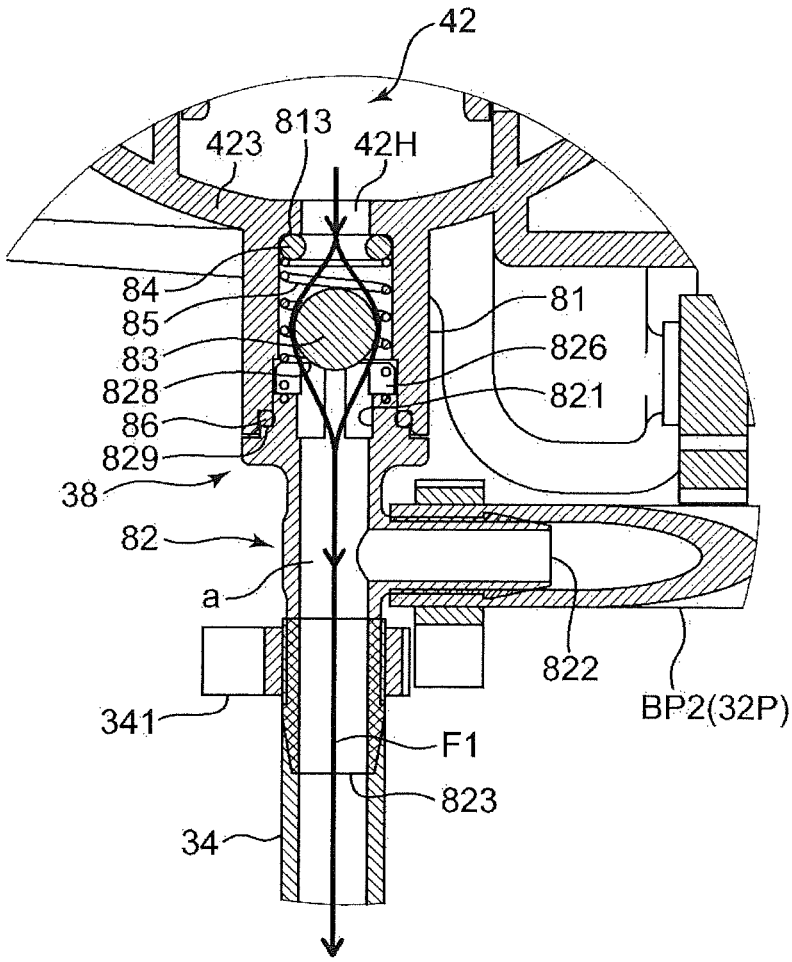
FIG. 28A is a sectional view showing a state of the backflow prevention mechanism in the printing mode.
Figure 28B:
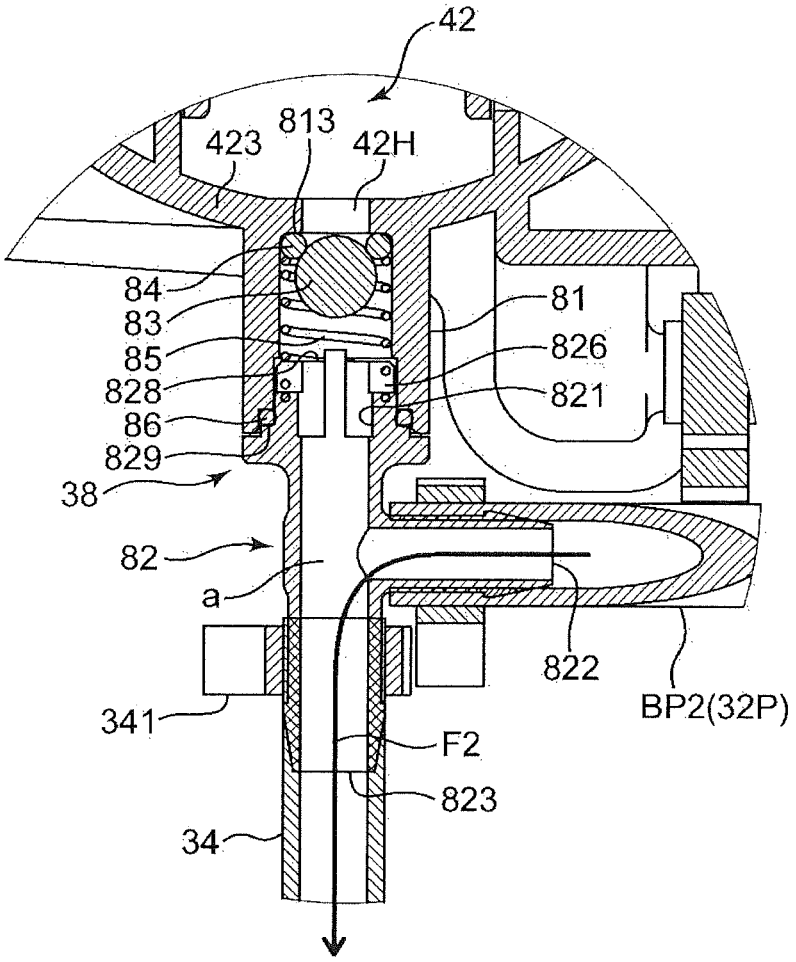
FIG. 28B is a sectional view showing a state of the backflow prevention mechanism in the pressurized purging mode.

Next, the structure of the backflow prevention mechanism portion 38 will be described in detail. As described earlier with reference to FIG. 9A, when the pressurized purging mode is performed, the backflow prevention mechanism portion 38 prevents a backflow of the ink pressurized by the pump 9 to the second chamber 42. FIG. 25 is a sectional view of the liquid feeding unit 3 in the front-rear direction, including a section of the backflow prevention mechanism portion 38. FIG. 26 is an exploded perspective view of the backflow prevention mechanism portion 38. FIGS. 27A, 27B, and 27C are perspective views of the backflow prevention mechanism portion 38. FIGS. 28A and 28B are enlarged views of part A3 in FIG. 25, FIG. 28A being a sectional view showing the state of the backflow prevention mechanism portion 38 in the printing mode, FIG. 28B being a sectional view showing the state of the backflow prevention mechanism portion 38 in the pressurized purging mode.

The backflow prevention mechanism portion 38 includes a valve pipe passage 81, a branch head portion 82, a spherical member 83, a seal member 84, a coil spring 85, and an O ring 86. The valve pipe passage 81 is a member that is integral with the lower-end portion 423 of the second chamber 42, and the other components are fitted to the valve pipe passage 81. FIGS. 27A and 28B are perspective views of the backflow prevention mechanism portion 38 excluding the valve pipe passage 81. FIG. 27C is a perspective view of the branch head portion 82 as seen from above.

As already mentioned, the feed hole 42H is formed in the lower-end portion 423 (lowermost end portion) of the second chamber 42. The valve pipe passage 81 is a pipe passage that extends vertically downward from the feed hole 42H, and is a portion that is formed integrally with the second demarcation wall 421. The valve pipe passage 81 provides an ink flow passage that connects together the second chamber 42 and the downstream pipe 34, and is part of the ink feed passage that runs from the second chamber 42 to the ink ejection portion 22. To lock the branch head portion 82, locking pieces 811 are provided to protrude from the outer circumferential face of the valve pipe passage 81, and a fitting annular projection 812 is provided to protrude from the inner circumferential face of the valve pipe passage 81.

The branch head portion 82 is a member that forms the joint portion a previously described with reference to FIGS. 7, 8, 9A, and 9B. The branch head portion 82 includes a first inlet port 821, a second inlet port 822, an outlet port 823, a pair of body portions 824, locking windows 825, notch portions 826, and fitting claws 827. The first inlet port 821 is a port that is connected to the second chamber 42. In the embodiment, the first inlet port 821 communicates via the valve pipe passage 81 with the second chamber 42. The second inlet port 822 is a port to which the downstream end of the bypass pipe 32P (bypass downstream pipe BP2) is connected. The outlet port 823 is a port to which the upstream end 341 of the downstream pipe 34 is connected.

The branch head portion 82 is a T-shaped pipe having a vertical portion 82A and a horizontal portion 82B. The vertical portion 82A extends vertically downward from the lower-end side of the valve pipe passage 81. The horizontal portion 82B joins the middle of the vertical portion 82A from a horizontal direction. The upper-end side of the vertical portion 82A is the first inlet port 821, and the lower-end side of the vertical portion 82A is the outlet port 823. The distal end of the horizontal portion 82B is the second inlet port 822. In the printing mode described above, ink is fed to the downstream pipe 34 through the first inlet port 821. By contrast, in the pressurized purging mode, ink is fed to the downstream pipe 34 through the second inlet port 822.

The pair of body portions 824 includes a pair of arc-form pieces that face each other. The first inlet port 821 is arranged between the pair of body portions 824. The valve pipe passage 81 fits in the gap between the first inlet port 821 and the pair of the body portions 824. The locking windows 825 are openings provided in the body portions 824. The locking pieces 811 on the valve pipe passage 81 engage with the locking windows 825. The notch portions 826 are portions formed by cutting off parts of the circumferential wall of the cylindrical first inlet port 821, and are formed to secure a flow passage for ink. The fitting claws 827 are hook-form portions that are provided to protrude upward from the upper end of the first inlet port 821, and engage with the fitting annular projection 812 in the valve pipe passage 81. That is, the branch head portion 82 is fastened to the valve pipe passage 81 by, on the outer circumference of the valve pipe passage 81, engagement of the locking pieces 811 with the locking windows 825 and, on the inner circumference of the valve pipe passage 81, engagement of the fitting annular projection 812 with the fitting claws 827. The upper-end edge 828 of the first inlet port 821 functions as a sphere seat that bears the spherical member 83, which will be described later.

The spherical member 83 is housed in the valve pipe passage 81 so as to be movable in the ink feed direction, and functions as a valve. The outer diameter of the spherical member 83 is smaller than the inner diameter of the valve pipe passage 81, and is still smaller than the inner diameter of the coil spring 85. While the spherical member 83 can be formed of any of various materials, it is preferable that the spherical member 83 be formed of a material with a specific gravity twice or less the specific gravity of ink, in particular a material with a specific gravity in the range of 1.1 to 1.5 times the specific gravity of ink. With a material in this range, the spherical member 83 has a specific gravity higher than that of ink, and thus the spherical member 83 can descend easily under its own weight in the valve pipe passage 81; in addition, owing to the specific gravity of the spherical member 83 being close to that of ink, the spherical member 83 can ascend speedily in the valve pipe passage 81 during pressurized purging.

In general, ink used in an inkjet printer is a water-soluble liquid, and has a specific gravity equal to or around one. Accordingly, it is preferable to select as the material of the spherical member 83 a material with a specific gravity less than two. It is preferable that the material be resistant to chemicals and wear so that it will not deteriorate in constant contact with ink. From these viewpoints, it is particularly preferable to use, as the material for the spherical member 83, polyacetal (with a specific gravity of 1.42), polybuthylene terephthalate (with a specific gravity of 1.31 to 1.38), polyvinyl chloride (with a specific gravity of 1.35 to 1.45), polyethylene terephthalate (with a specific gravity of 1.34 to 1.39), or the like.

As shown in FIGS. 28A and 28B, the seal member 84 is a ring-form sealing component that fits on a seat portion 813 provided over the spherical member 83, at the upper-end side of the valve pipe passage 81. The ring inner diameter of (the diameter of the through hole in) the seal member 84 is set smaller than the outer diameter of the spherical member 83. When the spherical member 83 has moved downward away from the seal member 84 as shown in FIG. 28A, the valve pipe passage 81 is open. By contrast, as shown in FIG. 28B, when the spherical member 83 is in contact with the seal member 84, the valve pipe passage 81 is closed.

The coil spring 85 is a compression spring that is fitted inside the valve pipe passage 81. An upper-end part of the coil spring 85 abuts on the seal member 84. A lower-end part of the coil spring 85 abuts on the upper-end edge 828 of the first inlet port 821 of the branch head portion 82. The coil spring 85 biases the seal member 84 toward the seat portion 813, and thus the seal member 84 is kept in pressed contact with the seat portion 813. Inside the coil spring 85, the spherical member 83 is housed, and the coil spring 85 also serves to guide the movement of the spherical member 83 in the ink feed direction. In this way, the spherical member 83 in the valve pipe passage 81 has restricted play, and this stabilizes the valve structure that is achieved by the spherical member 83 moving into and out of contact with the seal member 84.

The O ring 86 seals the joint between the valve pipe passage 81 and the branch head portion 82. The O ring 86 is fitted around the outer circumferential face of the first inlet port 821, and abuts on a protruding base portion 829 of the first inlet port 821.

The pump 9 housed in the pump portion 32 is shown in FIG. 25. The pump 9 is arranged in the bypass pipe 32P, and pressurizes the ink that passes through the bypass pipe 32P. The pump 9 is a tube pump (peristaltic pump) provided with an eccentric cam 91 and a squeeze tube 92. Through a shaft hole 91A in the eccentric cam 91, a cam shaft 93 (FIG. 4) that serves as the rotation shaft of the eccentric cam 91 is inserted. The eccentric cam 91 is fed with a rotation driving force from a drive gear (not shown). The squeeze tube 92 is arranged around the circumferential face of the eccentric cam 91; as the eccentric cam 91 rotates about the cam shaft 93, the squeeze tube 92 is squeezed to feed the liquid (ink) inside it from one end to the other end. In the embodiment, the squeeze tube 92 is a tube integral with the bypass pipe 32P. That is, the one-end side of the squeeze tube 92 is arranged on the bypass upstream pipe BP1 side, which communicates with the bypass communication chamber 413 of the first chamber 41, and the other-end side of the squeeze tube 92 is arranged on the bypass downstream pipe BP2 side, which communicates with the second inlet port 822 of the branch head portion 82, with a middle part of the squeeze tube 92 arranged around the circumferential face of the eccentric cam 91 and serving as a squeezing portion.

As already mentioned, the pump 9 is at rest in the printing mode shown in FIG. 7. In that case, the eccentric cam 91 is at rest while keeping the squeeze tube 92 flattened, and thus the ink feed passage that passes through the bypass pipe 32P is closed. By contrast, in the circulating mode shown in FIG. 8 and in the pressurized purging mode shown in FIG. 9A, the pump 9 is driven in forward rotation. In FIG. 25, the direction of the forward rotation of the eccentric cam 91 is clockwise. With the pump 9 driven in forward rotation, ink is sucked from the first chamber 41 through the bypass upstream pipe BP1, and passes through the bypass downstream pipe BP2 toward the backflow prevention mechanism portion 38 constituting the joint portion a. When the pump 9 is driven in reverse rotation, as shown in FIG. 9B, the second chamber 42 and the downstream pipe 34 are negatively pressurized through the bypass pipe 32P and the branch head portion 82.

Next, the operation of the backflow prevention mechanism portion 38 will be described. In the printing mode, ink is fed to the head unit 21 through the feed route that runs from the second chamber 42 through the backflow prevention mechanism portion 38 and the downstream pipe 34. In the printing mode, as shown in FIG. 28A, the spherical member 83 is apart downward from the seal member 84 and rests on the upper-end edge 828 (sphere seat) of the branch head portion 82. This is because the specific gravity of the spherical member 83 is higher than that of ink, and the spherical member 83 descends under its own weight. The feed route that runs from the second chamber 42 to the downstream pipe 34 is, in the printing mode, kept at negative pressure, and every time the ink ejection portion 22 in the head unit 21 ejects ink droplets, the ink present in that feed route is sucked, and this too helps keep the spherical member 83 resting on the upper-end edge 828 of the spherical member 83.

The spherical member 83 moves away from the seal member 84, and thus the feed hole 42H is opened. The upper-end edge 828 of the first inlet port 821 on which the spherical member 83 rests is provided with notch portions 826, which secure a passage for ink. Thus, the ink in the second chamber 42 passes, as indicated by arrow F1 in the diagram, from the second chamber 42 through the branch head portion 82 toward the downstream pipe 34.

FIG. 28B is a sectional view showing the state of the backflow prevention mechanism portion 38 in the pressurized purging mode. In the pressurized purging mode, with the pump 9 driven in forward rotation, ink pressurized through the bypass pipe 32P is fed to the second inlet port 822 (joint portion a) of the branch head portion 82. Thus, pressurized ink is present in the bypass pipe 32P and in a part of the downstream pipe 34 located downstream of the joint portion a. In this case, the ink is pressurized to so high a pressure as to exceed 100 kPa. If, for discussion's sake, such a high pressure acts on the second chamber 42, the atmospheric pressure sensing film 7 which demarcates part of the second chamber 42 may burst, or its portion fitted to the second demarcation wall 421 may come off.

However, in the embodiment, the pressurizing force that acts on the joint portion a presses the spherical member 83 to make it ascend (move upstream with respect to the ink feed direction), and the spherical member 83 makes contact with the seal member 84. That is, the pressurizing force makes the spherical member 83 float up and fit into the ring of the seal member 84. As a result of the spherical member 83 making contact with the seal member 84 pressed against the seat portion 813 by the coil spring 85, the feed hole 42H is closed. That is, the part of the ink feed passage in the printing mode located upstream of the joint portion a as well as the second chamber 42 is shut off from the pressurizing by pressurized ink. It is thus possible to prevent breakage or the like of the atmospheric pressure sensing film 7.

The embodiment also has the advantage that the head unit 21 is unlikely to be fed with ink dispersed with air. If air dissolved in ink or air mixed when the liquid feeding unit 3 is loaded with ink liquid passes, in a state dispersed in ink, into the head unit 21 and enters the individual passages 26 and the common passage 27 (FIG. 6), it is difficult to vent the air, and it can be impossible to remove it even by performing pressurized purging. That hampers ejection of ink from the ink ejection holes 22H. However, in the embodiment, the second chamber 42, the backflow prevention mechanism portion 38, and the downstream pipe 34 are arranged in this order from top down. Thus, air released from the ink stored in the second chamber 42 or air mixed in the second chamber 42 does not pass toward the backflow prevention mechanism portion 38 or the downstream pipe 34, which are arranged downstream. It is thus possible to prevent ink dispersed with air from passing toward the head unit 21, and thereby to prevent ejection failure of the head unit 21.

Even if air mixes in the branch head portion 82 or the downstream pipe 34, since air bubbles float up, it can be led out from the vertical portion 82A through the valve pipe passage 81 and the feed hole 42H into the second chamber 42. The air can be discharged from the second chamber 42 by the air vent mechanism 37. It is thus possible to prevent air from occupying an excessively large part of the volume inside the second chamber 42.

Double Protection Mechanism with the Umbrella Valve

As described above, in the embodiment, the backflow prevention mechanism Portion 38 is provided to prevent a backflow of the ink pressurized in the pressurized purging mode to the second chamber 42. However, some failure in the backflow prevention mechanism portion 38, for example malfunction of the spherical member 83, may cause the pressurizing force to act on the second chamber 42. With this taken into consideration, in the embodiment, a mechanism that makes the opening-closing valve 6 release pressure is provided as a second protection mechanism. That is, the opening-closing valve 6 is furnished with a pressure release mechanism that releases pressure from the second chamber 42 to the first chamber 41 when the pressure relationship in normal condition, that is, one in which the second chamber 42 is at negative pressure and the first chamber 41 is at Atmospheric Pressure+ρgh, is reversed such that second chamber 42 is at a higher pressure than the first chamber 41.

The pressure release mechanism is achieved with the umbrella valve 66 in the opening-closing valve 6. As described previously with reference to FIGS. 16A, 16B, 17A, and 17B, the umbrella valve 66 so operates that, when the negative pressure (the absolute value of the negative pressure) in the second chamber 42 is lower than a predetermined threshold value, the sealing face 67 abuts on the sealing wall face 43S and seals the communication hole 43. Thus, ink is prevented from flowing from the first chamber 41 to the second chamber 42. On the other hand, when the negative pressure (the absolute value of the negative pressure) in the second chamber 42 exceeds the predetermined threshold value, the umbrella valve 66 along with the valve holder 61 coupled to the pressing member 5 moves leftward, so that the sealing face 67 moves away from the sealing wall face 43S and the communication hole 43 is opened (sealing is canceled). Thus, ink is permitted to flow from the first chamber 41 to the second chamber 42.

In addition, the umbrella valve 66 so operates that, when the pressure relationship between the second and first chamber 42 and 41 is reversed due to a factor such as the pressure of pressurized ink acting on the second chamber 42 in the pressurized purging mode, the umbrella valve 66 on its own opens the communication hole 43. That is, without being assisted by being pressed by the pressing member 5, the umbrella valve 66 cancels the sealing of the communication hole 43, and releases the pressure in the second chamber 42 to the first chamber 41. That is, when a predetermined pressure acts on the right-face side of the umbrella portion 661 (sealing face 67) of the umbrella valve 66, the umbrella shape of the umbrella portion 661 reverses.

Figure 29A:
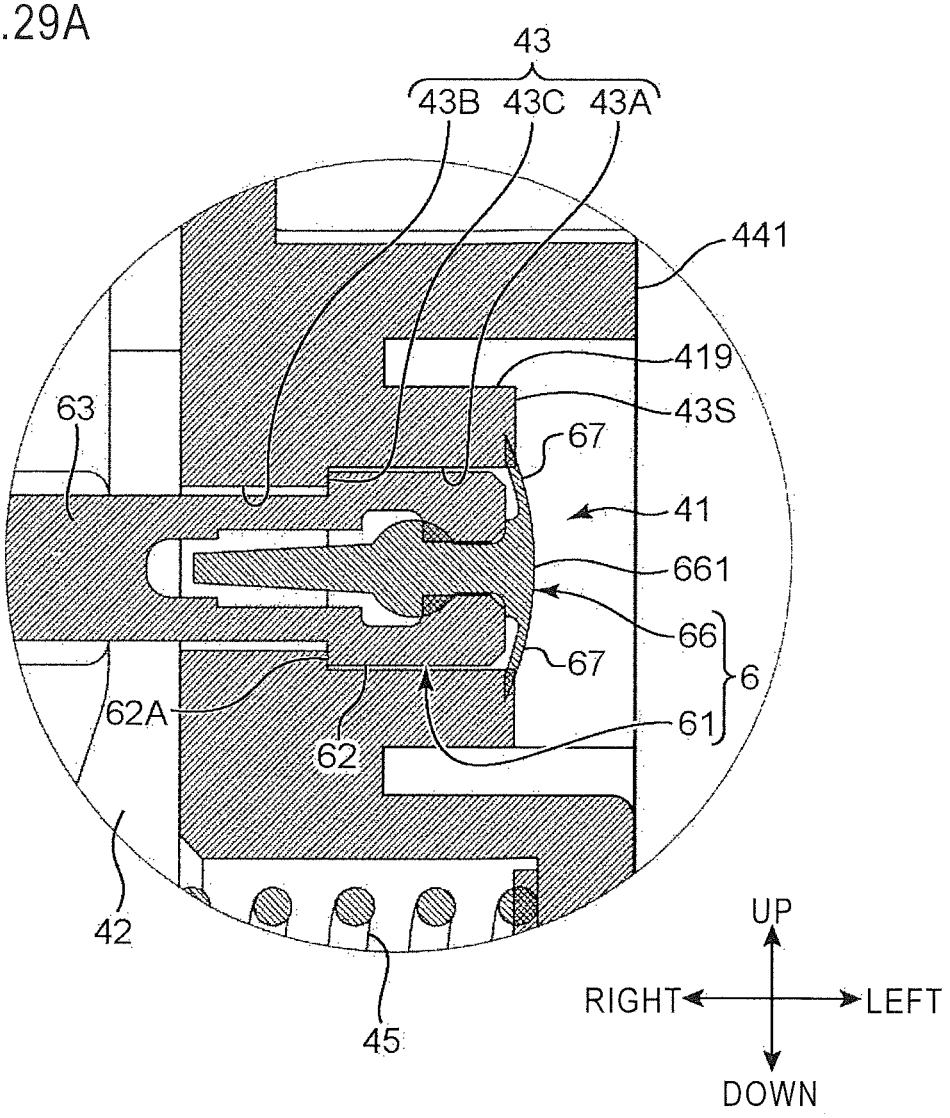
FIG. 29A is a sectional view showing a state where an umbrella valve keeps a communication hole sealed.
Figure 29B:
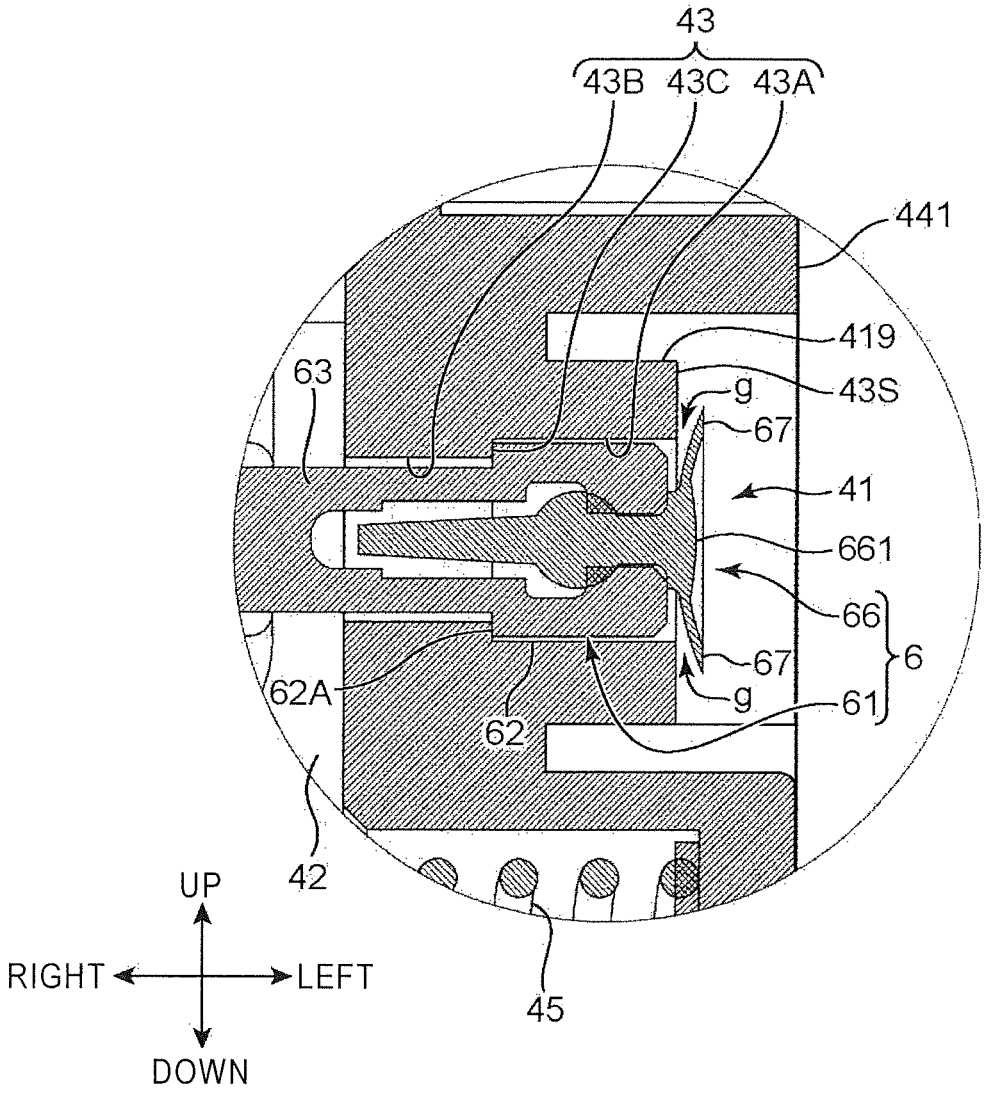
FIG. 29B is a sectional view showing a state where the umbrella valve leaves the communication hole open.

FIG. 29A is a sectional view showing a state where the umbrella valve 66 has the communication hole 43 sealed. FIG. 29B is a sectional view showing a state where the umbrella valve 66 has the communication hole 43 open. The state in FIG. 29A is the same as that in FIG. 16B described previously. The umbrella portion 661 has the shape of an umbrella convex leftward. The valve holder 61 is located at the rightmost position by the biasing force of the biasing spring 45, and the annular abutment portion 62A abuts on the step portion 43C of the communication hole 43. Thus, the sealing face 67 is in contact with the sealing wall face 43S.

The state in FIG. 29B is a state where the umbrella shape of the umbrella portion 661 has reversed under a pressure acting from the second chamber 42 side. That is, the umbrella portion 661 has deformed into an umbrella shape convex rightward. This reversed state occurs when the second chamber 42 is at a pressure a predetermined value higher than the first chamber 41. The embodiment assumes a case where a high positive pressure for pressurized purging acts on the second chamber 42 and consequently the second chamber 42 is at a higher pressure than the first chamber 41 at Atmospheric Pressure+ρgh. The predetermined pressure depends on the reversing pressure of the umbrella portion 661. The reversing pressure is set at a value lower than the burst strength of the atmospheric pressure sensing film 7 or the fitting strength of the atmospheric pressure sensing film 7 with respect to the second demarcation wall 421.

When the second chamber 42 is pressurized, the pressing member 5 does not pivot leftward. That is, the pressing member 5 does not exert a pressing force that presses the opening-closing valve 6 leftward. This is because, as the pressure in the second chamber 42 is increased, the atmospheric pressure sensing film 7 is displaced so as to bulge rightward and does not apply a displacing force to the pressed portion 5A. Accordingly, by the biasing force of the biasing spring 45, the valve holder 61 is kept at the rightmost position.

However, even though the valve holder 61 does not move, the umbrella shape of the umbrella portion 661 reverses; thus the sealing face 67 moves off the sealing wall face 43S, and a gap g is produced between them. Thus, the communication hole 43 is opened. Consequently, the pressurized ink (pressure) in the second chamber 42 is discharged (released) through the communication hole 43 to the first chamber 41. In this way, it is possible to prevent the atmospheric pressure sensing film 7 itself, or its fitting portion, from being acted on by an excessive force, and thereby to prevent breakage.

Ink Flow in Different Modes

Figure 30:
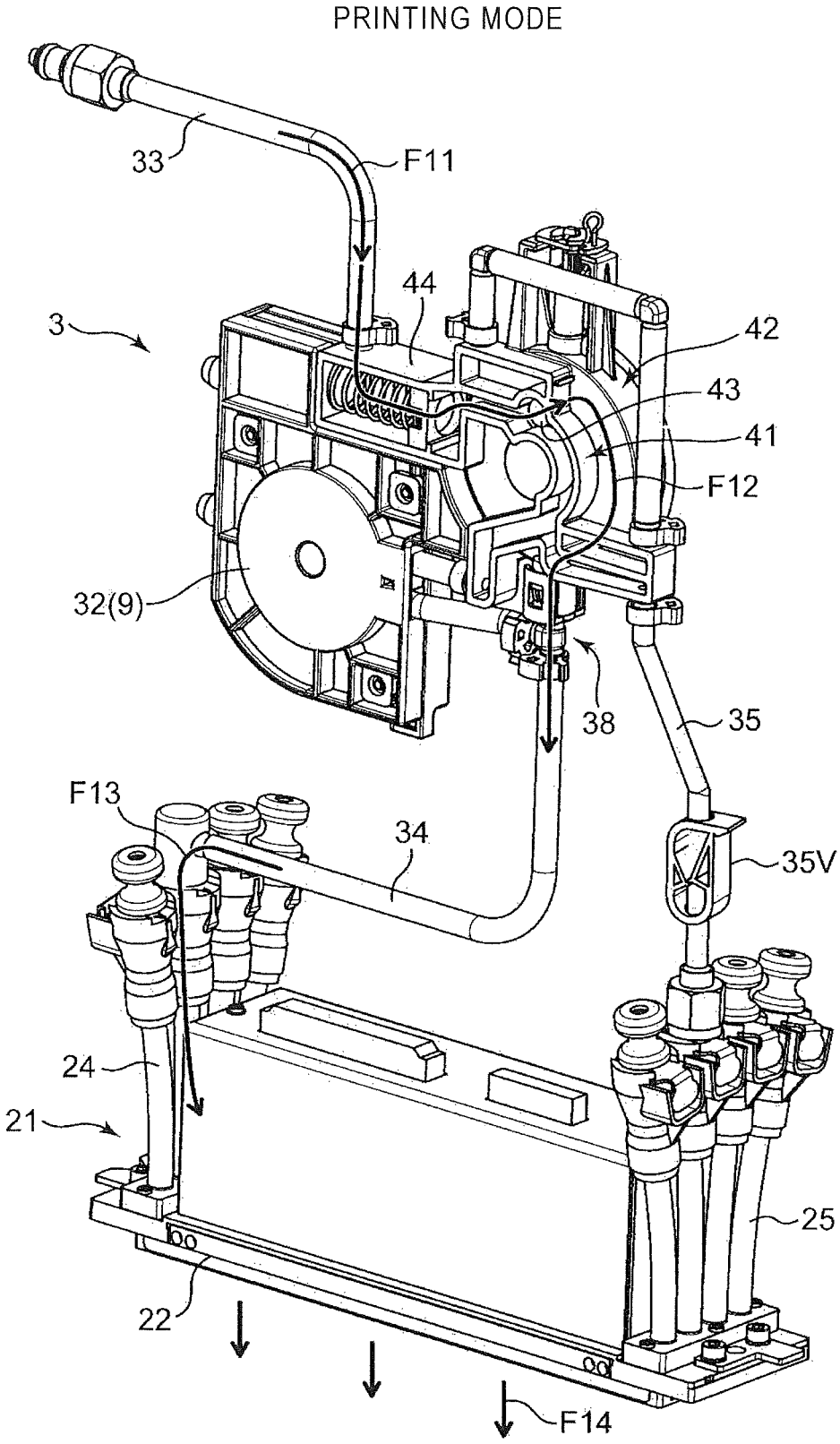
FIG. 30 is a perspective view showing the flow of ink in the printing mode.
Figure 31:
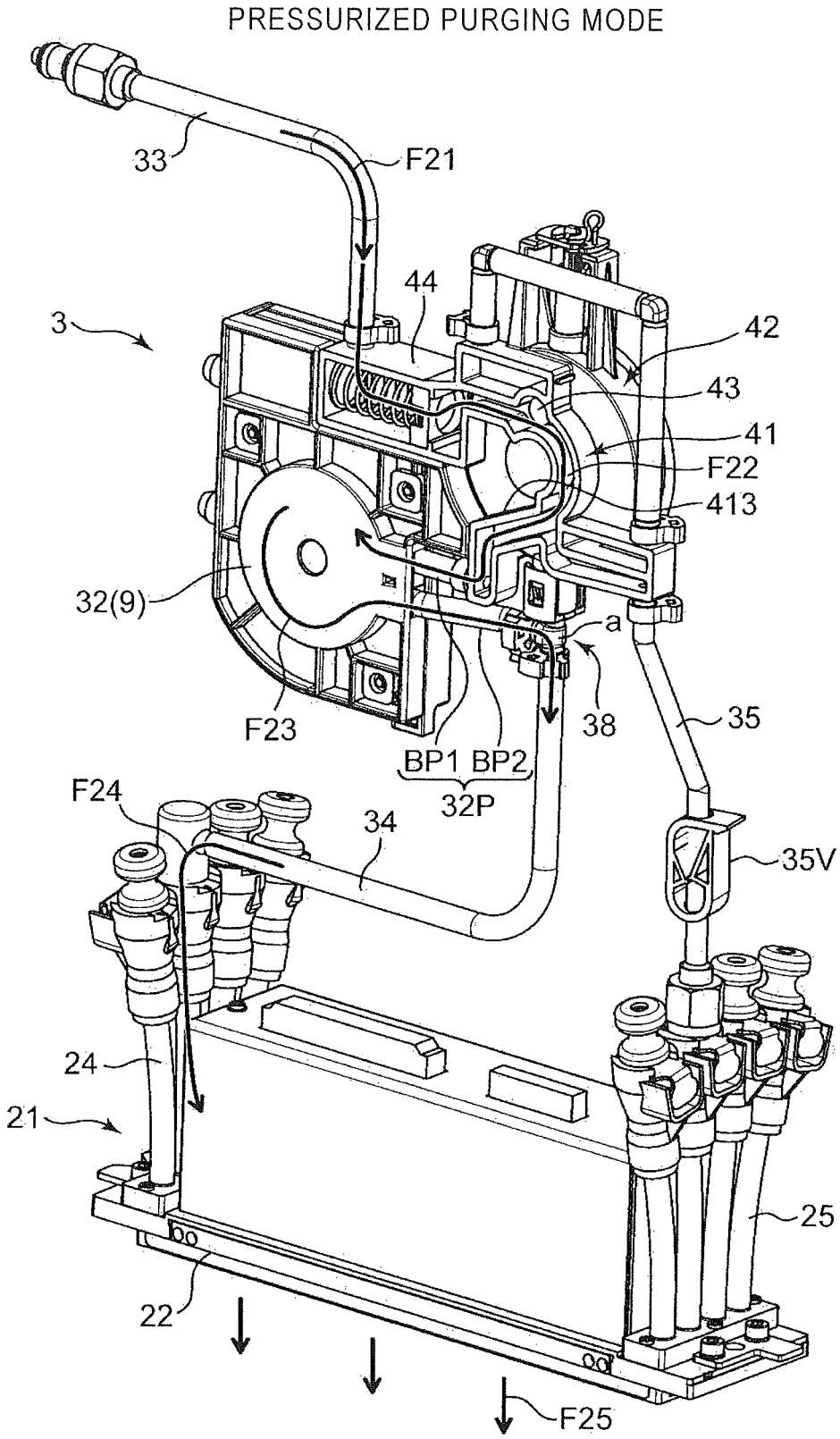
FIG. 31 is a perspective view showing the flow of ink in the pressurized purging mode.
Figure 32:
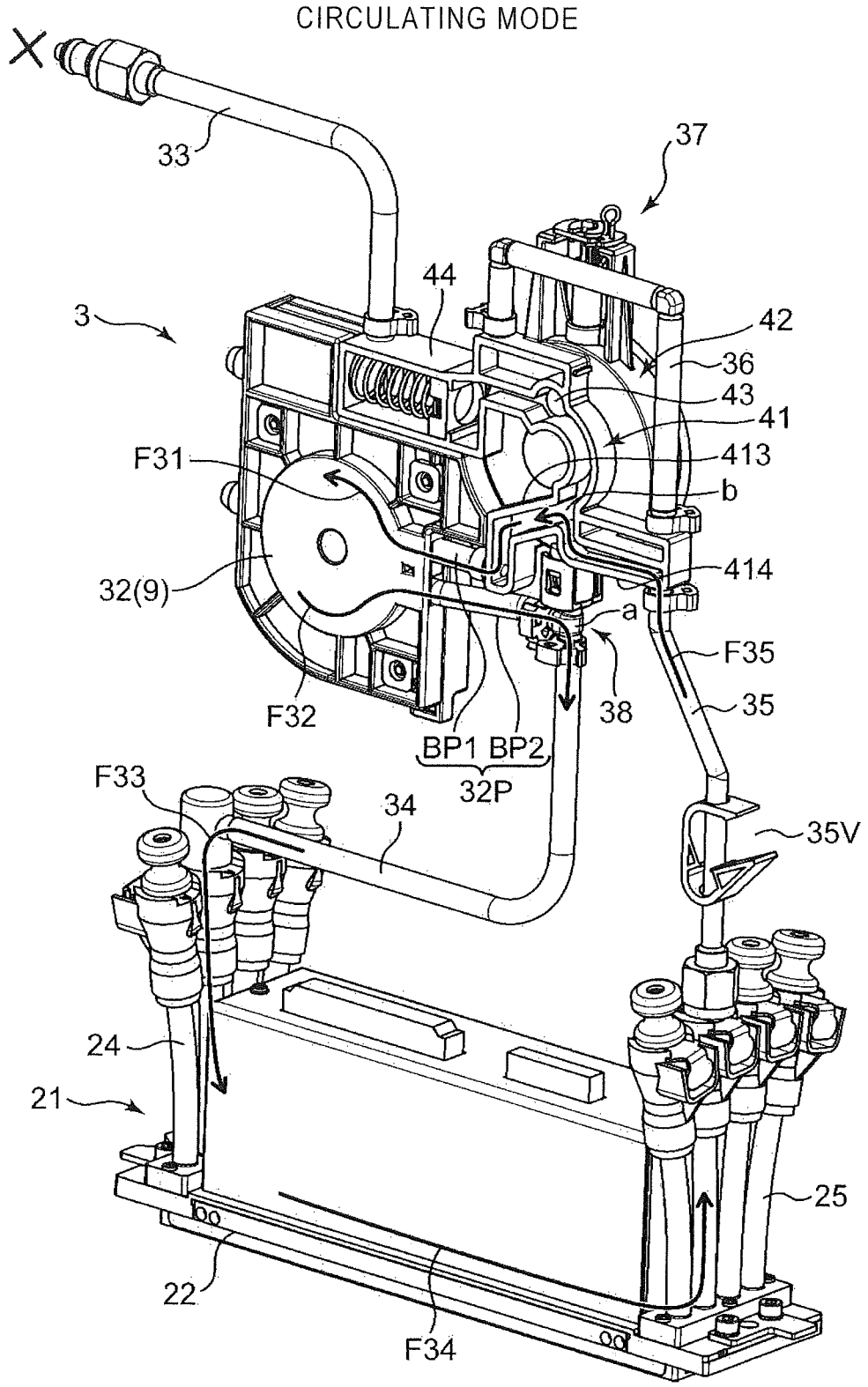
FIG. 32 is a perspective view showing the flow of ink in the circulating mode.

Next, the flow of ink in each mode of the liquid feeding unit 3 will be described. FIG. 30 is a perspective view showing the flow of ink in the printing mode. FIG. 31 is a perspective view showing the flow of ink in the pressurized purging mode. FIG. 32 is a perspective view showing the flow of ink in the circulating mode.

In the printing mode (FIG. 30), no circulation of ink using the return pipe 35 is performed, and thus the return pipe 35 is closed with the clip 35V. Needless to say, the feed valve 33V (FIG. 5) is open. As indicated by arrow F11 in FIG. 30, the ink ejected from the ink cartridge IC passes, due to the head difference, through the upstream pipe 33 into the filter chamber 44. As the ink passes through the filter member 442 in the filter chamber 44, solid foreign matter contained in the ink is removed. The ink then enters the first chamber 41.

When the pressing member 5 operates and the opening-closing valve 6 opens, as indicated by arrow F12, ink passes from the first chamber 41 through the communication hole 43 and is stored in the second chamber 42. By ink ejection operation in the ink ejection portion 22, the ink in the second chamber 42 is sucked, and passes through the feed hole 42H and subsequently the backflow prevention mechanism portion 38 to enter the downstream pipe 34. Then, as indicated by arrow F13, the ink passes through the end tube 24 and enters the common passage 27 (FIG. 6) in the head unit 21. The ink then passes through the individual passages 26 to be ejected from the ink ejection holes 22H (arrow F14).

Also in the pressurized purging mode (FIG. 31), no circulation of ink using the return pipe 35 is performed, and thus the return pipe 35 is closed with the clip 35V. The feed valve 33V (FIG. 5) is open. In the pressurized purging mode, the pump 9 is operated in forward rotation, and ink is forcibly, without reliance on the head difference, fed to the head unit 21. When the pump 9 operates, as indicated by arrow F21, ink passes through the upstream pipe 33 to enter the filter chamber 44, and then passes into the first chamber 41. Then, as indicated by arrow F22, the ink passes through the bypass communication chamber 413 and enters the bypass upstream pipe BP1 without passing toward the second chamber 42.

Squeezing operation by the pump 9 puts the ink under high pressure and delivers it downstream. That is, as indicated by arrow F23, the ink is delivered from the bypass downstream pipe BP2 to the downstream pipe 34. As described previously, the joint portion a at which the bypass downstream pipe BP2 joins the downstream pipe 34 is provided with the backflow prevention mechanism portion 38, and thus ink does not flow back toward the second chamber 42. Then, as indicated by arrow F24, the ink passes through the end tube 24 and enters the common passage 27 (FIG. 6) in the head unit 21. The ink then passes through the individual passages 26 and is ejected from the ink ejection holes 22H at high pressure (arrow F25). In this way, foreign matter clogging the ink ejection holes 22H, air detained in the individual passages 26, and the like are removed.

In the circulating mode (FIG. 32), circulation of ink using the return pipe 35 is performed; thus, sealing with the clip 35V is canceled, and the return pipe 35 is open. On the other hand, to enable circulation of ink between the liquid feeding unit 3 and the head unit 21, the feed valve 33V (FIG. 5) is closed. Thus, the bypass pipe 32P, the downstream pipe 34, the common passage 27 in the head unit 21, the return pipe 35, the return communication chamber 414, and the bypass communication chamber 413 form a closed ink circulation passage. Also in the circulating mode, as described previously with reference to FIG. 8, the pump 9 is operated in forward rotation.

When the pump 9 starts, ink starts to be circulated within the above-mentioned ink circulation passage. That is, as the pump 9 operates, ink is, as indicated by arrow F31, sucked from the bypass communication chamber 413 into the bypass upstream pipe BP1 and is then, as indicated by arrow F32, delivered to the bypass downstream pipe BP2. Then the ink passes through the joint portion a, the downstream pipe 34, and the end tube 24 into the head unit 21 (arrow F33), passes through the common passage 27 in the head unit 21, and enters the collection tube 25 (arrow F34). Then, as indicated by arrow F35, the ink passes from the collection tube 25 through the return pipe 35, the return communication chamber 414, and a joint portion b to return to the bypass communication chamber 413. At this time, since the feed valve 33V is closed, the return pipe 35 and the common passage 27 through which ink is sucked by the pump 9 are at negative pressure. This prevents ink from leaking through the ink ejection holes 22H during ink circulation.

By performing the circulating mode, it is possible to circulate ink within the ink circulation passage as described above. In other words, ink already delivered into the head unit 21 can be returned to the liquid feeding unit 3 by use of the return pipe 35. Thus, even if air enters the head unit 21 as a result of, for example, ink containing air being fed to it, it is possible, through the circulation described above, collect the air along with the ink in the liquid feeding unit 3. The air (air bubbles) collected in the liquid feeding unit 3 passes, with its own buoyant force, from the return communication chamber 414 into the first chamber 41 above, and moves to the second chamber 42 through the communication hole 43 arranged near the uppermost part of the first chamber 41. The user or serviceperson can discharge the air out of the second chamber 42 by operating the air vent mechanism 37 as necessary while monitoring air detention inside the second chamber 42 through the monitor pipe 36.

As described above, by performing the circulating mode, it is possible to prevent air from being detained in the individual passages 26 and near the ink ejection holes 22H in the head unit 21. Air that has entered the head unit 21 can be removed also in the pressurized purging mode. However, air having entered the head unit 21 is difficult to discharge, and its removal may require performing pressurized purging involving ejection of a considerable amount of ink. This leads to a large amount of ink being consumed simply to vent air from the head unit 21. However, in the circulating mode, ink is circulated and air is collected in the liquid feeding unit 3, and so no ink is consumed. Moreover, in the circulating mode, ink has simply to be circulated through the ink circulation passage mentioned above and does not need to be put under high pressure; thus, the pump 9 can be operated at low speed. It is thus possible to prevent the liquid feeding unit 3 from being acted on by a high pressure load, and thereby to prevent breakage of the atmospheric pressure sensing film 7 and the sealing film 7A.

Modified Examples

The embodiments disclosed herein should be understood to be in every aspect illustrative and not restrictive. The scope of the present disclosure is defined not by the description of the embodiments given above but by the appended claims, and encompasses any modifications made in a scope and sense equivalent to those of the claims. For example, modifications as described below are possible.

(1) The above embodiment deals with, as an example, a design where the liquid feeding unit 3 according to the present disclosure feeds ink to the head unit 21 in the inkjet printer 1. The liquid stored in and fed from the liquid feeding unit 3 is not limited to ink but may instead be any of various kinds of liquid. The target of storage in and feeding from the liquid feeding unit 3 may be any of water, various solutions, pharmaceutical liquids, industrial chemical liquids, and the like.

(2) The above embodiment deals with, as an example, a structure where the coil spring 446 presses the filter member 442 against the seal member 445. Instead, an assembly having the filter member 442 previously fitted to the holding member 443 may be fitted in the filter chamber 44 or in the first chamber 41.

(3) The above embodiment deals with an example where the filter chamber 44 (upstream chamber) in which the filter member 442 is arranged is provided upstream of the first chamber 41. The filter chamber 44 may be omitted, and instead the filter member 442 may be arranged near the inflow portion 412 of the first chamber 41.

(4) The above embodiment deals with an example where one filter member 442 is arranged in the filter chamber 44. Instead, a multiple stages of filter members 442 may be arranged along the ink feed direction in the filter chamber 44 or in the first chamber 41.

(5) The pressing member 5 and the opening-closing valve 6 are subject to a variety of modifications. The pressing member 5 may be so designed that the link bosses 54 are arranged between the pivot portions 53 and the pressed portion 5A so that the opening-closing valve 6 is pressed on the principle of leverage with the pivot portions 53 as the fulcrum, the pressed portion 5A as the point of effort, and the link bosses 54 as the point of load. Instead of the opening-closing valve 6 provided with the umbrella valve 66 taken as example, any other of various types of movable valve may be used as the opening-closing member. Although the above embodiment deals with an example where the pressing member 5 and opening-closing valve 6 are coupled by the link bosses 54 and the link pins 65, the link bosses 54 and the link pins 65 do not necessarily need to be coupled together. A structure is also possible where part of the pressing member 5 and part of the opening-closing valve 6 are kept in constant contact with each other via a spring or the like and through their contact the pressing member 5 presses the opening-closing valve 6.

(6) In the embodiment described above, the inkjet printer 1 is a printer suitable for printing on a large-size, long workpiece. The liquid feeding unit 3 according to the present disclosure is applicable equally to inkjet printers of any other types.

What is claimed is:

1. A liquid feeding unit comprising:

a first chamber to which a first feed passage is connected and to which liquid is fed through the first feed passage;

a second chamber to which the liquid is fed from the first chamber and to which a second feed passage for feeding the liquid is connected;

a wall portion having a communication hole through which the first and second chambers communicate with each other;

an opening-closing member arranged in the communication hole to open and close the communication hole; and a filter member arranged in the first feed passage or in the first chamber to remove foreign matter in the liquid.

2. The liquid feeding unit according to claim 1, wherein the filter member is a sheet-form member, and a holding member to which a peripheral part of the filter member is fastened is provided in the first feed passage or in the first chamber.

3. The liquid feeding unit according to claim 2, wherein the holding member includes:

a frame member having an opening serving as a flow passage for the liquid; and a ring-form seal member supported on the frame member, and the liquid feeding unit further comprises a fastening member which presses the peripheral part of the filter member against the seal member.

4. The liquid feeding unit according to claim 1, wherein a pressure in the first chamber is a first pressure, and a pressure in the second chamber as observed when the opening-closing member has the communication hole dosed is a second pressure lower than the first pressure.

5. A liquid ejection device comprising:

the liquid feeding unit according to claim 1; and a liquid ejection head that ejects the liquid, wherein the first feed passage is connected 4*ea* the liquid storage container in which the liquid is stored, the liquid is fed from the liquid storage container to the first chamber through the first feed passage, the second feed passage is connected to the liquid ejection head, and the liquid is fed from the second chamber to the liquid ejection head through the second feed passage.

6. The liquid ejection device according to claim 5, wherein the liquid storage container is arranged above the liquid ejection head so that, due to a head difference, the liquid is fed from the liquid storage container to the liquid ejection head, a pressure in the first chamber is a first pressure that is a sum of an atmospheric pressure and a pressure due to the head difference, and a pressure in the second chamber as observed when the opening-closing member has the communication hole closed is a second pressure lower than the first pressure.

7. A liquid feeding unit comprising:

a first chamber to which a first feed passage is connected and to which liquid is fed through the first feed passage;

a second chamber to which the liquid is fed from the first chamber and to which a second feed passage for feeding the liquid is connected;

a wall portion having a communication hole through which the first and second chambers communicate with each other;

an opening-closing member arranged in the communication hole to open and close the communication hole;

a filter member arranged in the first feed passage or in the first chamber to remove foreign matter in the liquid;

a fastening member; and an upstream chamber forming part of the first feed passage, wherein the filter member is a sheet-form member, a holding member to which a peripheral part of the filter member is fastened is provided in the first feed passage or in the first chamber, the holding member comprises:

a frame member having an opening serving as a flow passage for the liquid; and a ring-form seal member supported on the frame member, the fastening member presses the peripheral part of the filter member against the seal member, the upstream chamber has an inner wall face demarcating a cylindrical space extending in a liquid feed direction, the upstream chamber housing the holding member and the fastening member, the frame member is engaged with a downstream-end side of the inner wall face, and the fastening member is a coil spring fitted in the upstream chamber such that one end of the coil spring is locked at an upstream-end side of the inner wall face and another end of the coil spring presses the peripheral part of the filter member against the seal member.

8. A liquid ejection device comprising:

the liquid feeding unit according to claim 7; and a liquid ejection head that ejects the liquid, wherein the first feed passage is connected to a liquid storage container in which the liquid is stored, the liquid is fed from the liquid storage container to the first chamber through the first feed passage, the second feed passage is connected to the liquid ejection head, and the liquid is fed from the second chamber to the liquid ejection head through the second feed passage.

9. A liquid feeding unit comprising:

a first chamber to which a first feed passage is connected and to which liquid is fed through the first feed passage;

a second chamber to which the liquid is fed from the t chamber and to which a second feed passage for feeding the liquid is connected;

a wall portion having a communication hole through which the first and second chambers communicate with each other;

an opening-closing member arranged in the communication hole to open and close the communication hole;

a filter member arranged in the first feed passage or n the first chamber o remove foreign matter in the liquid;

a biasing member which biases the opening-closing member in a direction in which the opening-closing member closes the communication hole;

a flexible film member which is displaced based on a pressure in the second chamber; and a pressing member which presses the opening-closing member in a direction in which the opening-closing member opens the communication hole based on a pressing force transmitted from the flexible film member.

10. A liquid ejection device comprising:

the liquid feeding unit according to claim 9; and a liquid ejection head that ejects the liquid, wherein the first feed passage is connected to a liquid storage container in which the liquid is stored, the liquid is fed from the liquid storage container to the first chamber through the first feed passage, the second feed passage is connected to the liquid ejection head, and the liquid is fed from the second chamber to the liquid ejection head through the second feed passage.

* * * * *